US009843111B2

(12) United States Patent
Ying et al.

(10) Patent No.: US 9,843,111 B2
(45) Date of Patent: Dec. 12, 2017

(54) ANTENNAS INCLUDING AN ARRAY OF DUAL RADIATING ELEMENTS AND POWER DIVIDERS FOR WIRELESS ELECTRONIC DEVICES

(71) Applicant: Sony Corporation, Tokyo (JP)

(72) Inventors: Zhinong Ying, Lund (SE); Kun Zhao, Stockholm (SE)

(73) Assignee: Sony Mobile Communications Inc., Tokyo (JP)

( * ) Notice: Subject to any disclaimer, the term of this patent is extended or adjusted under 35 U.S.C. 154(b) by 293 days.

(21) Appl. No.: 14/699,033

(22) Filed: Apr. 29, 2015

(65) Prior Publication Data

US 2016/0322714 A1 Nov. 3, 2016

(51) Int. Cl.
*H01Q 21/30* (2006.01)
*H01Q 3/24* (2006.01)
(Continued)

(52) U.S. Cl.
CPC ..... *H01Q 21/30* (2013.01); *H01Q 1/38* (2013.01); *H01Q 1/50* (2013.01); *H01Q 3/24* (2013.01);
(Continued)

(58) Field of Classification Search
CPC H01Q 21/30; H01Q 1/38; H01Q 1/50; H01Q 3/24; H01Q 9/0407; H01Q 9/0457;
(Continued)

(56) References Cited

U.S. PATENT DOCUMENTS 9,609,530 B2 * 3/2017 Lea ..... H04W 24/02
2004/0239565 A1 * 12/2004 Brachat ..... H01Q 9/0414 343/700 MS
(Continued)

FOREIGN PATENT DOCUMENTS

EP 2 276 116 A1 1/2011

OTHER PUBLICATIONS

Notification of Transmittal of the International Search Report and the Written Opinion of the International Searching Authority, International Application No. PCT/JP2015/005462, dated Apr. 25, 2016 (22 pages).
(Continued)

*Primary Examiner* — Dameon E Levi
*Assistant Examiner* — David Lotter
(74) *Attorney, Agent, or Firm* — Myers Bigel P.A.

(57) ABSTRACT

A wireless electronic device includes dual radiating antennas, with each of the dual radiating antennas including a first radiating element and a second radiating element. The wireless electronic device includes power dividers, a respective one of which is associated with a respective one of the dual radiating antennas and is configured to divide the power of a signal into a first portion of the power and a second portion of the power. The first portion of the power is applied to a respective first radiating element and the second portion of the power is applied to the respective second radiating element. The wireless electronic device is configured to resonate at a resonant frequency corresponding to the first radiating element and/or the second radiating element of at least one of the plurality of dual radiating antennas when excited by a signal transmitted by at least one of the plurality of dual radiating antennas.

25 Claims, 43 Drawing Sheets

(51) Int. Cl.

| | |
|---|---|
| ***H01Q 9/04*** | (2006.01) |
| ***H01Q 21/00*** | (2006.01) |
| ***H01Q 21/28*** | (2006.01) |
| ***H01Q 25/00*** | (2006.01) |
| ***H01Q 1/38*** | (2006.01) |
| ***H01Q 1/50*** | (2006.01) |
| *H01Q 1/24* | (2006.01) |

(52) U.S. Cl.
CPC ..... *H01Q 9/0407* (2013.01); *H01Q 9/0457* (2013.01); *H01Q 9/0485* (2013.01); *H01Q 21/0075* (2013.01); *H01Q 21/28* (2013.01); *H01Q 25/002* (2013.01); *H01Q 25/005* (2013.01); *H01Q 1/243* (2013.01)

(58) Field of Classification Search
CPC .. H01Q 9/0485; H01Q 21/0075; H01Q 21/28; H01Q 25/002; H01Q 25/005; H01Q 1/243
USPC ..... 343/853
See application file for complete search history.

(56) References Cited

U.S. PATENT DOCUMENTS

2005/0110685 A1* 5/2005 Frederik du Toit . H01Q 19/005 343/700 MS
2009/0174613 A1 7/2009 Liu et al.

OTHER PUBLICATIONS

Ihara et al., "Switched Four-Sector Beam Antenna for Indoor Wireless LAN Systems in the 60 GHz Band", 1997 Topical Symposium on Millimeter Waves, Jul. 7, 1997, pp. 115-118.
Invitation to Pay Additional Fees, and, Where Applicable, Protest Fee, in corresponding PCT Application No. PCT/JP2015/005462, dated Feb. 18, 2016 (pages).
Lee, H.M., "Pattern Reconfigurable Micro-strip Patch Array Antenna using Switchable Feed-Network", 2010 Asia-Pacific Microwave Conference Proceedings (APMC), Dec. 7, 2010, pp. 2017-2020.

* cited by examiner

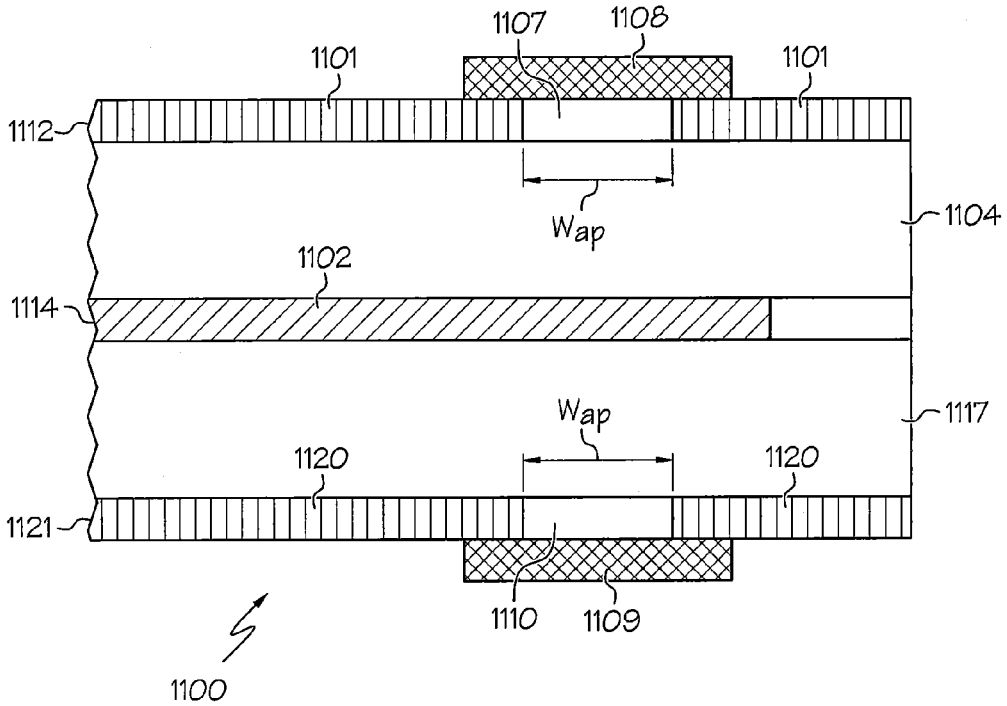
FIG. 11A
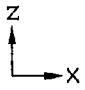

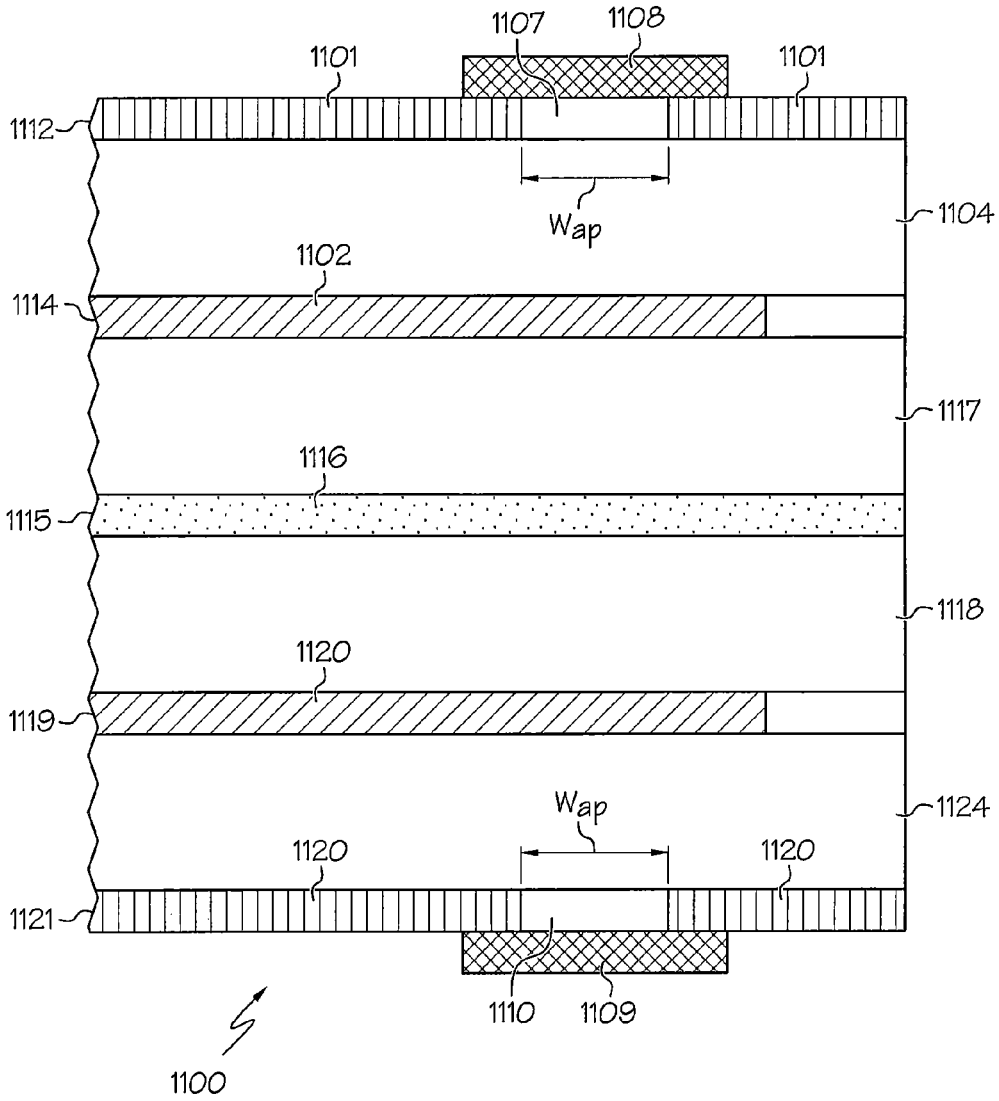
FIG. 11B
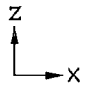

ANTENNAS INCLUDING AN ARRAY OF DUAL RADIATING ELEMENTS AND POWER DIVIDERS FOR WIRELESS ELECTRONIC DEVICES

TECHNICAL FIELD

The present inventive concepts generally relate to the field of wireless communications and, more specifically, to antennas for wireless communication devices.

BACKGROUND

Wireless communication devices such as cell phones and other user equipment may include antennas that may be used to communicate with external devices. These antennas may produce broad radiation patterns. Some antenna designs, however, may facilitate irregular radiation patterns whose main beam is directional.

SUMMARY

Various embodiments of the present inventive concepts include a wireless electronic device including a plurality of dual radiating elements, each of which includes a first radiating element and a second radiating element. The wireless electronic device may include a plurality of power dividers, a respective one of which is associated with a respective one of the plurality of dual radiating antennas, and may be configured to divide a power of a signal into a first portion of the power and a second portion of the power, and may be configured to apply the signal at the first portion of the power to the respective first radiating element and to apply the signal at the second portion of the power to the respective second radiating element. The wireless electronic device may be configured to resonate at a resonant frequency corresponding to a respective first radiating element and/or a respective second radiating element of at least one of the plurality of dual radiating antennas when excited by the signal transmitted by at least one of the plurality of dual radiating antennas.

According to various embodiments, a respective one of the plurality of dual radiating antennas may be configured such that a first polarization of the signal at the first portion of the power applied to the first radiating element is orthogonal to a second polarization of the signal at the second portion of the power applied to the second radiating element. According to various embodiments, a third polarization of a respective first radiating element of a first one of the plurality of dual radiating antennas may be orthogonal to a fourth polarization of a respective first radiating element of a second one of the plurality of dual radiating antennas that is adjacent the first one of the plurality of dual radiating antennas. According to various embodiments, a fifth polarization of a respective second radiating element of the first one of the plurality of dual radiating antennas may be orthogonal to a sixth polarization of a respective second radiating element of the second one of the plurality of dual radiating antennas that is adjacent the first one of the plurality of dual radiating antennas. According to various embodiments, the third polarization may be orthogonal to the fifth polarization, and/or the fourth polarization may be orthogonal to the sixth polarization.

According to various embodiments, the wireless electronic device may include a first subarray comprising a first plurality of the dual radiating antennas and a first plurality of power dividers, a respective one of which is associated with a respective one of the first plurality of the dual radiating antennas. The wireless electronic device may include a second subarray including a second plurality, exclusive of the first plurality, of the dual radiating antennas and a second plurality of power dividers, a respective one of which is associated with a respective one of the second plurality of the dual radiating antennas. In some embodiments, the first subarray and/or the second subarray may be configured to transmit multiple-input and multiple-output (MIMO) communication and/or diversity communication.

According to various embodiments, the plurality of dual radiating antennas may be further configured such that a seventh polarization of signals at each of the first radiating elements of the first plurality of the dual radiating antennas of the first subarray may be orthogonal to an eighth polarization of signals at each of the first radiating elements of the second plurality of the dual radiating antennas of the second subarray. The plurality of dual radiating antennas may be configured such that a ninth polarization of signals at each of the second radiating elements of the first plurality of the dual radiating antennas of the first subarray may be orthogonal to a ninth polarization of signals at each of the second radiating elements of the second plurality of the dual radiating antennas of the second subarray.

According to various embodiments, the first plurality of power dividers of the first subarray may be each configured to provide the signal at the first portion of the power of the signal that is greater than zero. The second plurality of power dividers of the second subarray may be each configured to provide the signal at the second portion of the power of the signal that is greater than zero.

According to various embodiments, the first plurality of power dividers of the first subarray may be each configured to provide the signal at the first portion of the power of the signal that is greater than zero, and/or the second plurality of power dividers of the second subarray may be each configured to provide the signal at the second portion of the power of the signal that is greater than zero, in response to a signal strength of the signal being less than a first threshold. In some embodiments, the first plurality of power dividers of the first subarray may be each configured to provide all of the power of the signal to the first radiating element and the second plurality of power dividers of the second subarray may be each configured to provide all of the power of the signal to the second radiating element, or the first plurality of power dividers of the first subarray may be each configured to provide all of the power of the signal to the second radiating element and the second plurality of power dividers of the second subarray may be each configured to provide all of the power of the signal to the first radiating element.

According to various embodiments, the first plurality of power dividers of the first subarray may be each configured to provide all of the power of the signal to the first radiating element and the second plurality of power dividers of the second subarray may be each configured to provide all of the power of the signal to the second radiating element, or the first plurality of power dividers of the first subarray may be each configured to provide all of the power of the signal to the second radiating element and the second plurality of power dividers of the second subarray may be each configured to provide all of the power of the signal to the first radiating element, in response to a signal strength of the signal being greater than a first threshold and less than a second threshold.

According to various embodiments, a selected one of the first plurality of power dividers of the first subarray or the second plurality of power dividers of the second subarray may be configured to provide all of the power of the signal to a respective first radiating element and zero power to a respective second radiating element of a respective dual radiating antenna or may be configured to provide all of the power of the signal to a respective second radiating element and zero power to a respective first radiating element of a respective dual radiating antenna. The remaining ones of the first plurality of power dividers of the first subarray and the second plurality of power dividers of the second subarray, exclusive of the selected one, may be configured to provide zero power to respective first radiating elements and respective second radiating elements of respective dual radiating antennas.

According to various embodiments, the selected one of the first plurality of power dividers of the first subarray or the second plurality of power dividers of the second subarray may be configured to provide all of the power of the signal to the respective first radiating element and zero power to the respective second radiating element of the respective dual radiating antenna or may be configured to provide all of the power of the signal to the respective second radiating element and zero power to the respective first radiating element of the respective dual radiating antenna, in response to a signal strength of the signal being greater than a second threshold.

According to various embodiments, the wireless electronic device may include a control signal that is applied to the respective one of the plurality of power dividers and that provides an indication of a value of the first portion of the power and/or the second portion of the power. In some embodiments, the wireless electronic device may include a controller that is configured to generate the control signal.

According to various embodiments, the first radiating element may include a first dielectric block, and/or the second radiating element may include a second dielectric block. According to various embodiments, the first radiating element may include a first patch element, and/or the second radiating element may include a second patch element.

According to various embodiments, the wireless electronic device may include a plurality of first striplines and a plurality of second striplines. A respective one of the plurality of the first striplines and a respective one of the plurality of the second striplines may be electrically coupled to a respective one of the plurality of power dividers. A respective one of the plurality of the first striplines may be associated with the first radiating element of the respective one of the plurality of dual radiating antennas, and/or a respective one of the plurality of the second striplines may associated with the second radiating element of the respective one of the plurality of dual radiating antennas.

According to various embodiments, the wireless electronic device may include a first conductive layer including a plurality of first slots, and/or a second conductive layer including the plurality of first striplines. A respective one of the plurality of first slots may be associated with a respective one of the plurality of first striplines. The wireless electronic device may include a third conductive layer with the plurality of second striplines and/or a fourth conductive layer with a plurality of second slots. A respective one of the plurality of second slots may be associated with a respective one of the plurality of second striplines. The first, second, third, and fourth conductive layers may be arranged in a face-to-face relationship, separated from one another by first, second, and third dielectric layers, respectively.

According to various embodiments a wireless electronic device may include first, second, third, and fourth conductive layers arranged in a face-to-face relationship, separated from one another by first, second, and third dielectric layers, respectively. The wireless electronic device may include a plurality of first radiating elements and/or a plurality of second radiating elements. The first conductive layer may include a plurality of first slots, the second conductive layer may include a plurality of first striplines, the third conductive layer may include a plurality of second striplines, and/or the fourth conductive layer may include a plurality of second slots. In some embodiments, respective ones of the plurality of second radiating elements may be associated with and at least partially overlap respective ones of the plurality of first radiating elements. In some embodiments, a respective one of the plurality of first radiating elements may be associated with and at least partially overlap a respective one of the plurality of the first slots, and/or a respective one of the plurality of second radiating elements may be associated with and at least partially overlaps a respective one of the plurality of the second slots. In some embodiments, the wireless electronic device may be configured to resonate at a resonant frequency corresponding to at least one of the plurality of the first radiating elements and/or at least one of the plurality of second radiating elements when excited by a signal transmitted and/or received though the first stripline and/or second stripline. According to various embodiments, a first one of the plurality of the first radiating elements and a respective first one of the plurality of the second radiating elements may be configured such that a first polarization of the signal at the first one of the plurality of the first radiating elements is orthogonal to a second polarization of the signal at the respective first one of the plurality of the second radiating elements.

According to various embodiments, a second one of the plurality of the first radiating elements and a respective second one of the plurality of the second radiating elements may be configured such that a third polarization of the signal at the second one of the plurality of the first radiating elements is orthogonal to a fourth polarization of the signal at the respective second one of the plurality of the second radiating elements. The first one of the plurality of the first radiating elements and the respective second one of the plurality of the first radiating elements may be adjacent to one another, and/or the first one of the plurality of the second radiating elements and the respective second one of the plurality of the second radiating elements may be adjacent to one another. In some embodiments, the third polarization may be orthogonal to the first polarization.

According to various embodiments, the wireless electronic device may include a plurality of power dividers. A respective one of the plurality of the power dividers may be electrically coupled to a respective one of the plurality of the first striplines and a respective one of the plurality of the second striplines. A respective one of the plurality of the first striplines may be configured to receive the signal at the first portion of a power of the signal from a respective one of the power dividers and/or a respective one of the plurality of the second striplines may be configured to receive the signal at a second portion of the power of the signal from the respective one of the power dividers. The wireless electronic device may include a fifth conductive layer including the plurality of first radiating elements, and/or a sixth conductive layer including the plurality of second radiating elements. The plurality of first radiating elements may include a plurality of first patch elements, and/or the plurality of second radiating elements may include a plurality of second patch elements.

According to various embodiments, the wireless electronic device may include a controller that is configured to generate a control signal that is applied to the respective one of the plurality of the power dividers and that provides an indication of a value of the first portion of the power and/or a second portion of the power. According to various embodiments, the plurality of first radiating elements may include a plurality of first dielectric blocks on the first conductive layer. A respective one of the plurality of the first dielectric blocks may at least partially overlap a respective one of the plurality of first slots. The plurality of second radiating elements may include a plurality of second dielectric blocks on the fourth conductive layer, and/or a respective one of the plurality of the second dielectric blocks may at least partially overlap a respective one of the plurality of second slots.

Other devices and/or operations according to embodiments of the inventive concepts will be or become apparent to one with skill in the art upon review of the following drawings and detailed description. It is intended that all such additional devices and/or operations be included within this description, be within the scope of the present inventive concepts, and be protected by the accompanying claims. Moreover, it is intended that all embodiments disclosed herein can be implemented separately or combined in any way and/or combination.

BRIEF DESCRIPTION OF THE DRAWINGS

The accompanying drawings, which are included to provide a further understanding of the present disclosure and are incorporated in and constitute a part of this application, illustrate certain embodiment(s). In the drawings:

FIGS. 11A and 11B illustrate dual DRA antennas, according to various embodiments of the present inventive concepts.

DETAILED DESCRIPTION

Figure 1A:
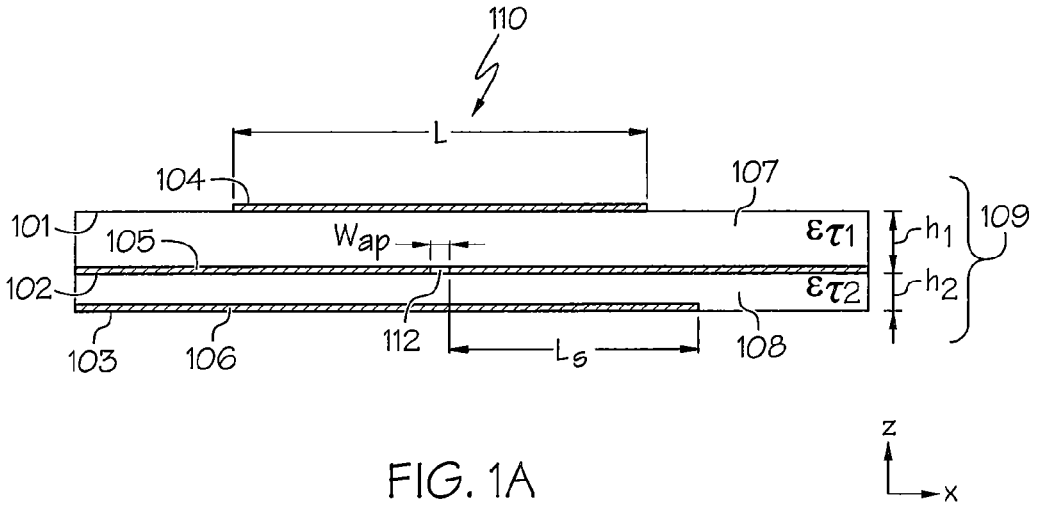
FIG. 1A illustrates a single patch antenna on a printed circuit board (PCB), according to various embodiments of the present inventive concepts.

The present inventive concepts now will be described more fully with reference to the accompanying drawings, in which embodiments of the inventive concepts are shown. However, the present application should not be construed as limited to the embodiments set forth herein. Rather, these embodiments are provided so that this disclosure will be thorough and complete, and to fully convey the scope of the embodiments to those skilled in the art. Like reference numbers refer to like elements throughout.

The contents of U.S. patent application Ser. No. 14/681,432 filed on Apr. 8, 2015 are replicated herewith in the Specification of the present application under the heading "Antenna Including Dual Radiating Elements" and as well as corresponding to FIGS. 1A to 18 of the present application. Additional embodiments are described in the section under the heading "Antenna Including an Array of Dual Radiating Elements and Power Dividers" and may be combined with any of the previous embodiments. Additionally, FIGS. 19 to 34 have been added herewith and may be combined with any of previous FIGS. 1A to 18.

Antenna Including Dual Radiating Elements

A patch antenna is commonly used in microwave antenna design for wireless electronic devices such as mobile terminals. A patch antenna may include a radiating element on a printed circuit board (PCB). As used herein, a PCB may include any conventional printed circuit board material that is used to mechanically support and electrically connect electronic components using conductive pathways, tracks or signal traces. The PCB may comprise laminate, copper-clad laminates, resin-impregnated B-stage cloth, copper foil, metal clad printed circuit boards and/or other conventional printed circuit boards. In some embodiments, the printed circuit board is used for surface mounting of electronic components thereon. The PCB may include one or more integrated circuit chip power supplies, integrated circuit chip controllers and/or other discrete and/or integrated circuit passive and/or active microelectronic components, such as surface mount components thereon. The PCB may comprise a multilayered printed wiring board, flexible circuit board, etc., with pads and/or metal traces that are on the surface of the board and/or on intervening layers of the PCB.

Patch antenna designs may be compact in size and easy to manufacture since they may be implemented as printed features on PCBs. A dielectric resonator antenna (DRA) is also commonly used in microwave antenna design for wireless electronic devices such as mobile terminals. The DRA may include a radiating element such as a flux couple on a PCB with a dielectric block on the flux couple.

Various wireless communication applications may use patch antennas and/or DRAs. Patch antennas and/or DRAs may be suitable for use in the millimeter band radio frequencies in the electromagnetic spectrum from 10 GHz to 300 GHz. Patch antennas and/or DRAs may each provide radiation beams that are quite broad. A potential disadvantage of patch antenna designs and/or DRA designs may be that the radiation pattern is directional. For example, if a patch antenna is used in a mobile device, the radiation pattern may only cover half the three dimensional space around the mobile device. In this case, the antenna produces a radiation pattern that is directional, and may require the mobile device to be directed towards the base station for adequate operation.

Various embodiments described herein may arise from the recognition that the patch antenna and/or the DRA may be improved by adding another radiating element on or near the opposite side of the printed circuit board, producing a dual patch antenna and/or a dual DRA design. The dual radiating elements may improve the antenna performance by producing a radiation pattern that covers the three-dimensional space around the mobile device.

Referring now to FIG. 1A, the diagram illustrates a single patch antenna 110 on a printed circuit board (PCB) 109. The PCB 109 includes a first conductive layer 101, a second conductive layer 102, and a third conductive layer 103. The first, second, and/or third conductive layers (101, 102, 103) may be arranged in a face-to-face relationship. The first, second, and third conductive layers (101, 102, 103) are separated from one another by a first dielectric layer 107 and/or a second dielectric layer 108, respectively. A first radiating element 104 may be in the first conductive layer 101. A stripline 106 may be in the third conductive layer of the single patch antenna 110. A ground plane 105 may be in the second conductive layer 102. The ground plane 105 may include an opening or slot 112. The width of the slot 112 may be $W_{ap}$. A signal may be received and/or transmitted through the stripline 106, causing the single patch antenna 110 to resonate.

Figure 1B:
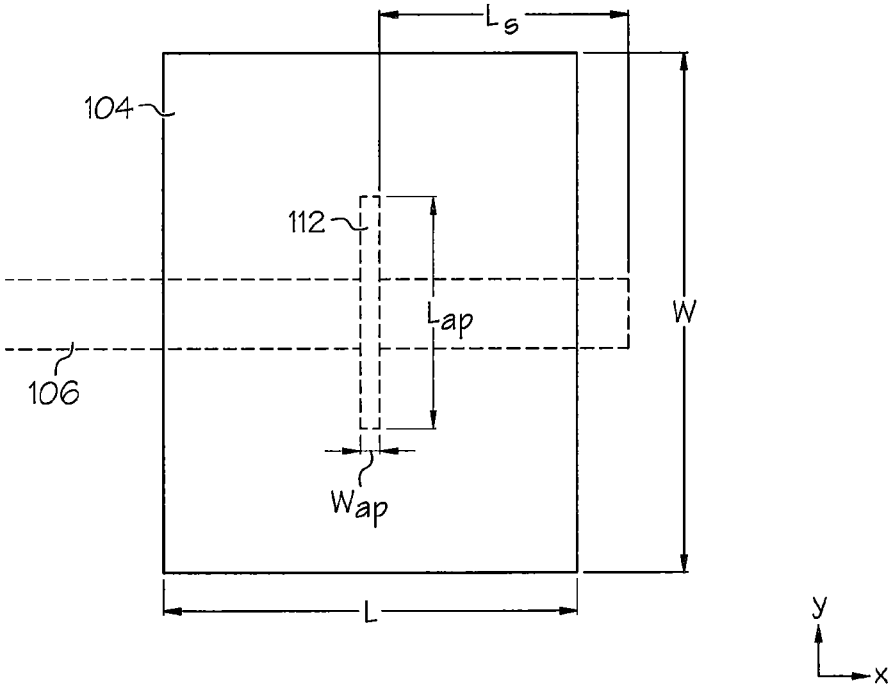
FIG. 1B illustrates a plan view of the single patch antenna of FIG. 1A, according to various embodiments of the present inventive concepts.

Referring now to FIG. 1B, a plan view of the single patch antenna 110 of FIG. 1A is illustrated. The first radiating element 104 may have a length L and width W. The first radiating element 104 may overlap the stripline 106. The stripline may overlap a slot 112 in the ground plane of the single patch antenna 110. The slot 112 in the ground plane of the single patch antenna 110 may have width $W_{ap}$ and/or length $L_{ap}$. In some embodiments, the stripline 106 may extend beyond the first radiating element 104, for a length $L_s$ from the slot 112.

Electromagnetic properties of the described antenna structures may be determined by physical dimensions and/or other parameters. For example, parameters such as stripline width, stripline positioning, dielectric layer thickness, dielectric layer permittivity, dimensions $W_{ap}$ and/or length $L_{ap}$ of the slot in the ground plane, and/or dimensions L and/or W of the first radiating element 104 may affect the electromagnetic properties of antenna structures and subsequently the antenna performance. In some embodiments, the relative permittivity of the first dielectric layer 107 may be $\in\tau_1$ while the relative permittivity of the second dielectric layer may be $\in\tau_2$. $\in\tau_2$ may be different from $\in\tau_1$.

Figure 1C:
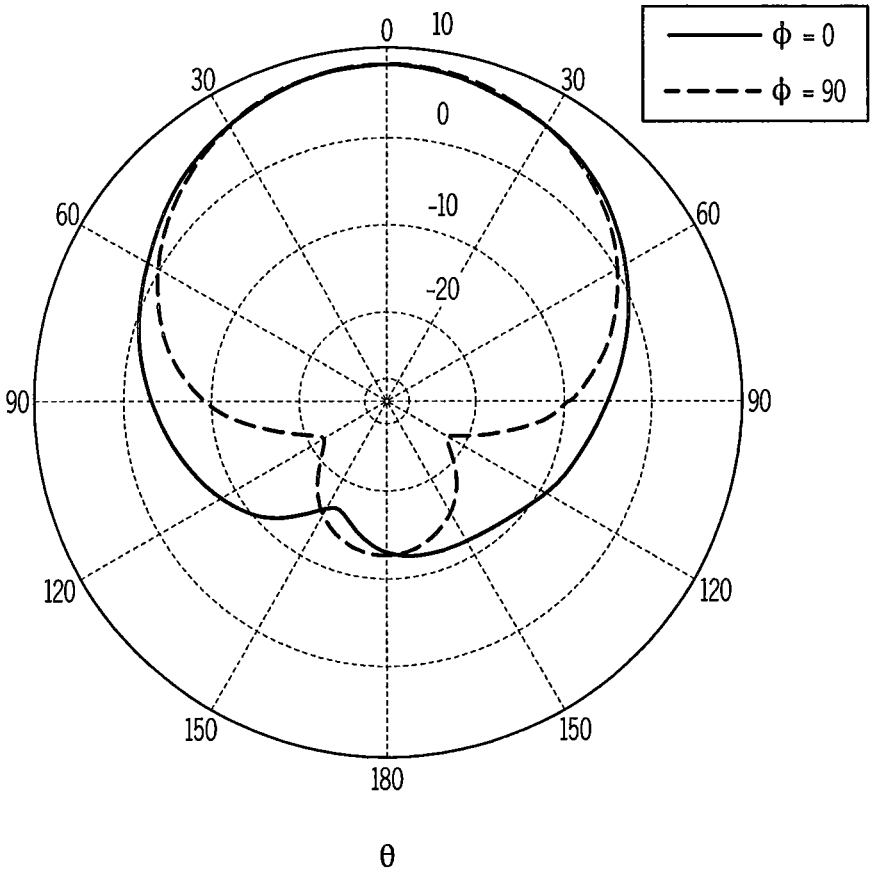
FIG. 1C illustrates radiation patterns at two different phases for the single patch antenna of FIGS. 1A and 1B, according to various embodiments of the present inventive concepts.

Referring now to FIG. 1C, radiation patterns for two different phases of the single patch antenna 110 of FIGS. 1A and 1B are illustrated. The radiation patterns at phase $\phi=0°$ and phase $\phi=90°$ are illustrated. Both radiation patterns appear to be broad and symmetric. However, the radiation patterns are directional, mostly covering one half the space around the antenna. In other words, if the single patch antenna 110 is placed in a mobile device, one side of the mobile device would have excellent performance while the opposite side of the mobile device would have poor performance. This directional behavior of the single patch antenna may provide good performance in certain orientations with respect to a base station and/or poor performance in other orientations with respect to the base station.

Figure 2:
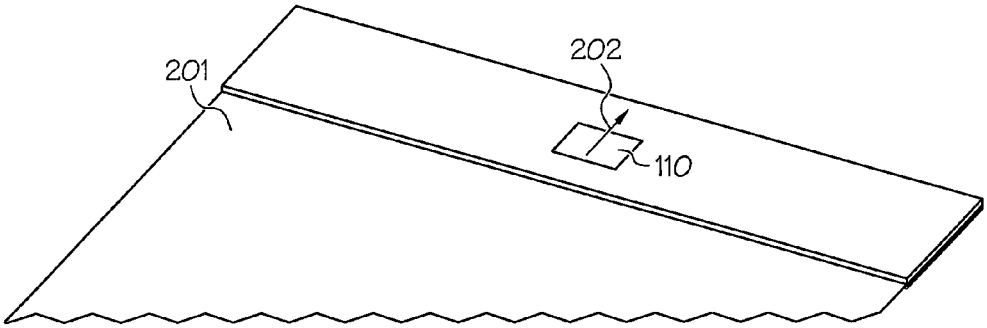
FIG. 2 illustrates the single patch antenna of FIGS. 1A and 1B in a wireless electronic device, according to various embodiments of the present inventive concepts.

Referring now to FIG. 2, a wireless electronic device 201 that includes the single patch antenna 110 of FIGS. 1A and 1B is illustrated. The single patch antenna 110 is positioned along an edge of the wireless electronic device 201. Other components may be included in the wireless electronic device 201, but are not illustrated for purposes of simplicity. The polarization of the single patch antenna 110 may be in the direction indicated by arrow 202 in FIG. 2, such as, for example, towards the top of the wireless electronic device 201.

Figure 3A:
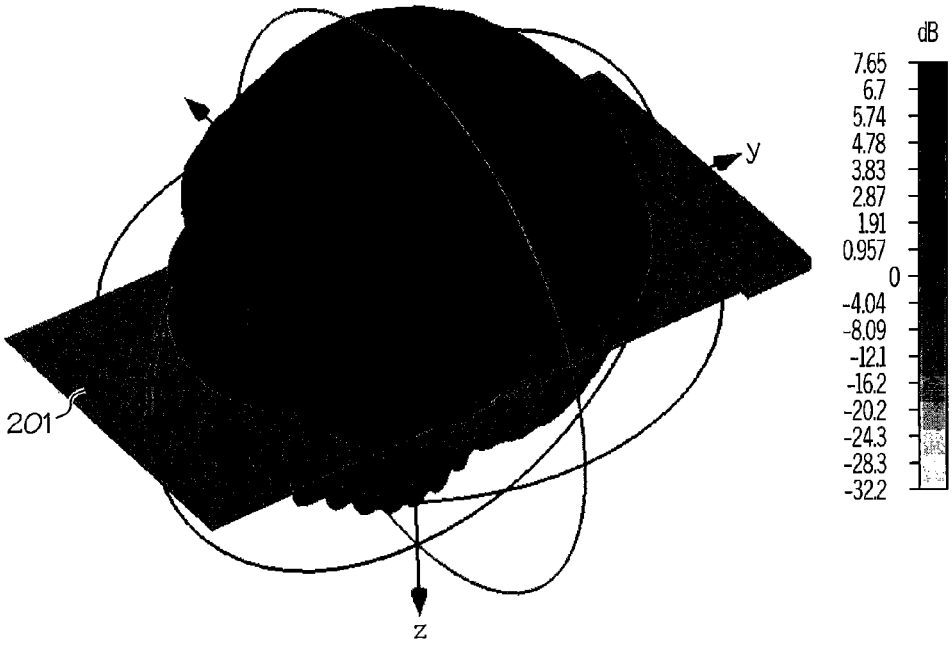
FIG. 3A illustrates the radiation pattern around a wireless electronic device such as a smartphone, including the single patch antenna of FIG. 2, according to various embodiments of the present inventive concepts.

Referring now to FIG. 3A, the radiation pattern around a wireless electronic device 201 including the single patch antenna 110 of FIGS. 1A and 1B is illustrated. When the single patch antenna 110 is excited at 15.1 GHz, an irregular radiation pattern is formed around the wireless electronic device 201. The radiation pattern around the wireless electronic device 201 exhibits directional distortion with broad, even radiation covering one half the space around the antenna but poor radiation around the other half of the antenna. Hence, this antenna may not be suitable for communication at this frequency since some orientations exhibit poor performance.

Figure 3B:
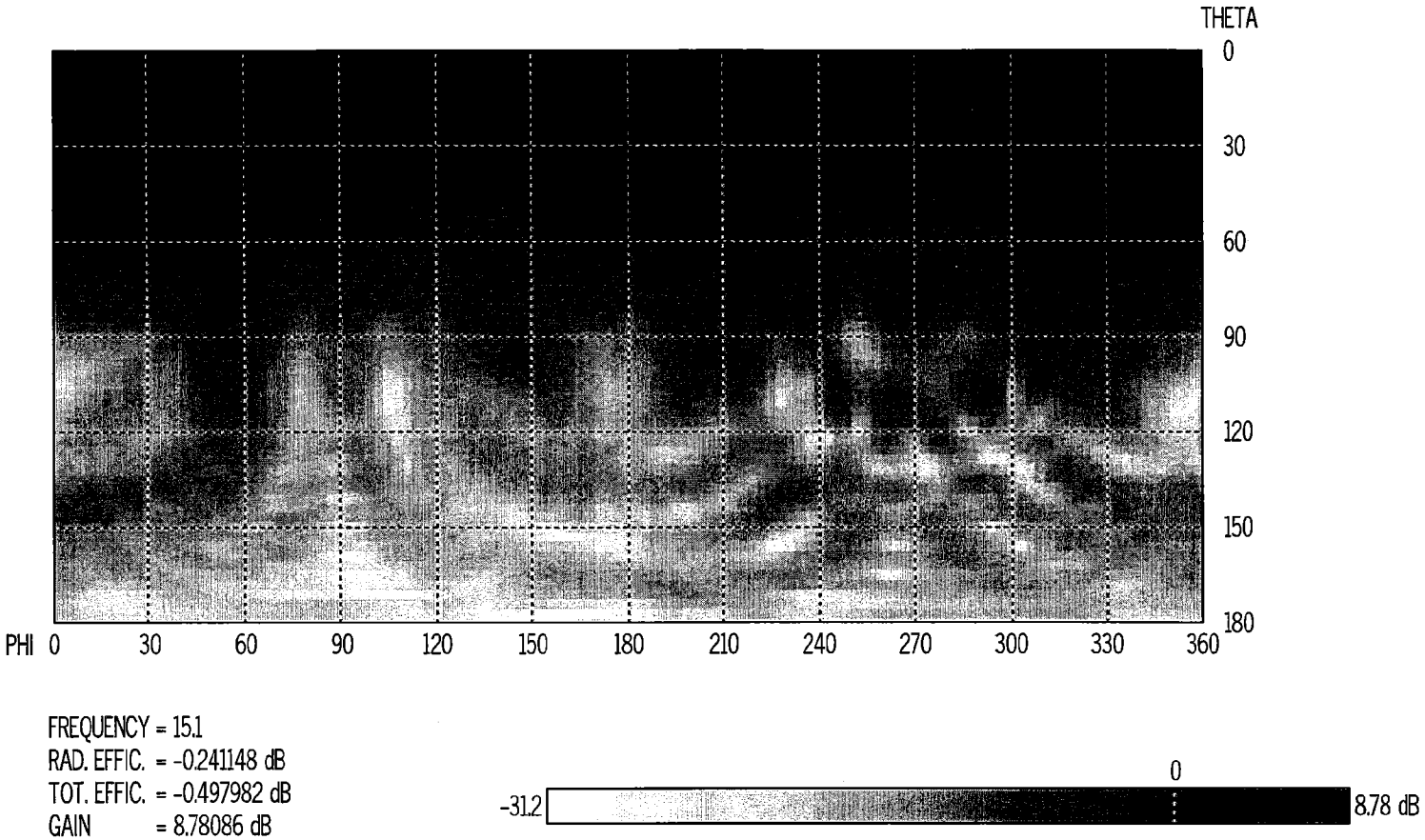
FIG. 3B illustrates the absolute far field gain, at 15.1 GHz excitation, along a wireless electronic device including the single patch antenna of FIG. 2, according to various embodiments of the present inventive concepts.

Referring now to FIG. 3B, the absolute far field gain, at 15.1 GHz excitation, along a wireless electronic device 201 including the single patch antenna 110 of FIG. 2 is illustrated. The axis Theta represents the y-z plane while the axis Phi represents the x-y plane around the wireless electronic device 201 of FIG. 2. Similar to the resulting radiation pattern of FIG. 3A, the absolute far field gain exhibits satisfactory gain characteristics in one direction around the wireless electronic device 201, such as, for example, spanning broadly in the x-y plane. However, in the y-z plane, good absolute far field gain results are obtained in one direction, for example, 90° to 180° around the wireless electronic device 201, but poor absolute far field gain results are obtained in the opposite direction in the y-z plane, for example, 0° to 90° around the wireless electronic device 201.

Figure 4A:
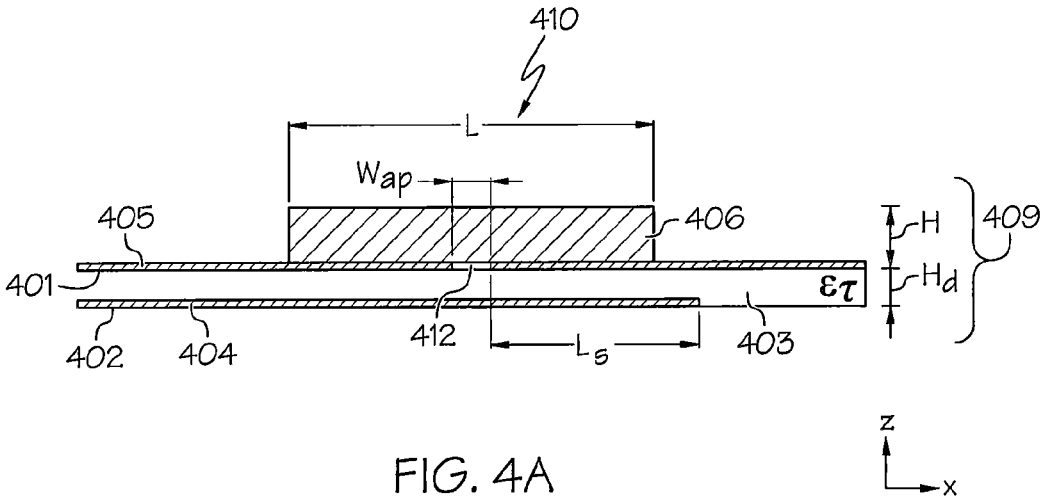
FIG. 4A illustrates a single dielectric resonator antenna (DRA) on a printed circuit board (PCB), according to various embodiments of the present inventive concepts.

Referring now to FIG. 4A, the diagram illustrates a single dielectric resonator antenna (DRA) 410 on a printed circuit board (PCB) 409. The PCB 409 includes a first conductive layer 401 and/or a second conductive layer 402. The first and second conductive layers (401, 402) may be arranged in a face-to-face relationship. The first and second conductive layers (401, 402) may be separated from one another by a dielectric layer 403. The dielectric layer 403 may be a single layer or a multilayer insulating material or a material that is a very poor conductor of electric current. The dielectric layer 403 may be formed of oxide, nitride, and/or insulating metal oxides such as hafnium oxide, aluminum oxide, and/or the like. The dielectric layer 403 may have a thickness $H_d$. A radiating element 405 may be in the first conductive layer 401. The radiating element 405 may comprise a flux couple. The radiating element 405 may include an opening or slot 412. A dielectric block 406 may be on the radiating element 405, remote from the dielectric layer 403. The dielectric block 406 may have a length L and height H. A stripline 404 may be in the second conductive layer 402 of the DRA 410. The width of the slot 412 may be $W_{ap}$. A signal may be received and/or transmitted through the stripline 404, causing the DRA 410 to resonate.

Figure 4B:
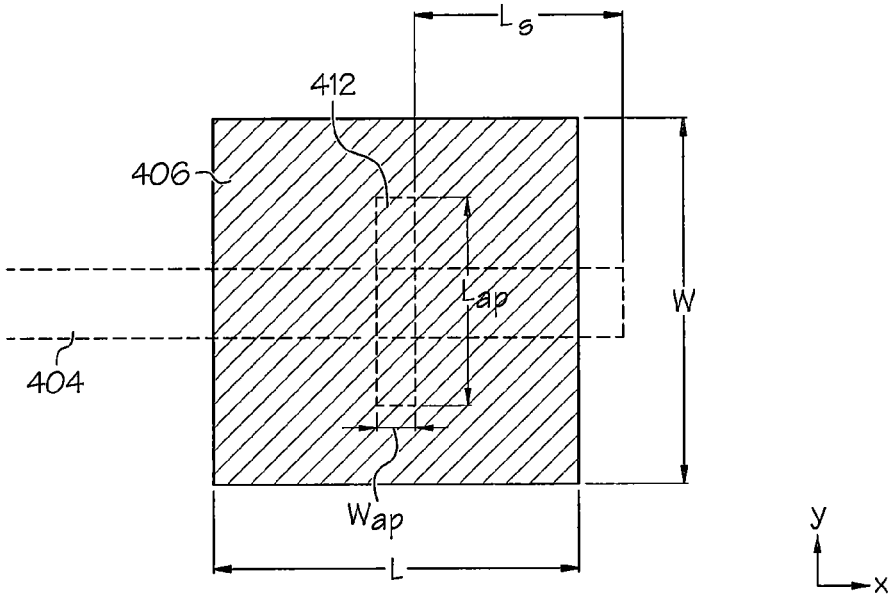
FIG. 4B illustrates a plan view of the single DRA on a printed circuit board (PCB) of FIG. 4A, according to various embodiments of the present inventive concepts.

Referring now to FIG. 4B, a plan view of the DRA 410 of FIG. 4A is illustrated. The dielectric block 406 may have a length L and width W. In some embodiments, the length L and width W may be equal. The dielectric block 406 may overlap the stripline 404. The stripline 404 may overlap a slot 412 in the radiating element 405 of the DRA 410. The slot 412 in the radiating element 405 of the DRA 410 may have a width $W_{ap}$ and/or a length $L_{ap}$. In some embodiments, the stripline 404 may extend beyond the dielectric block 406 for a length $L_s$ from the slot 412.

Electromagnetic properties of the described DRA antenna structure may be determined by physical dimensions and other parameters. For example, parameters such as stripline 404 width, stripline 404 positioning, dielectric layer 403 thickness $H_d$, dielectric layer permittivity $\in\tau$, dimensions $W_{ap}$ and/or a length $L_{ap}$ of the slot 412 in the radiating element 405, and/or dimensions L and/or W of the dielectric block 406 may affect the electromagnetic properties of DRA antenna structures and subsequently the antenna performance.

Figure 4C:
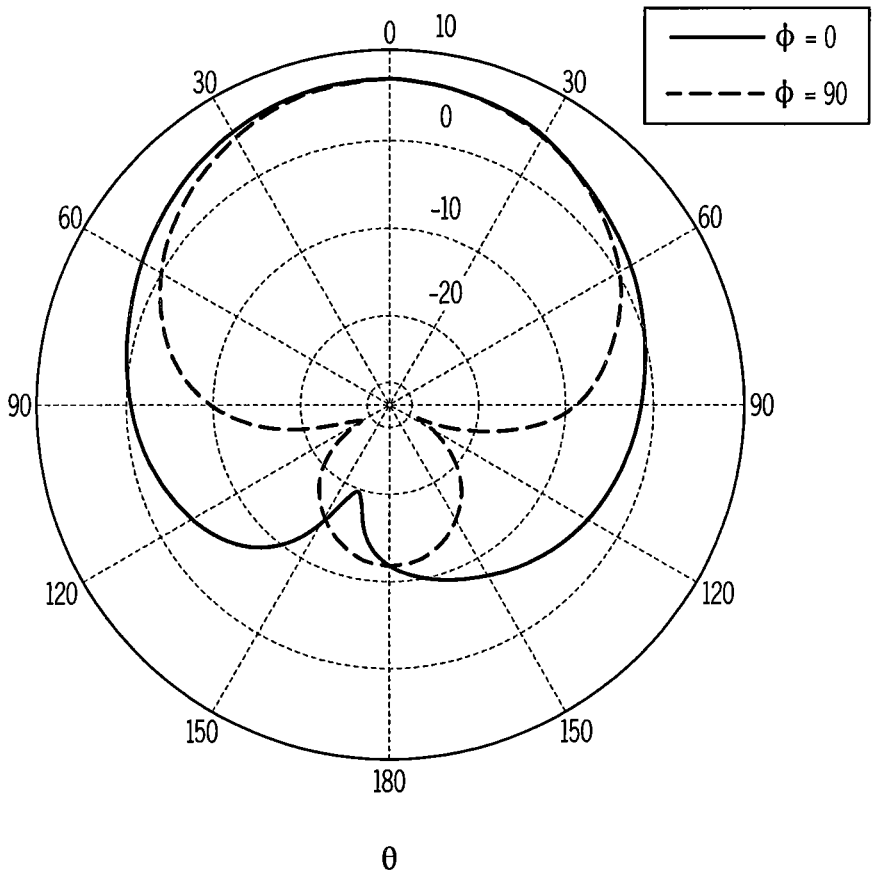
FIG. 4C illustrates the radiation pattern at two different phases of the single DRA of FIGS. 4A and 4B, according to various embodiments of the present inventive concepts.

Referring now to FIG. 4C, radiation patterns for two different phases of the DRA 410 of FIGS. 4A and 4B are illustrated. The radiation patterns at phase $\phi=0°$ and phase $\phi=90°$ are illustrated. Both radiation patterns appear to be broad and symmetric. However, the radiation patterns are directional, mostly covering one half the space around the antenna. In other words, if the DRA 410 is placed in a mobile device, one side of the mobile device would have excellent performance while the opposite side of the mobile device would have poor performance. This directional behavior of the DRA antenna may provide good performance in certain orientations with respect to a base station and/or poor performance in other orientations with respect to the base station.

Figure 5A:
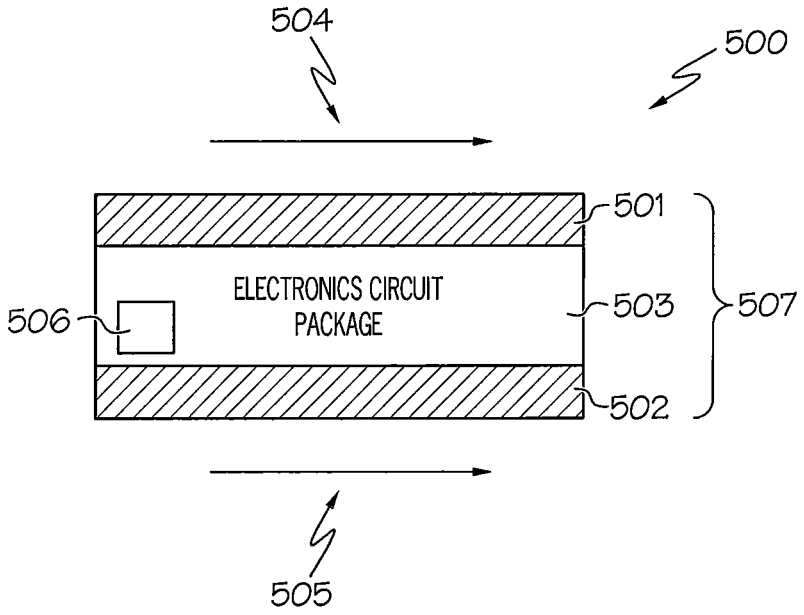
FIG. 5A illustrates a dual radiating element antenna including two radiating elements with the same polarization, according to various embodiments of the present inventive concepts.
Figure 5B:
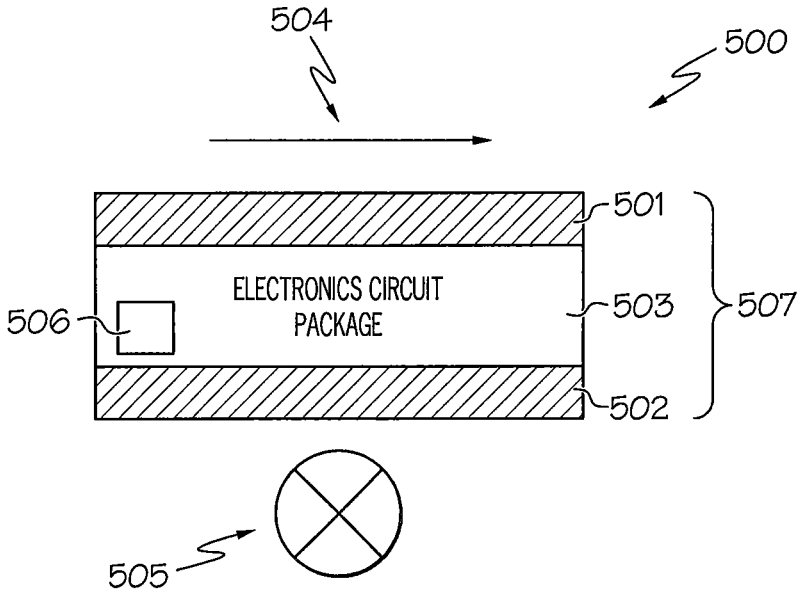
FIG. 5B illustrates a dual radiating element antenna including two radiating elements with orthogonal polarization, according to various embodiments of the present inventive concepts.

FIGS. 5A and 5B, may include the single patch antenna of FIGS. 1A and 1B, and/or the single DRA of FIGS. 4A and 4B. Referring now to FIG. 5A, a dual radiating element antenna 500 including two radiating elements with the same polarization is illustrated. The dual radiating element antenna 500 may be on a PCB 507 and include a first radiating element 501 and a second radiating element 502. An electronics circuit package 503 may be included in the PCB 507, between the first radiating element 501 and the second radiating element 502. In some embodiments, the first radiating element 501 may include the first radiating element 104 of FIG. 1A. In some embodiments, the first radiating element 501 may include the radiating element 405 of FIG. 4A. The electronics circuit package 503 may include circuits for transmitting and/or receiving signals, circuits for adjusting the polarization of signals, impedance matching circuits, and/or a power divider 506 for signal splitting and/or switching. The power divider 506 may be electrically coupled and/or connected to components in the electronics circuit package 503 and/or to a stripline associated with the dual radiating element antenna 500. Arrows 504 and 505 illustrate the respective polarizations of signals at the first radiating element 501 and the second radiating element 502. In this case, a signal at the first radiating element 501 has a same polarization 504 as the polarization 505 of a signal at the second radiating element 502. Since the first and second radiating elements 501 and 502 have the same polarization, high mutual coupling between the antenna elements may result. This high mutual coupling may result in disturbance of the signals at each of the first radiating element 501 and the second radiating element 502, causing radiation pattern distortion. In some embodiments, the signal at the first radiating element 501 may cancel and/or interfere with the signal at the second radiating element 502. In other words, in this configuration signals with the same polarization at the first and second radiating elements 501 and 502, the antenna elements may not work properly together. Changing polarization of the signals may improve performance of this antenna, as will be discussed with respect to FIG. 5B.

Referring now to FIG. 5B, a dual radiating antenna 500 including two radiating elements with orthogonal polarization is illustrated. The electronics circuit package 503 may include circuits for configuring the polarization of signals at the first and second radiating elements 501 and 502. The polarization of a signal may be associated with a physical orientation of the signal. Arrows 504 and 505 illustrate the respective polarizations of signals at the first radiating element 501 and the second radiating element 502. In this case, a signal at the first radiating element 501 has polarization 504 that is orthogonal to the polarization 505 of the signal at the second radiating element 502. Since the signal at the first radiating element 501 is orthogonal to the signal at the second radiating element 502, the antenna elements may work together to form an omni-directional radiation pattern. The radiation pattern for the upper half of the antenna at the first radiating element 501 may be orthogonal to the radiation pattern for the lower half of the antenna at the second radiating element 502, providing high isolation such as, for example −35 dB. FIG. 5B illustrates the polarization of the signals as a non-limiting example. In some embodiments, the polarization of the signal may be based on linear polarization, circular polarizations, Right Hand Circular Polarization (RHCP) or Left Hand Circular Polarization (LHCP), and/or elliptical polarization.

Still referring to FIGS. 5A and 5B, in various embodiments described herein, performance of the dual radiating antenna 500 with orthogonal signal polarization may be improved by including a power divider 506 circuit in the electronics package 503. As discussed earlier, a signal may be received and/or transmitted through the stripline associated with an antenna. A power divider 506 may be electrically connected and/or coupled to the stripline. A power divider 506 may operate to split the signal that is received and/or transmitted through the stripline. For example, a power divider 506 may be configured to control a power of the signal received at the stripline that is applied to the first radiating element 501 and/or the second radiating element 502. In other words, a first portion of the power of the signal may be applied to the first radiating element 501 for a first period of time and/or a second portion of the power of the signal may be applied to the second radiating element 502 for a second period of time. In some embodiments, the first period of time may overlap and/or be congruent in time with the second period of time. In some embodiments, the first time period may not overlap the second time period. In some embodiments, the power divider 506 may be configured to provide a first portion of the power of the signal to the first radiating element 501 that is orthogonal to the second portion of the power of the signal to the second radiating element 502. In some embodiments, the power divider 506 may be configured to provide all of the power of the signal at the stripline to the first radiating element 501 for a first period of time and to provide all of the power of the signal at the stripline to the second radiating element 502 for a second period of time. The first and second time periods may not overlap with one another when the power divider 506 switches between providing all of the power of the signal at the stripline to the first radiating element 501 or the second radiating element 502. Switching between applying power to the first radiating element 501 and the second radiating element 502 may occur periodically in time and/or according to a predefined time-based function.

In some embodiments, any of the power splitting operations may be constant over time or may vary over time. The mode of operation of the power divider 506 may switch between a first mode of providing different portions of the signal power to each of the first and second radiating elements 501 and 502 to a second mode of providing all of the power of the signal at the stripline to the first and second radiating elements 501 and 502 for different periods of time. The mode of operation of the power divider 506 may be controlled based on communication channel conditions, user selection, and/or a predetermined pattern of operation.

In some embodiments, the first and second radiating elements 501 and/or 502 of FIGS. 5A and 5B may comprise first and/or second patch elements. Now referring to FIG. 6A, a dual patch antenna 600 is illustrated. The dual patch antenna 600 may include a first conductive layer 612 and a second conductive layer 614. The first and second conductive layers (612, 614) may be arranged in a face-to-face relationship. The first and second conductive layers (612, 614) may be separated from one another by a first dielectric layer 604. A first patch element 605 may be in a fourth conductive layer 611. A second patch element 606 may be in a fifth conductive layer 613. A stripline 602 may be in the second conductive layer 612 of the dual patch antenna 600. A ground plane 601 may be in the first conductive layer 612. The ground plane may include an opening or slot 607. The width of the slot 607 may be $W_{ap}$. The width of the slot 607 may control impedance matching of the dual patch antenna 600 to the wireless electronic device 201. In some embodiments, a conductive layer 615 may be between dielectric layers 617 and 618. Conductive layer 615 may include a PCB ground plane 616 associated with a PCB. In some embodiments, the PCB ground plane 616 may include a slot 626 of width $W_{ap}$. In some embodiments, the slot 607 may overlap with the first patch element 605 and/or the second patch element 606. In some embodiments, the slot 607 may overlap with the stripline 602. In some embodiments, the slot 607 may laterally overlap with the first patch element 605 and/or the second patch element 606. In some embodiments, the slot 607 may laterally overlap with the stripline 602. A signal may be received and/or transmitted through the stripline 602, causing the dual patch antenna 600 to resonate. In some embodiments, the second patch element 606 may have a different corresponding stripline. The two striplines may each correspond to a different patch element and thus may be used by the power divider 506 of FIG. 5 to separately provide signals to the first patch element 605 and/or the second patch element 606.

Figure 6A:
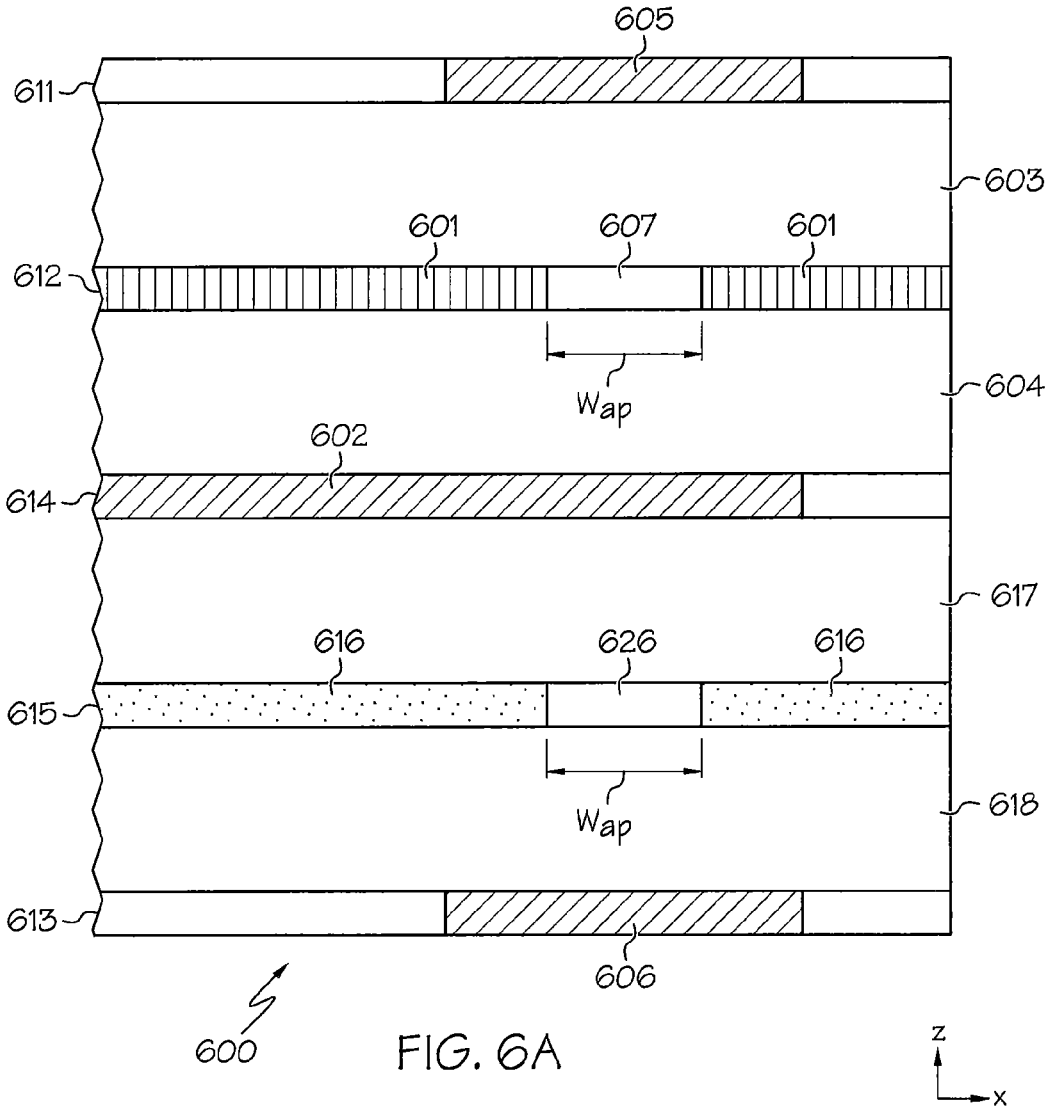
FIGS. 6A and 6B illustrate dual patch antennas, according to various embodiments of the present inventive concepts.

Still referring to FIG. 6A, a power divider may be associated with the dual patch antenna 600. The power divider is not illustrated in FIG. 6A for simplicity. The power divider may be internal or external to the dual patch antenna 600 but is electrically connected and/or coupled to the stripline 602. The power divider may be configured to control a power of the signal that is applied to the first patch element 605 and/or the second patch element 606. The first patch element 605 and/or the second patch element 606 may be configured such that a first polarization of the signal at the first patch element 605 is orthogonal to a second polarization of the signal at the second patch element 606.

In some embodiments, the first and second radiating elements 501 and/or 502 of FIGS. 5A and 5B may comprise first and/or second patch elements. Now referring to FIG. 6B, a dual patch antenna 600 is illustrated. The dual patch antenna 600 may include a first conductive layer 612 and a second conductive layer 614. The first and second conductive layers (612, 614) may be arranged in a face-to-face relationship. The first and second conductive layers (612, 614) may be separated from one another by a first dielectric layer 604. A first patch element 605 may be in a fourth conductive layer 611. The first conductive layer 612 and the fourth conductive layer 611 may be arranged in a face-to-face relationship separated by a second dielectric layer 603. A second patch element 606 may be in a fifth conductive layer 613. A stripline 602 may be in the second conductive layer 612 of the dual patch antenna 600. A ground plane 601 may be in the second conductive layer 612. The ground plane may include an opening or first slot 607. The width of the slot 607 may be $W_{ap}$. The width of the slot 607 may control impedance matching of the dual patch antenna 600 to the wireless electronic device 201. In some embodiments, the slot 607 may overlap with the first patch element 605 and/or the second patch element 606. In some embodiments, the slot 607 may overlap with the stripline 602. In some embodiments, the slot 607 may laterally overlap with the first patch element 605 and/or the second patch element 606. In some embodiments, the slot 607 may laterally overlap with the stripline 602. A signal may be received and/or transmitted through the stripline 602, causing the dual patch antenna 600 to resonate. In some embodiments, the second patch element 606 may have a different corresponding stripline 620 in a third conductive layer 619. In some embodiments, the second patch element 606 may have a different ground plane 622 in a sixth conductive layer 621. The ground plane 622 may include a second slot 623 in the sixth conductive layer 621. In some embodiments, the sixth conductive layer 621 may be separated from the third conductive layer 619 by a fourth dielectric layer 624. The sixth conductive layer 621 may be separated from the fifth conductive layer 613 by a sixth dielectric layer 625. The two striplines 602, 620 may each correspond to a different patch element 605, 606, respectively and thus may be used by the power divider 506 of FIG. 5 to separately provide signals to the first patch element 605 and/or the second patch element 606.

Figure 6B:
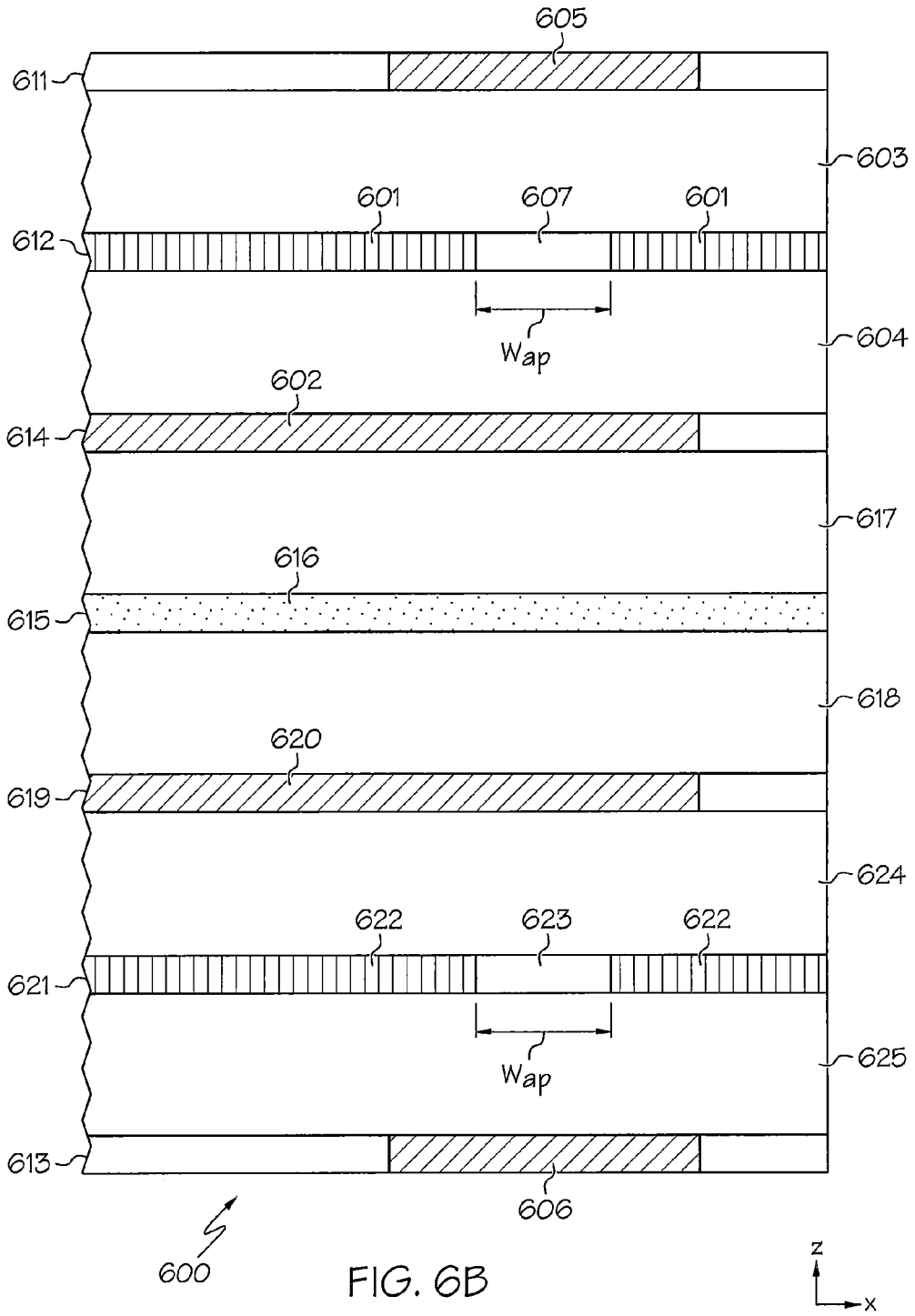

Still referring to FIG. 6B, a power divider may be associated with the dual patch antenna 600. The power divider is not illustrated in FIG. 6B for simplicity. The power divider may be internal or external to the dual patch antenna 600 but is electrically connected and/or coupled to the first stripline 602 and/or the second stripline 620. The power divider may be configured to control a power of the signal that is applied to the first patch element 605 and/or the second patch element 606. The first patch element 605 and/or the second patch element 606 may be configured such that a first polarization of the signal at the first patch element 605 is orthogonal to a second polarization of the signal at the second patch element 606.

Still referring to FIG. 6B, the dual patch antenna 600 may be included in a Printed Circuit Board (PCB). In some embodiments, the dual patch antenna 600 may include a PCB ground plane 616 in a seventh conductive layer 615. The seventh conductive layer 615 may be separated from the second conductive layer 614 by a third dielectric layer 617. The seventh conductive layer 615 may be separated from the third conductive layer 619 by a fifth dielectric layer 618.

Figure 7A:
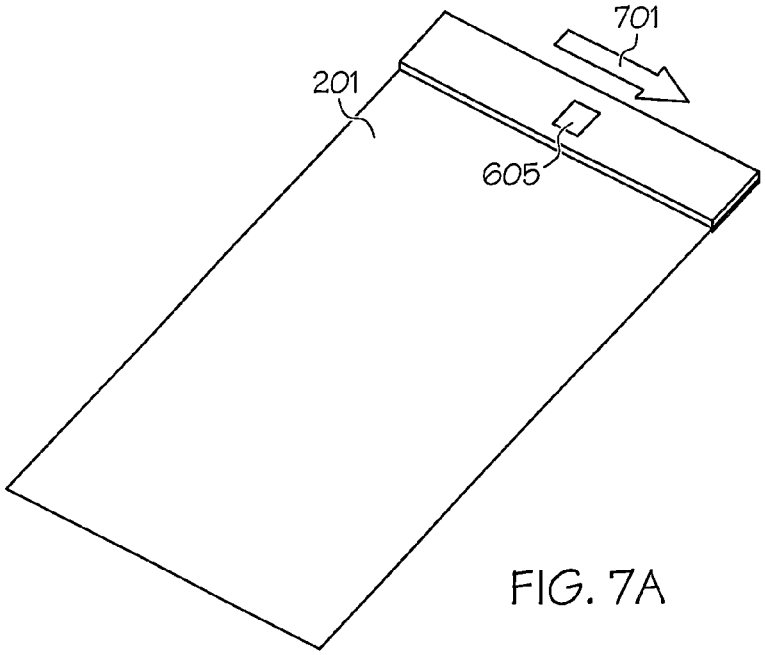
FIG. 7A illustrates the front side of a wireless electronic device such as a smartphone, including the dual patch antenna of FIG. 5B, FIG. 6A, and/or FIG. 6B according to various embodiments of the present inventive concepts.

Referring to FIG. 7A, the front side of a wireless electronic device 201, such as a smartphone, including the dual patch antenna of FIG. 5B, FIG. 6A, and/or FIG. 6B is illustrated. The wireless electronic device 201 may be oriented such that the front or top side of the mobile device is in a face-to-face relationship with the first conductive layer 611 of FIG. 6A and/or FIG. 6B. The wireless electronic device 201 may include the dual patch antenna 600 of FIG. 6A and/or FIG. 6B with first patch element 605. Arrow 701 illustrates the direction of polarization of the signals at the first patch element 605.

Figure 7B:
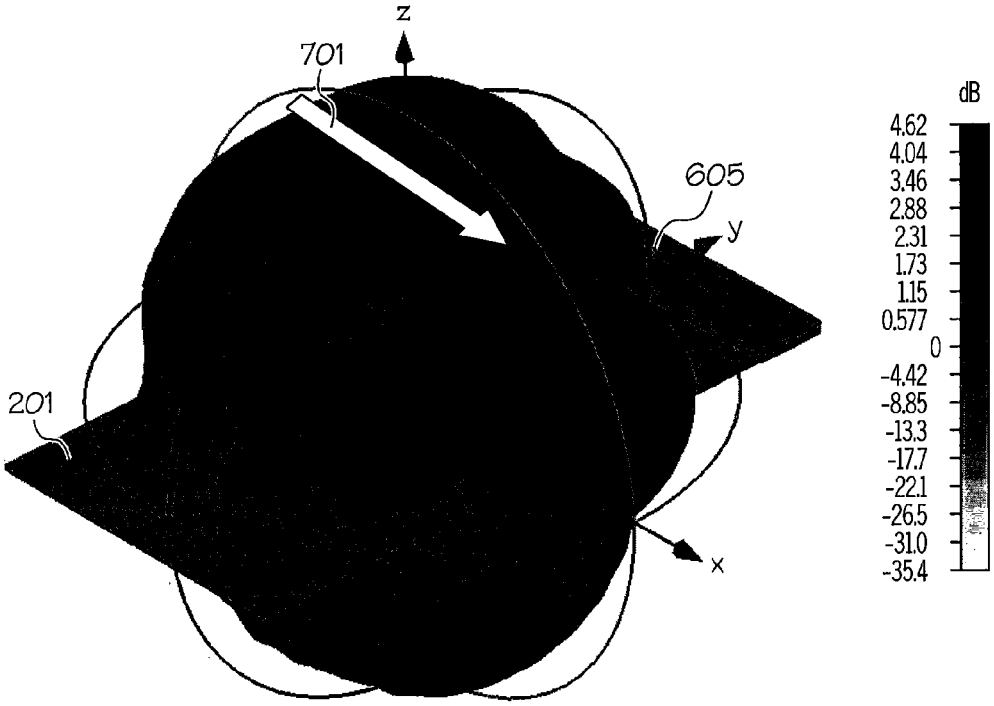
FIG. 7B illustrates the radiation pattern associated with a patch antenna element on the front side of a wireless electronic device such as a smartphone of FIG. 7A, according to various embodiments of the present inventive concepts.

Referring to FIG. 7B, the radiation pattern associated with first patch element 605 on the front side of the wireless electronic device 201 of FIG. 7A is illustrated. When the first patch element 605 is excited at 15.1 GHz, an evenly distributed radiation pattern is formed around the wireless electronic device 201. The radiation pattern around the wireless electronic device 201 exhibits little directional distortion with broad, encompassing radiation covering the space around front and back of the antenna. Although the radiation pattern of FIG. 7B is illustrated for the case when the first patch element 605 is excited, the presence of the second patch element 606 of FIG. 6A and/or FIG. 6B improves performance of the antenna by producing covering the space around both the front and the back of the antenna.

Figure 8A:
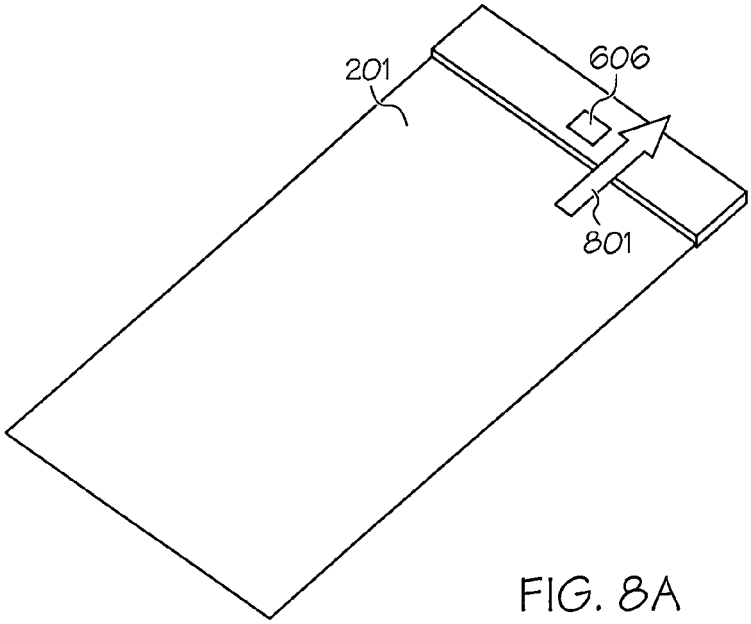
FIG. 8A illustrates the back side of a wireless electronic device such as a smartphone, including the dual patch antenna of FIG. 5B, FIG. 6A, and/or FIG. 6B according to various embodiments of the present inventive concepts.

Referring to FIG. 8A, the back side of a wireless electronic device 201, such as a smartphone, including the dual patch antenna of FIG. 5B, FIG. 6A and/or FIG. 6B, is illustrated. The wireless electronic device 201 may be oriented such that the back or bottom side of the mobile device is in a face-to-face relationship with the third conductive layer 613 of FIG. 6A and/or FIG. 6B. The wireless electronic device 201 may include the dual patch antenna 600 of FIG. 6A and/or FIG. 6B with second patch element 606. Arrow 801 illustrates the direction of polarization of the signals at the second patch element 606. The polarization 701 of the first patch element 605 of FIG. 7A is orthogonal to the polarization 801 of the second patch element 606 of FIG. 8A.

Figure 8B:
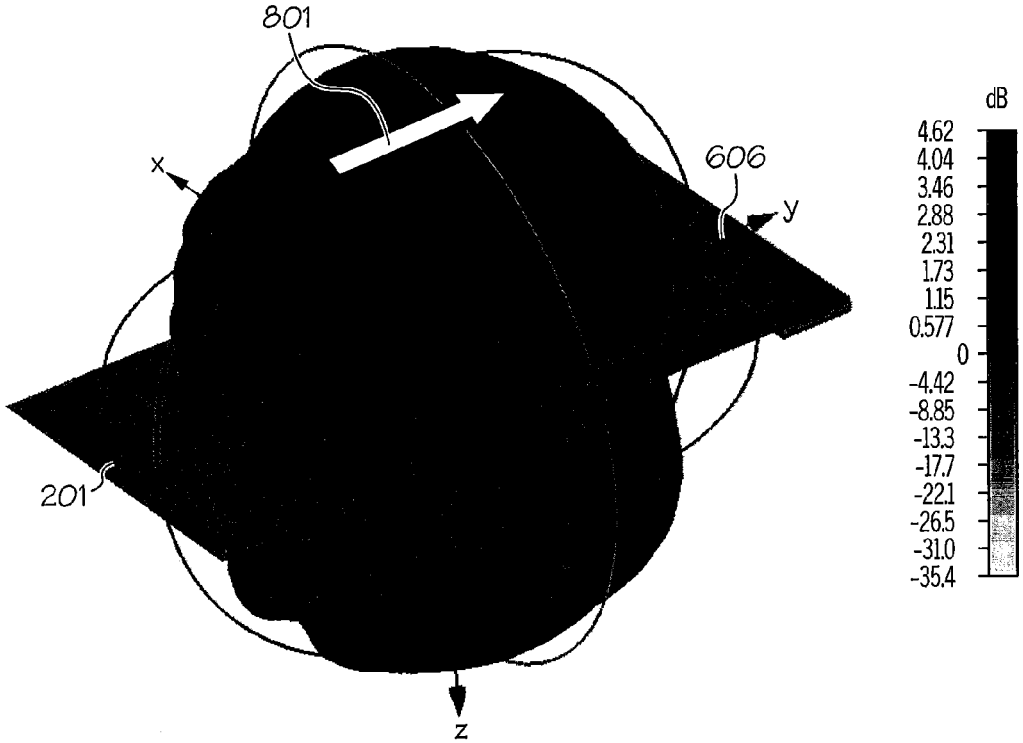
FIG. 8B illustrates the radiation pattern associated with a patch antenna element on the back side of a wireless electronic device such as a smartphone of FIG. 8A, according to various embodiments of the present inventive concepts.

Referring to FIG. 8B, the radiation pattern associated with second patch element 606 on the back side of the wireless electronic device 201 of FIG. 8A is illustrated. When the second patch element 606 is excited at 15.1 GHz, an evenly distributed radiation pattern is formed around the wireless electronic device 201. The radiation pattern around the wireless electronic device 201 exhibits little directional distortion with broad, encompassing radiation covering the space around both the front and back of the antenna. Although the radiation pattern of FIG. 8B is illustrated for the case when the second patch element 606 is excited, the presence of the first patch element 605 of FIG. 6A and/or FIG. 6B improves performance of the antenna by producing covering the space around both the front and the back of the antenna.

Figure 9:
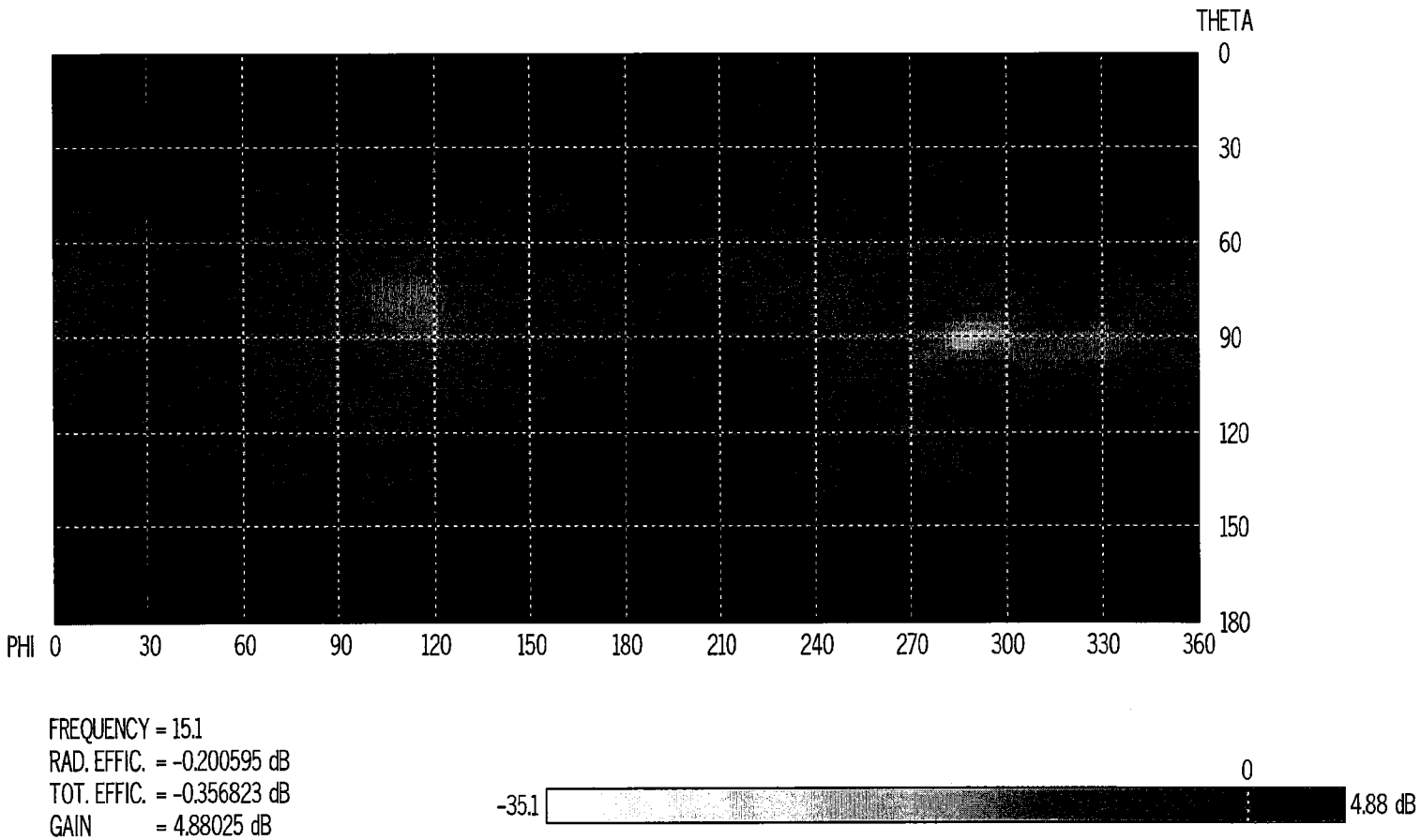
FIG. 9 illustrates the absolute far field gain, at 15.1 GHz excitation, along a wireless electronic device including the dual patch antenna of FIG. 6A and/or FIG. 6B, according to various embodiments of the present inventive concepts.

Referring to FIG. 9, the absolute far field gain, at 15.1 GHz excitation, along a wireless electronic device including the dual patch antenna of FIG. 6A and/or FIG. 6B, is illustrated. The absolute far field gain of FIG. 9 is associated with simultaneous excitation from a power divider applied to both the first patch element 605 and the second patch element 606 of the dual patch antennas of FIGS. 6 to 8B. In this case, approximately half the signal power was provided to excite the first patch element 605 and approximately half the signal power was provide to excite the second patch element 606.

Still referring to FIG. 9, the axis Theta represents the y-z plane while the axis Phi represents the x-y plane around the wireless electronic device 201 of FIGS. 7A and 7B. The absolute far field gain exhibits satisfactory gain characteristics in directions radiating from both the front face and the back face of the wireless electronic device 201. For example, excellent gain characteristics with −35 dB isolation may be obtained in both directions of the z-axis. However, the far field gain appears to be less in both directions of the x-axis, corresponding to the sides of the mobile device. Compared to the single patch antenna of FIGS. 3A and 3B, FIGS. 7A and 7B illustrate that the dual patch antenna may provide significantly larger coverage space due to the effects of the first and second patch elements 605 and 606 and/or orthogonal polarization of signals. In other words, the single patch antenna produced a radiation pattern that was substantially directed from one direction (i.e. from one face) of the mobile device whereas the dual patch antenna produces a radiation pattern that is substantially directed from two different directions, for example, from both the front and back faces of the mobile device.

Figure 10A:
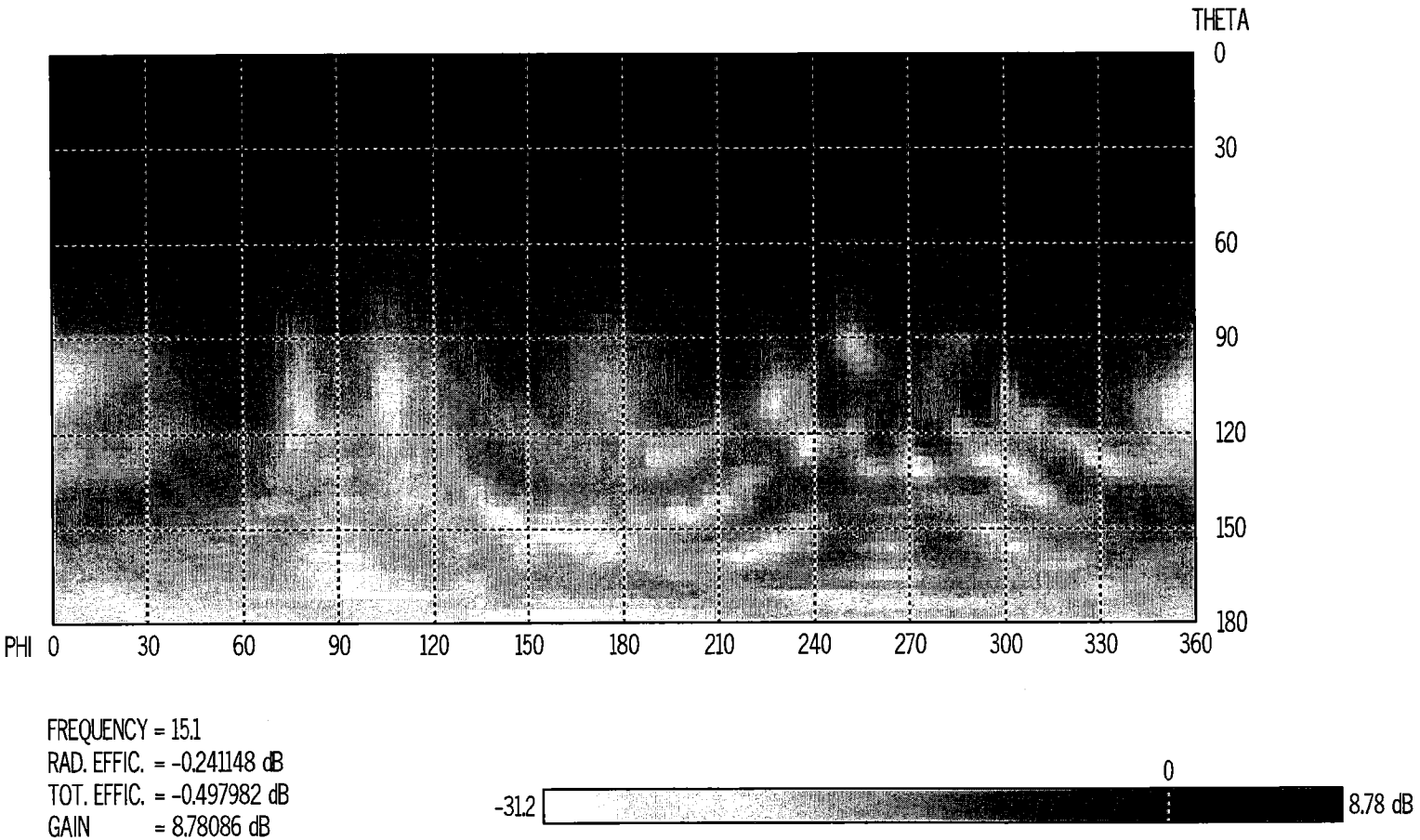
FIGS. 10A and 10B illustrate the absolute far field gain using different signal feeding schemes, at 15.1 GHz excitation, along a wireless electronic device including the dual patch antenna of FIG. 6A and/or FIG. 6B, according to various embodiments of the present inventive concepts.
Figure 10B:
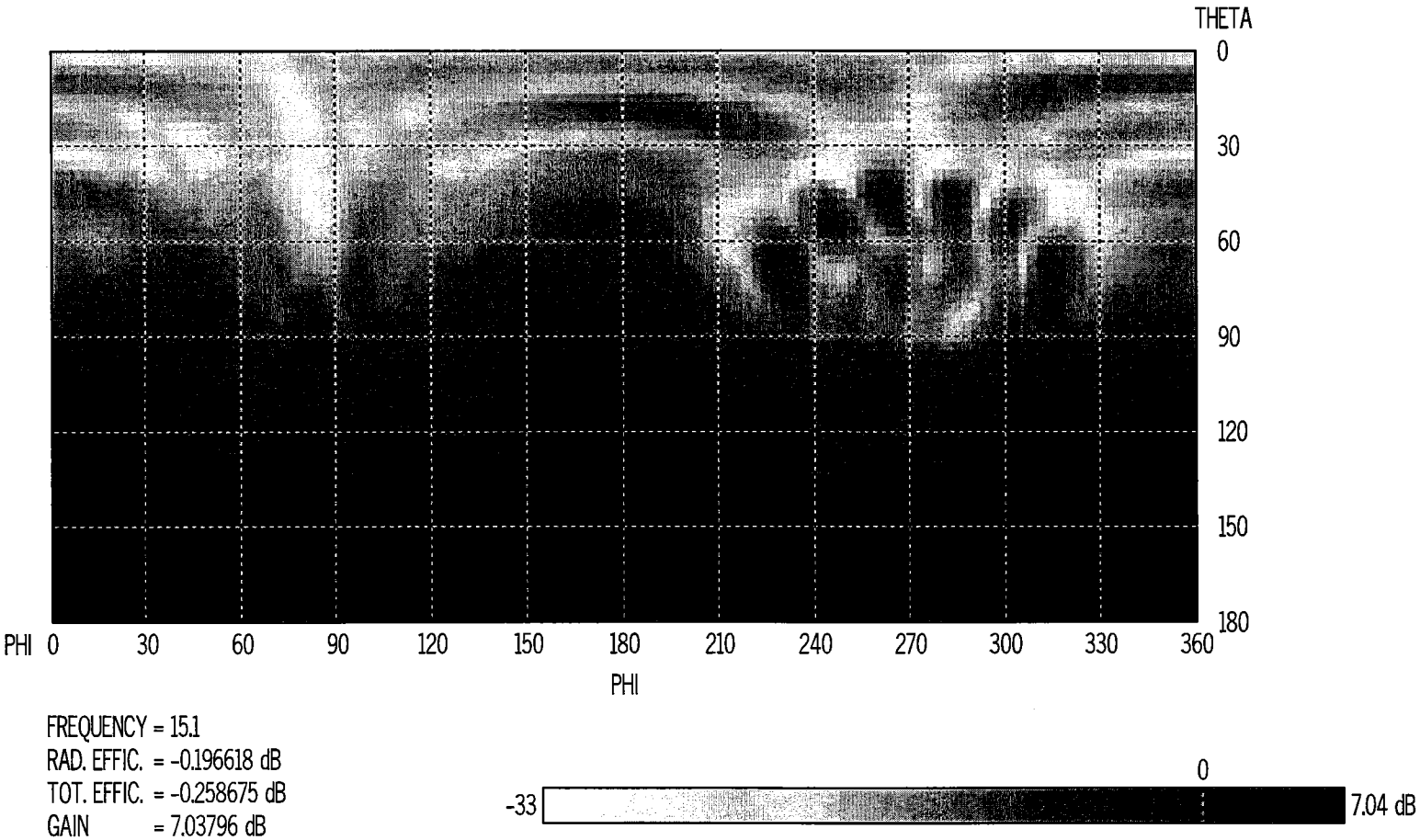

FIGS. 10A and 10B illustrate the absolute far field gain using different signal feeding schemes, at 15.1 GHz excitation, along a wireless electronic device including the dual patch antenna of FIG. 6A and/or FIG. 6B. As discussed in detail above, a power divider may be used to switch the signal excitation between the first and second patch elements 605 and 606. In this example configuration, the power divider provides most of the power of the signal to the first patch element 605 of FIG. 6A and/or FIG. 6B for a first period of time, illustrated in the results of FIG. 10A. The power divider may provide most of the power of the signal to the second patch element 606 of FIG. 6A and/or FIG. 6B for a second period of time, illustrated in the results of FIG. 10B. Compared to the approximately equal power division of FIG. 9, the peak gain increases by 2 dB-3 dB when using this switching feeding scheme. The switch feeding scheme may tune the antenna to better fit channel characteristics such as periodic noise disturbances. In some embodiments, switching the feeding from the first patch element to the second patch element may be based on directional channel measurements. For example, a pilot signal from a base station may be used to determine better performance between feeding to the first patch element versus the second patch element.

Referring to FIG. 11A, a dual dielectric resonator antenna (DRA) 1100 is illustrated. The dual DRA 1100 may include a first conductive layer 1112 and a second conductive layer 1114. The first and second conductive layers (1112, 1114) may be arranged in a face-to-face relationship. The first and second conductive layers (1112, 1114) may be separated from one another by a first dielectric layer 1104. A first flux couple may be in the first conductive layer 1112. A second flux couple may be in a fourth conductive layer 1121. A first dielectric block 1108 may be on the first conductive layer 1112, opposite the first dielectric layer 1104. A second dielectric block 1109 may be on the fourth conductive layer 1121, opposite a fourth dielectric layer 1118. A stripline 1102 may be in the second conductive layer 1114 of the dual DRA 1100. A ground plane 1101 may be in the second conductive layer 1112. The ground plane 1101 may include an opening or slot 1107. The width of the slot 1107 may be $W_{ap}$. In some embodiments, the slot 1107 may laterally overlap the first dielectric block 1108 and/or the second dielectric block 1109. In some embodiments, the slot 1107 may overlap the stripline 1102. A signal may be received and/or transmitted through the stripline 1102, causing the dual DRA 1100 to resonate. Some embodiments may include a ground plane 1120 including a second slot 1110 in the fourth conductive layer 1121. In some embodiments, the first dielectric block 1108 may overlap the first slot 1107 and/or the second dielectric block 1109 may overlap the second slot 1110. In some embodiments, factors such as the relative permittivity of the first dielectric block 1108 and/or the second dielectric block 1109 may affect the electromagnetic properties of the dual DRA antenna 1100 and/or subsequently affect the antenna performance. In some embodiments, the first radiating element 501 of FIG. 5B may include a first flux couple and/or the first dielectric block 1108 of FIG. 11A. Similarly, the second radiating element 502 of FIG. 5B may include a second flux couple and/or the second dielectric block 1109 of FIG. 11A. The dual DRA 1100 of FIG. 11A provides similar performance results as illustrated in FIGS. 7B, 8B, 9, 10A, and/or 10B. In some embodiments, the dual DRA 1100 of FIG. 11A may provide better performance with wider bandwidth when compared to the dual path antenna 600 of FIG. 6A and/or FIG. 6B.

Still referring to FIG. 11A, a power divider may be associated with the DRA 1100. The power divider is not illustrated in FIG. 11A for simplicity. The power divider may be internal or external to the DRA 1100 but is electrically connected and/or coupled to the stripline 1102. The power divider may be configured to control a power of the signal that is applied to the first dielectric block 1108 and/or the second dielectric block 1109. The first dielectric block 1108 and/or the second dielectric block 1109 may be configured such that a first polarization of the signal at the first dielectric block 1108 is orthogonal to a second polarization of the signal at the second dielectric block 1109.

Referring to FIG. 11B, a dual dielectric resonator antenna (DRA) 1100 is illustrated. The dual DRA 1100 may include a first conductive layer 1112 and a second conductive layer 1114. The first and second conductive layers (1112, 1114) may be arranged in a face-to-face relationship. The first and second conductive layers (1112, 1114) may be separated from one another by a first dielectric layer 1104. A first flux couple may be in the first conductive layer 1112. A second flux couple may be in a fourth conductive layer 1121. A first dielectric block 1108 may be on the first conductive layer 1112, opposite the first dielectric layer 1104. A second dielectric block 1109 may be on the fourth conductive layer 1121, opposite a fourth dielectric layer 1118. A stripline 1102 may be in the second conductive layer 1114 of the dual DRA 1100. A ground plane 1101 may be in the second conductive layer 1112. The ground plane 1101 may include an opening or slot 1107. The width of the slot 1107 may be $W_{ap}$. In some embodiments, the slot 1107 may laterally overlap the first dielectric block 1108 and/or the second dielectric block 1109. In some embodiments, the slot 1107 may overlap the stripline 1102. A signal may be received and/or transmitted through the stripline 1102, causing the dual DRA 1100 to resonate. Some embodiments may include a ground plane 1120 including a second slot 1110 in the fourth conductive layer 1121. In some embodiments, the first dielectric block 1108 may overlap the first slot 1107 and/or the second dielectric block 1109 may overlap the second slot 1110. In some embodiments, a second stripline 1120 may be included in a third conductive layer 1119. The third conductive layer 1119 may be separated from the sixth conductive layer 1121 by a fourth dielectric layer 1124.

Still referring to FIG. 11B, the dual DRA 1100 may be included in a Printed Circuit Board (PCB). In some embodiments, the dual DRA 1100 may include a PCB ground plane 1116 in a seventh conductive layer 1115. The seventh conductive layer 1115 may be separated from the second conductive layer 1114 by a third dielectric layer 1117. The seventh conductive layer 1115 may be separated from the third conductive layer 1119 by a fifth dielectric layer 1118.

In some embodiments, factors such as the relative permittivity of the first dielectric block 1108 and/or the second dielectric block 1109 may affect the electromagnetic properties of the dual DRA antenna 1100 and/or subsequently affect the antenna performance. In some embodiments, the first radiating element 501 of FIG. 5B may include a first flux couple and/or the first dielectric block 1108 of FIG. 11B. Similarly, the second radiating element 502 of FIG. 5B may include a second flux couple and/or the second dielectric block 1109 of FIG. 11B. The dual DRA 1100 of FIG. 11B provides similar performance results as illustrated in FIGS. 7B, 8B, 9, 10A, and/or 10B. In some embodiments, the dual DRA 1100 of FIG. 11B may provide better performance with wider bandwidth when compared to the dual path antenna 600 of FIG. 6A and/or FIG. 6B.

Still referring to FIG. 11B, a power divider may be associated with the DRA 1100. The power divider is not illustrated in FIG. 11B for simplicity. The power divider may be internal or external to the DRA 1100 but is electrically connected and/or coupled to the stripline 1102. The power divider may be configured to control a power of the signal that is applied to the first dielectric block 1108 and/or the second dielectric block 1109. The first dielectric block 1108 and/or the second dielectric block 1109 may be configured such that a first polarization of the signal at the first dielectric block 1108 is orthogonal to a second polarization of the signal at the second dielectric block 1109.

Figure 12A:
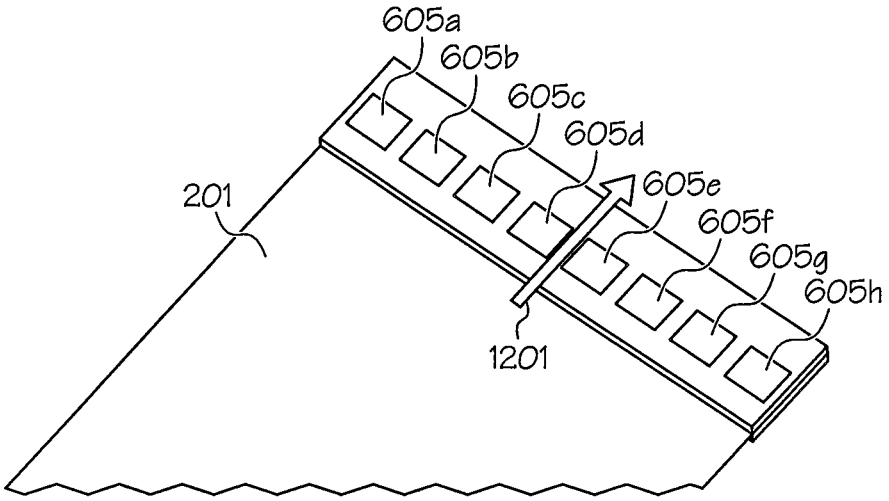
FIG. 12A illustrates the front side of a wireless electronic device such as a smartphone, including an array of dual patch antenna elements of FIG. 6A and/or FIG. 6B, according to various embodiments of the present inventive concepts.
Figure 12B:
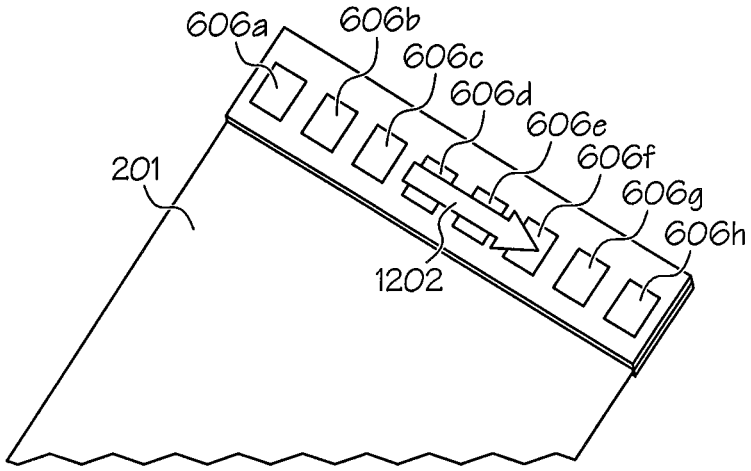
FIG. 12B illustrates the back side of a wireless electronic device such as a smartphone, including an array of dual patch antenna elements of FIG. 6A and/or FIG. 6B, according to various embodiments of the present inventive concepts.

FIGS. 12A and 12B illustrate a wireless electronic device 201 such as a smartphone including an array of dual patch antennas of FIG. 6A and/or FIG. 6B. Referring to FIG. 12A, the front side of a wireless electronic device 201 including an array of first patch antenna elements 605*a*-605*h* is illustrated. The polarization of the signals at first patch antenna elements 605*a*-605*h* is indicated by arrow 1201. Now referring to FIG. 12B, the back side of a wireless electronic device 201 including an array of second patch elements 606*a*-606*h* is illustrated. The polarization of the signals at second patch antenna elements 606*a*-606*h* is indicated by arrow 1202. In some embodiments, polarization 1201 may be orthogonal to polarization 1202. Although FIGS. 12A and 12B are described in the context of the dual patch antenna of FIG. 6A and/or FIG. 6B as a non-limiting example, the array may include the first and second radiating elements of FIGS. 5A and 5B, and/or the first and second flux couples and first and second dielectric blocks of the DRA antenna of FIG. 11A, according to some embodiments.

Figure 13A:
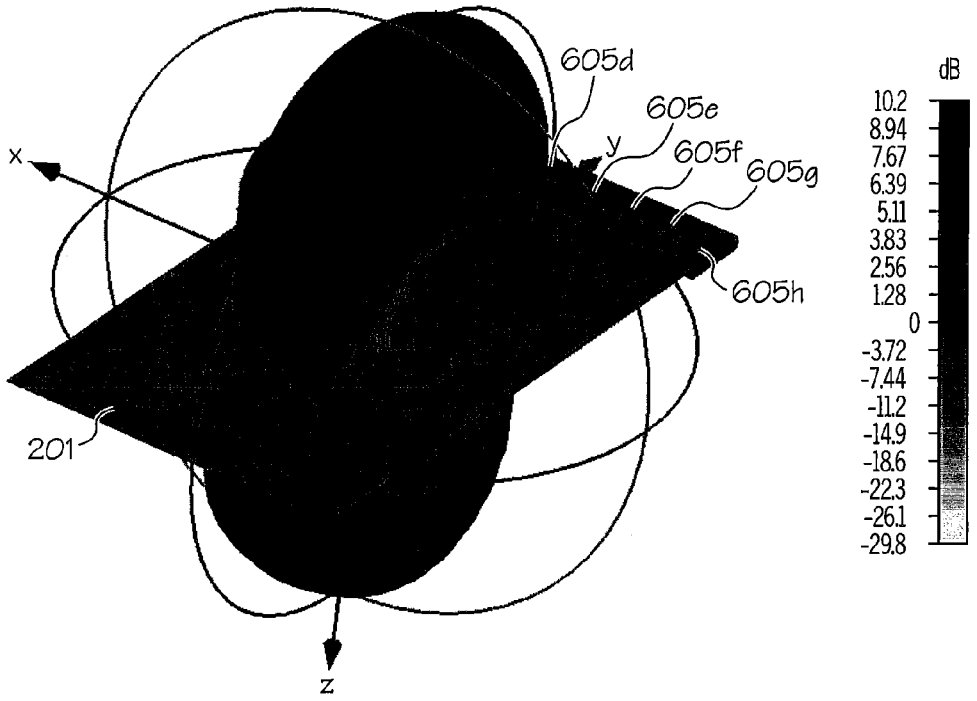
FIGS. 13A-13C illustrate the radiation pattern around the wireless electronic device, including a dual patch array antenna of FIGS. 12A and 12B, according to various embodiments of the present inventive concepts.
Figure 13B:
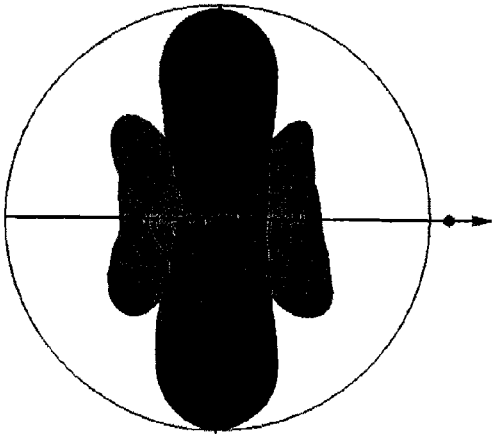
Figure 13C:
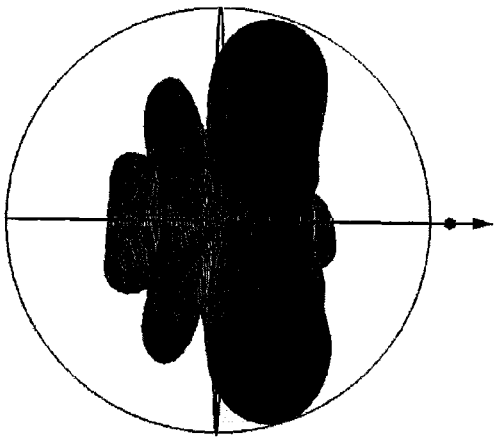

FIGS. 13A-13C illustrate the radiation pattern around the wireless electronic device 201, including a dual patch array antenna of FIGS. 12A and 12B. Referring to FIG. 13A, when the dual patch array antenna is excited, an evenly distributed radiation pattern is formed around the wireless electronic device 201. The radiation pattern around the wireless electronic device 201 exhibits little directional distortion along the z-axis with broad, encompassing radiation, symmetrically covering the space around the front side and back side of the wireless electronic device 201. Referring to FIGS. 13B and 13C, although a broad radiation pattern is exhibited in FIG. 13A with respect to the front and back faces of the wireless electronic device 201, poor gain characteristics and distortion may be present in the direction of the x-axis.

Figure 14:
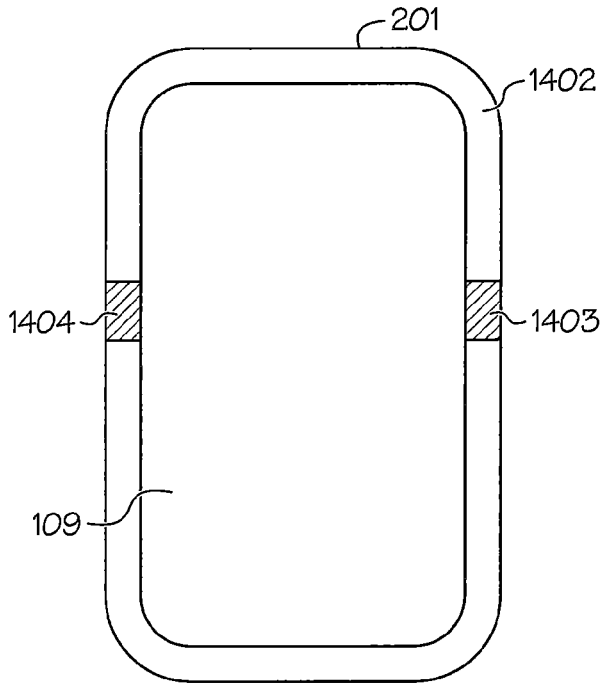
FIG. 14 illustrates a wireless electronic device with a metal ring antenna, according to various embodiments of the present inventive concepts.

The dual patch antenna and/or the dual DRA described herein may be suitable for use at millimeter band radio frequencies in the electromagnetic spectrum, for example, from 10 GHz to 300 GHz. In some embodiments, if may be desirable for the wireless electronic device 201 to transmit and/or receive signals in the cellular band of 850 to 1900 MHz. Referring now to FIG. 14, a wireless electronic device 201 including a metal ring antenna 1402 is illustrated. The metal ring antenna may extend along an outer edge of the PCB 109. The metal ring antenna may be spaced apart and electrically isolated from the PCB 109. The metal ring antenna 1402 may be coupled to PCB 109 through grounding components 1403 and 1404. The metal ring antenna may be configured to resonate at a frequency in the cellular band of 850 to 1900 MHz that is different from the millimeter band of the dual patch antenna and/or the dual DRA.

Figure 15:
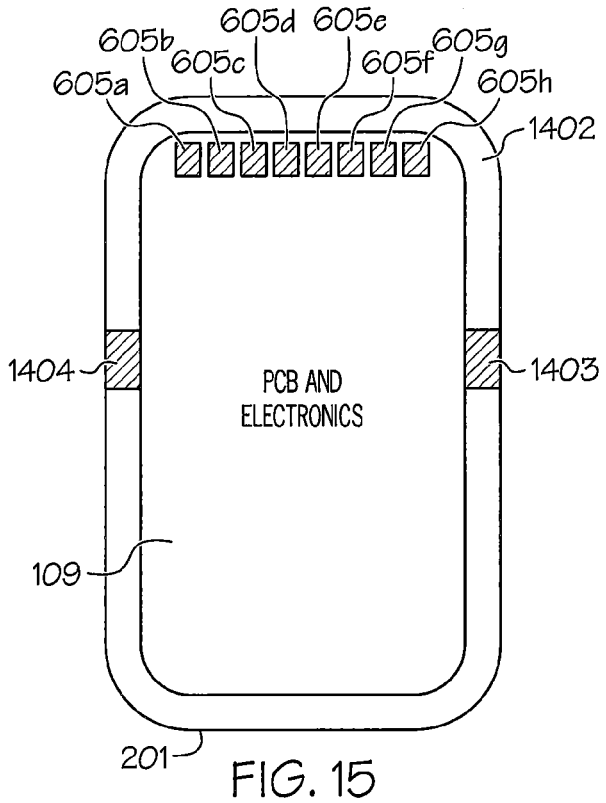
FIG. 15 illustrates a wireless electronic device with a metal ring antenna as well as dual radiating element array antenna, according to various embodiments of the present inventive concepts.

Referring to FIG. 15, a wireless electronic device 201 with the metal ring antenna 1402 of FIG. 14 as well as the dual patch array antenna of FIGS. 12A and 12B is illustrated. FIG. 15 illustrates a front view of the mobile device and thus illustrates first patch antenna elements 605*a*-605*h*. Corresponding second patch antenna elements may be located on the back side of the wireless electronic device 201. Although FIG. 15 is described in the context of the dual patch antenna array of FIGS. 12A and 12B as a non-limiting example, the array may include the first and second radiating elements of FIGS. 5A and 5B, and/or the first and second flux couples of FIG. 11A and/or the first and second dielectric blocks of the DRA antenna of FIG. 11A, according to some embodiments.

Figure 16:
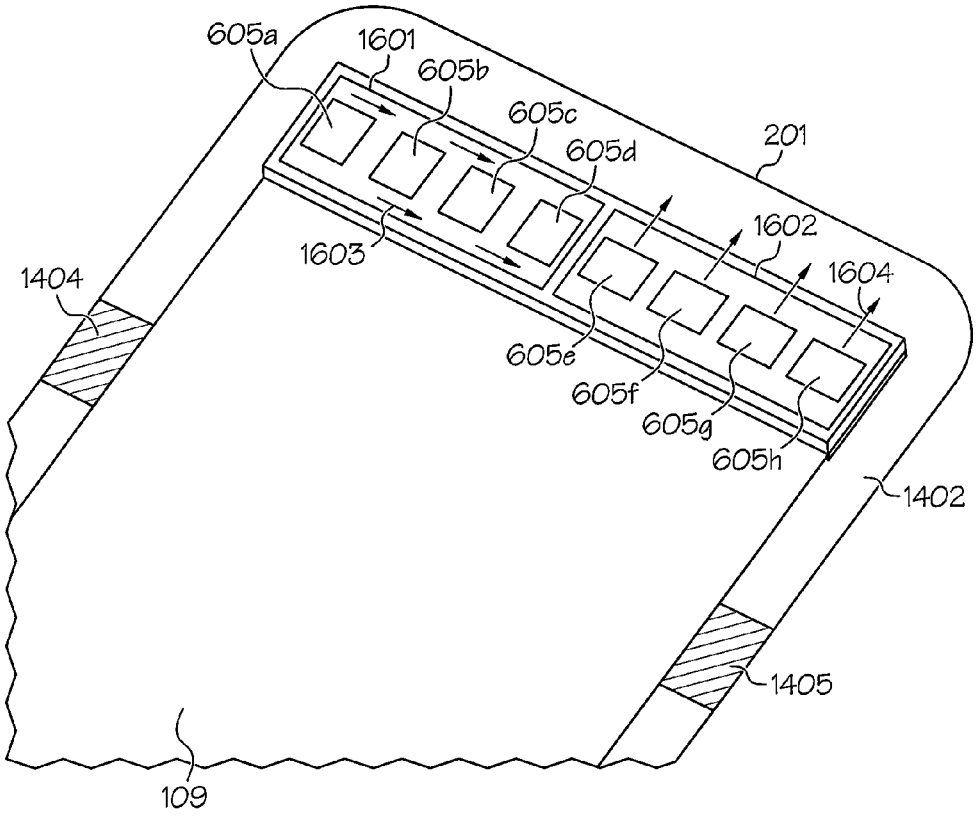
FIG. 16 illustrates a wireless electronic device with a metal ring antenna as well as dual radiating element Multiple Input and Multiple Output (MIMO) array antenna, according to various embodiments of the present inventive concepts.

Referring to FIG. 16, a wireless electronic device with a metal ring antenna as well as a dual patch Multiple Input and Multiple Output (MIMO) array antenna is illustrated. FIG. 16 illustrates the dual patch array antenna of FIG. 15, with an array dual patch antennas configured in subarrays for MIMO operation. For example, patch antenna elements 605*a* to 605*d* comprise MIMO subarray 1601 whereas patch antenna elements 605*e* to 605*h* comprise MIMO subarray 1602. Although not illustrated in FIG. 16, corresponding second patch antenna elements 606*a* to 606*h* may be present on the back side of the wireless electronic device 201. Arrows 1603 indicate the direction of polarization of MIMO subarray 1601 whereas arrows 1604 indicates the direction of polarization of MIMO subarray 1602. Corresponding second patch antenna elements 606*a* to 606*d* on the back of the wireless electronic device 201 and associated with MIMO subarray 1601, may have a direction of polarization that is orthogonal to the direction indicated by 1603. Likewise, corresponding second patch antenna elements 606*e* to 606*h* on the back of the wireless electronic device 201 and associated with MIMO subarray 1602, may have a direction of polarization that is orthogonal to the direction indicated by 1604. Although FIG. 16 is described in the context of the dual patch antenna of FIG. 6A and/or FIG. 6B as a non-limiting example, the MIMO array antenna may include the first and second radiating elements of FIGS. 5A and 5B, and/or the first and second flux couples of FIG. 11A and/or the first and second dielectric blocks of the DRA antenna of FIG. 11B, according to some embodiments.

Figure 17A:
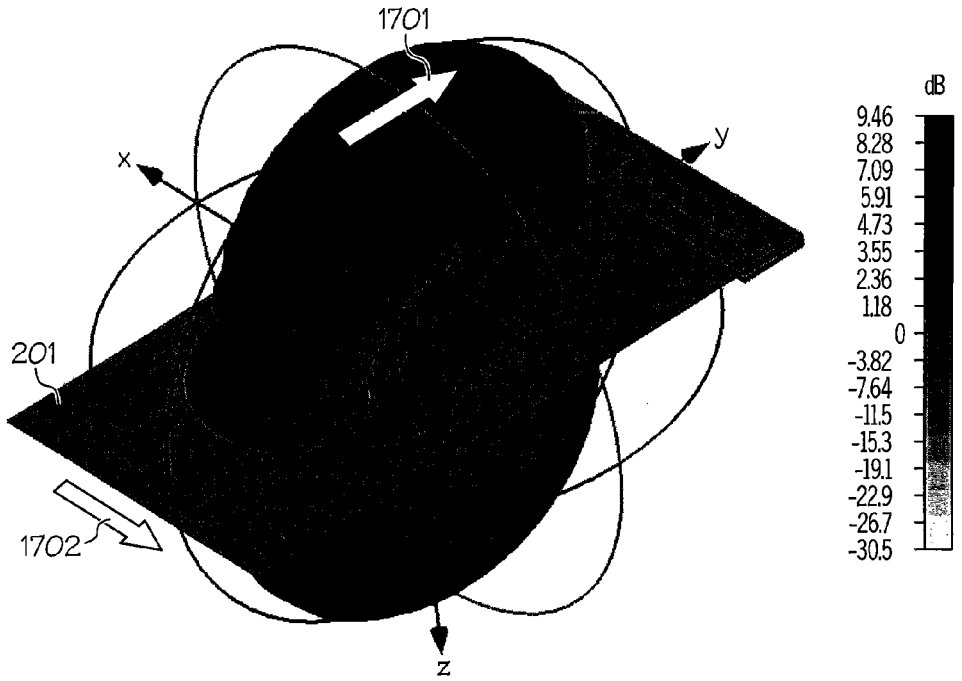
FIGS. 17A and 17B illustrate the radiation patterns around the wireless electronic device for various subarrays of the dual patch MIMO array antenna including the antenna of FIG. 16, according to various embodiments of the present inventive concepts.

Referring to FIG. 17A, the radiation patterns around the wireless electronic device 201 for the dual patch MIMO subarray 1601 of FIG. 16 is illustrated. Arrow 1701 indicates the polarization of the first patch antenna elements in the dual patch MIMO subarray 1601 and arrow 1702 indicates the polarization of the second patch antenna elements in the dual patch MIMO subarray 1601. The radiation pattern around the wireless electronic device 201 exhibits little directional distortion on the z-axis with broad, encompassing radiation covering the space around the front side and back side of the wireless electronic device 201.

Figure 17B:
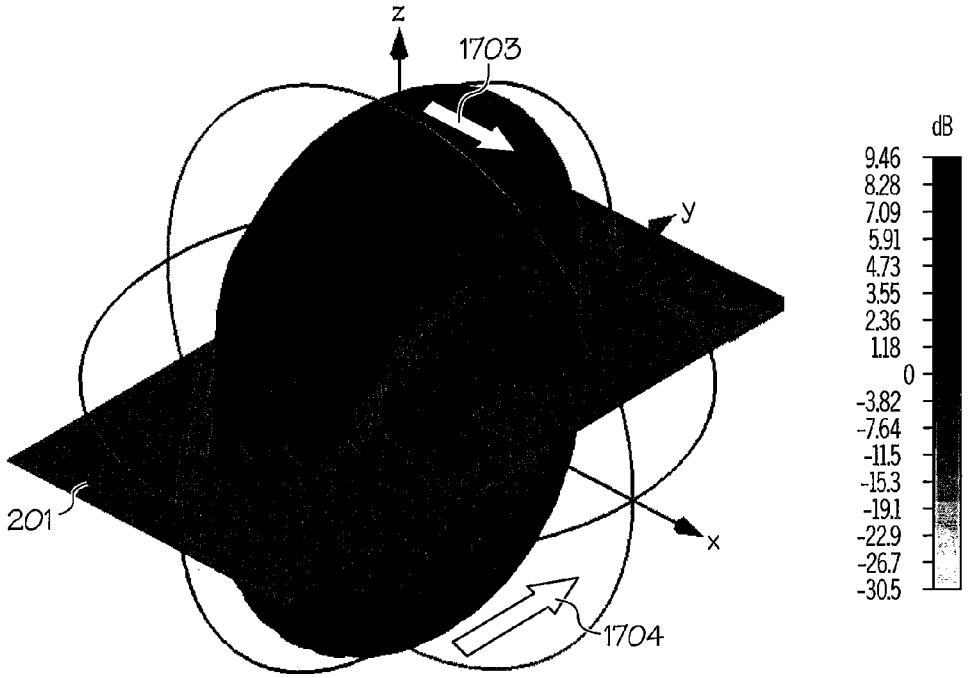

Referring to FIG. 17B, the radiation patterns around the wireless electronic device 201 for dual patch MIMO subarray 1602 of FIG. 16 is illustrated. Arrow 1703 indicates the polarization of the first patch antenna elements in the dual patch MIMO subarray 1602 and arrow 1704 indicates the polarization of the second patch antenna elements in the dual patch MIMO subarray 1602. The radiation pattern around the wireless electronic device 201 exhibits little directional distortion on the z-axis with broad, encompassing radiation covering the space around the front side and back side of the wireless electronic device 201.

Figure 18:
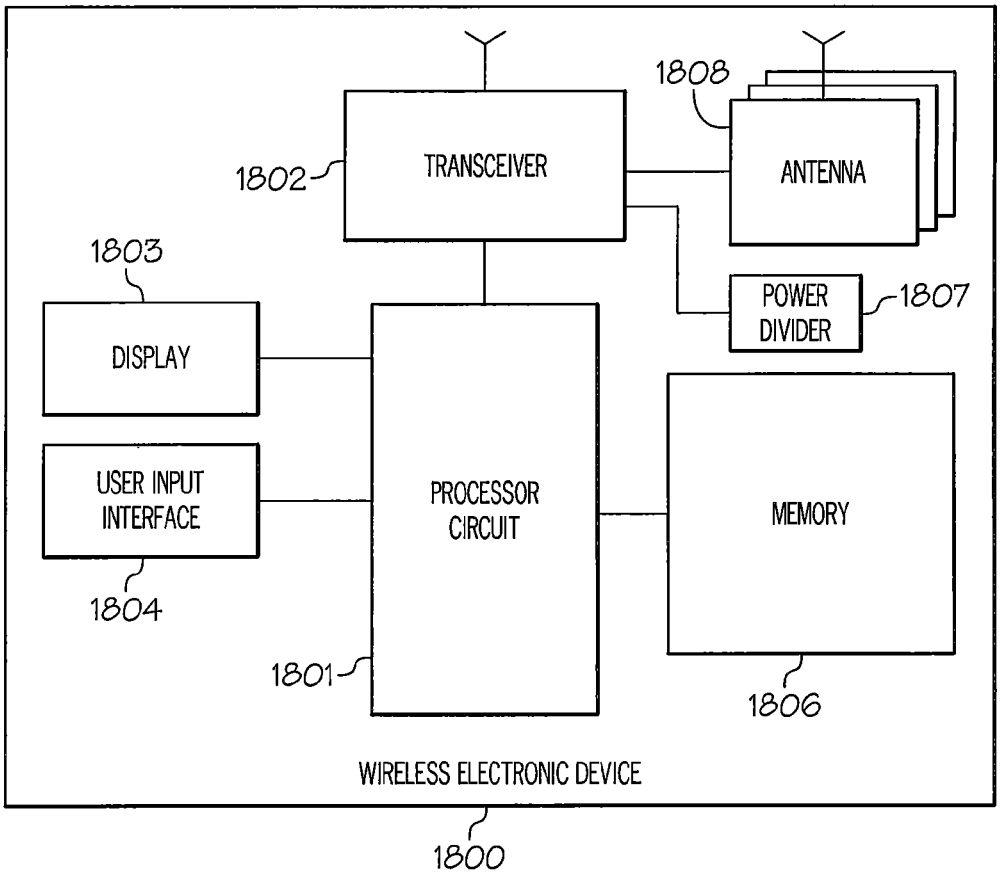
FIG. 18 illustrates a wireless electronic device such as a cell phone including one or more antennas according to any of FIGS. 1 to 17B and 19 to 34, according to various embodiments of the present inventive concepts.

Referring to FIG. 18, a wireless electronic device 1800 such as a cell phone including one or more antennas according to any of FIGS. 1 to 17B is illustrated. The wireless electronic device 1800 may include a processor 1801 for controlling the transceiver 1802, power divider 1807, and/or one or more antennas 1808. The one or more antenna 1808 may include the patch antenna 600 of FIG. 6A and/or FIG. 6B, the DRA 1100 of FIG. 11A and/or FIG. 11B, and/or the metal ring antenna 1402 of FIGS. 14 to 16. The wireless electronic device 1800 may include a display 1803, a user interface 1804, and/or memory 1806. In some embodiments, the power divider 1807 may be part of an electronic circuit package 503 of FIG. 5A.

The above discussed antenna structures for millimeter band radio frequency communication with dual radiating elements may produce uniform radiation patterns with respect to the front face and back face of a mobile device. The dual patch antennas and/or the dual DRA antenna may control the radiation pattern of the antenna. A collection of the dual radiating elements arranged in an array may provide MIMO communication in addition to omni-directional radiation patterns. In some embodiments, the polarization of the first radiating element of the dual radiating element antenna may be orthogonal to the second radiating element, improving far field gain. In some embodiments, a power divider may be used in conjunction with dual radiating element antenna to improve coverage of the antenna. In some embodiments, a metal ring antenna may be used in conjunction with the dual radiating element antenna for cellular frequency communication. The described inventive concepts create antenna structures with omni-directional radiation, wide bandwidth, and/or multi-frequency use.

Antenna Including an Array of Dual Radiating Elements and Power Dividers

Various wireless communication applications may use a dual radiating element antenna. The dual radiating element antenna may be suitable for use in the millimeter band radio frequencies in the electromagnetic spectrum from 10 GHz to 300 GHz. The dual radiating element antenna may provide radiation beams that are quite broad. A potential disadvantage of dual radiating element antennas is that the path loss may be high. For example, if a dual radiating element antenna is used in a mobile device, the radiation pattern around the mobile device may not have enough peak gain for the desired application.

Various embodiments described herein may arise from a recognition that a single dual radiating element antenna may be improved by adding other dual radiating element antennas to produce a dual radiating element antenna array design. The array of dual radiating element antennas may improve the antenna performance by producing high gain signals that cover the three-dimensional space around the mobile device. Further performance improvements may be obtained by adding a plurality of power dividers to control power to various elements in the array of dual radiating element antennas based on signal conditions.

Figure 19:
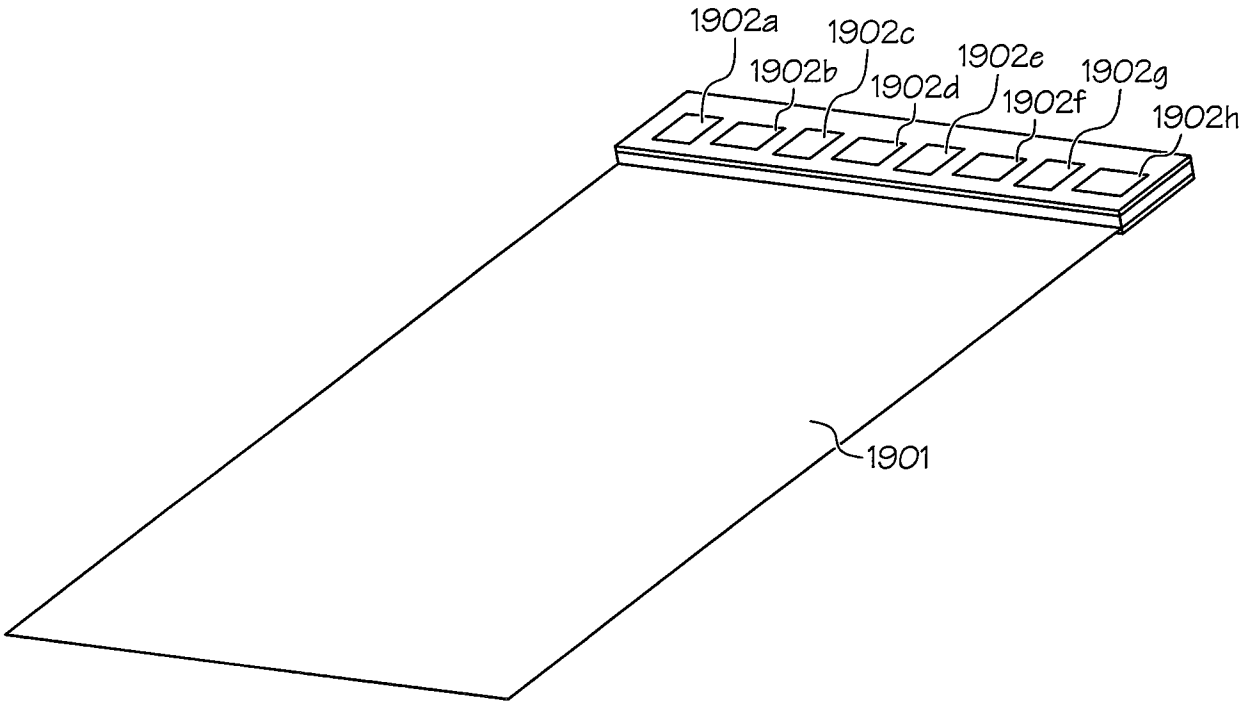
FIG. 19 illustrates a wireless electronic device including an array of dual radiating element antennas, according to various embodiments of the present inventive concepts.

FIGS. 1 to 18 have been discussed above and include embodiments related to antennas with dual radiating elements. FIGS. 19 to 34 will now discuss antennas including an array of dual radiating elements and power dividers. Referring now to FIG. 19, a wireless electronic device 1901 including an array of dual radiating element antennas is illustrated. The top side of the wireless electronic device 1901 is illustrated, which includes the first radiating elements 1902*a* to 1902*h*. Corresponding seconding radiating elements are located on the opposite, bottom side of the wireless electronic device 1901 and are not illustrated in FIG. 19.

Figure 20:
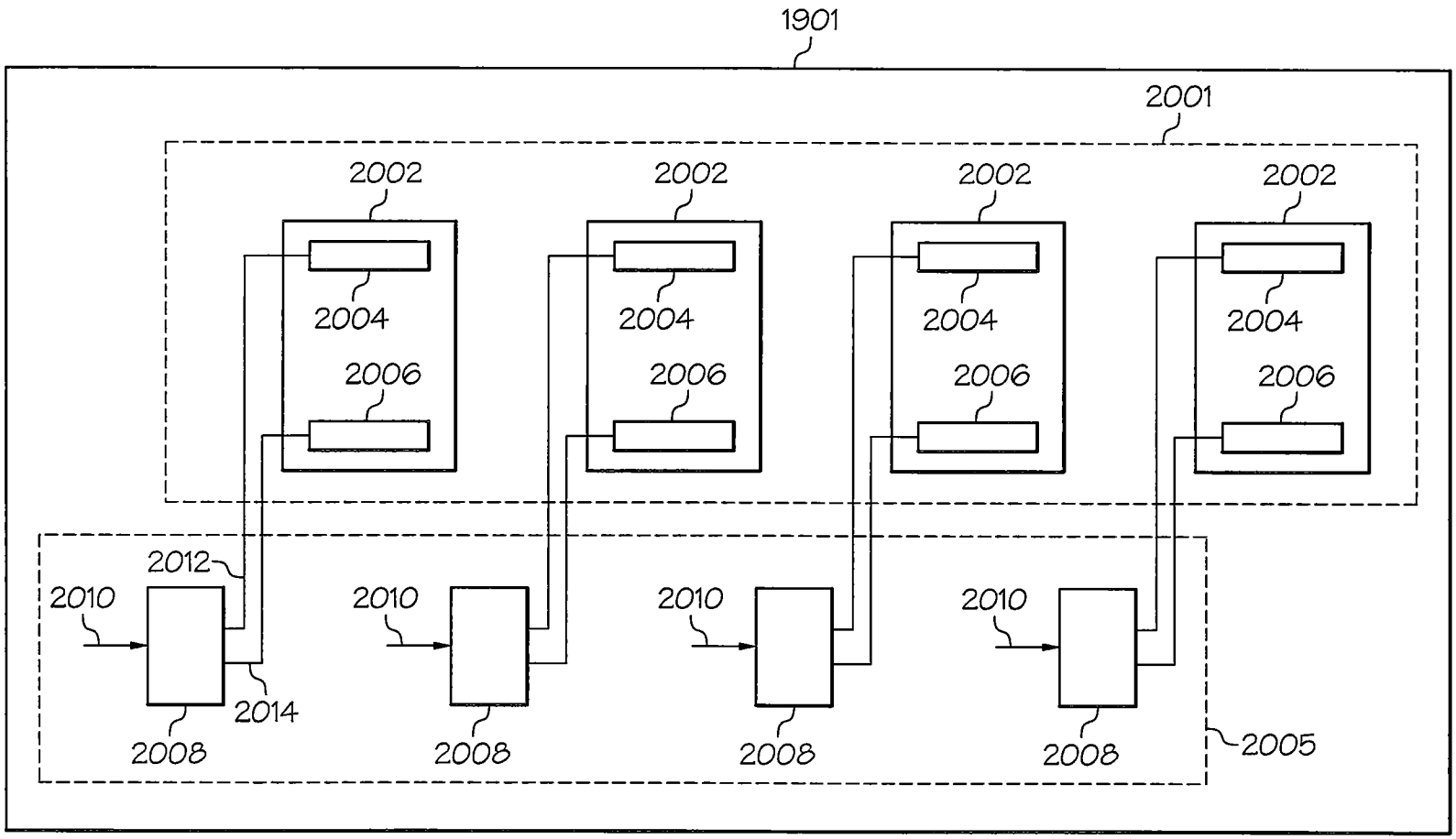
FIG. 20 illustrates a plurality of dual radiating element antennas according to FIG. 19 and power dividers, according to various embodiments of the present inventive concepts.

Referring now to FIG. 20, a wireless electronic device 1901 including a plurality of dual radiating element antennas 2002 and a plurality of power dividers 2008 is illustrated. Each of the dual radiating element antennas 2002 may include a first radiating element 2004 and a second radiating element 2006. In some embodiments, the first radiating element 2004 and/or the second radiating element 2006 may include a patch element. In some embodiments, the first radiating element 2004 and/or the second radiating element 2006 may include a dielectric block on a conductive layer. The plurality of dual radiating element antennas 2002 may be arranged in an array 2001 of dual radiating element antennas. The plurality of power dividers 2008 may be arranged in an array 2005 of power dividers.

Still referring to FIG. 20, a signal 2010 may be input into a power divider 2008. The power divider 2008 may be configured to divide a power of the signal 2010 into a first portion of the power and/or a second portion of the power. The power divider 2008 may apply the signal 2010 at the first portion of the power 2012 to the first radiating element 2004 and/or the power divider 2008 may apply the signal 2010 at the second portion of the power 2014 to the second radiating element 2006. In some embodiments, the power divider may divide the power evenly between the first radiating element 2004 and the second radiating element 2006, i.e. 50% of the power may be applied to the first radiating element 2004 and 50% of the power may be applied the second radiating element 2006. In some embodiments, the portions of power may be divided unevenly by the power divider, i.e. a higher portion of the power may be applied to the first radiating element 2004 or a higher portion of the power may be applied to the second radiating element 2006. In some embodiments, all of the power (i.e. 100%) may be applied to the first radiating element 2004 or all of the power (i.e. 100%) may be applied to the second radiating element 2006.

In some embodiments, a respective one of the plurality of dual radiating antennas 2002 may be configured such that a first polarization of the signal at the first portion of the power 2012 applied to the first radiating element 2004 is orthogonal to a second polarization of the signal at the second portion of the power 2014 applied to the second radiating element 2006. In some embodiments, a third polarization of a respective first radiating element 2004 of a first one of the plurality of dual radiating antennas may be orthogonal to a fourth polarization of a respective first radiating element 2004 of a second one of the plurality of dual radiating antennas that is adjacent the first one of the plurality of dual radiating antennas. A fifth polarization of a respective second radiating element 2006 of the first one of the plurality of dual radiating antennas may be orthogonal to a sixth polarization of a respective second radiating element 2006 of the second one of the plurality of dual radiating antennas that is adjacent the first one of the plurality of dual radiating antennas. In some embodiments, the third polarization may be orthogonal to the fifth polarization, and/or the fourth polarization may be orthogonal to the sixth polarization.

Figure 21:
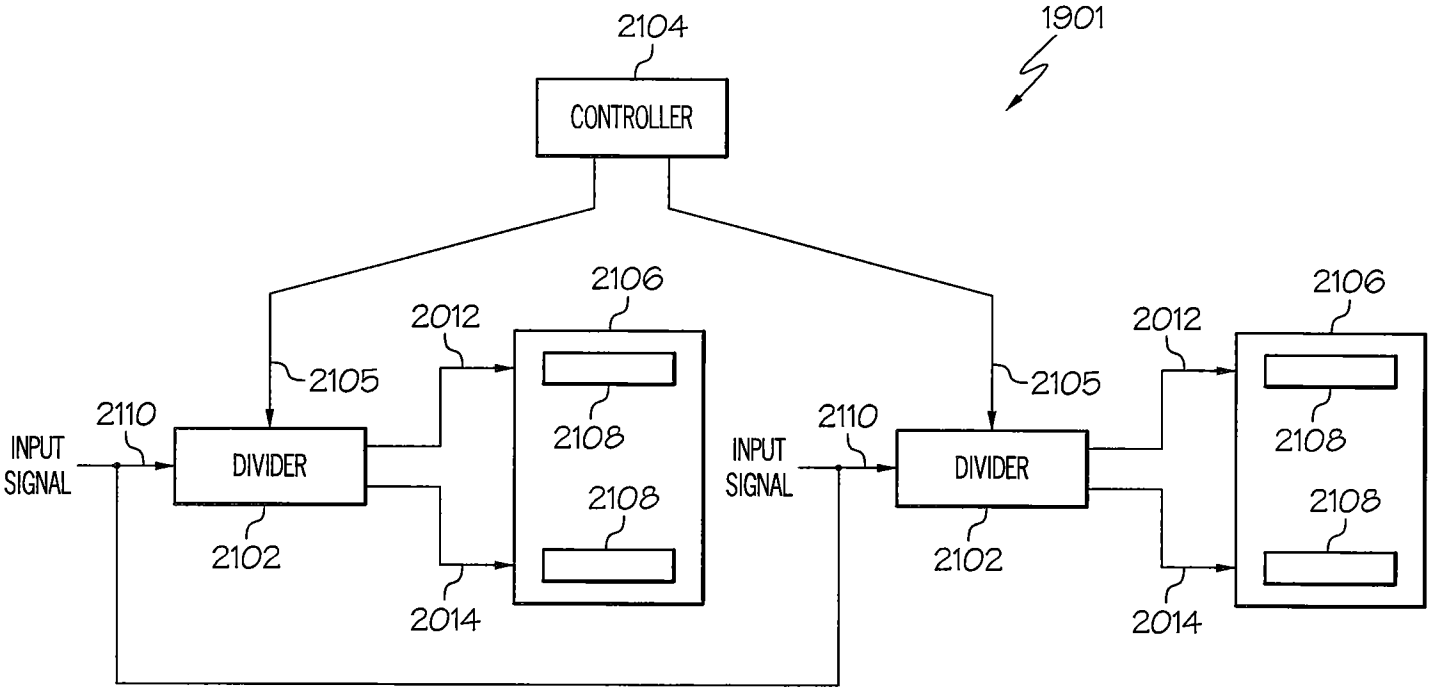
FIG. 21 illustrates dual radiating element antennas according to FIG. 19 and power dividers along with a controller for diversity combining systems, according to various embodiments of the present inventive concepts.

Referring now to FIG. 21, dual radiating element antennas and power dividers along with a controller for diversity combining systems are illustrated. Diversity combining is a technique applied to combine the multiple received signals of a diversity reception device into a single improved signal. For this diversity combining system, the same input signal 2110 is received at multiple power dividers 2102. The power dividers 2102 divide the power of the input signal 2110 between the first radiating element 2106 and the second radiating element 2108. In some embodiments, the power divider may be configured and/or controlled by a controller 2104. The controller 2104 may generate one or more control signals 2105 that control the amount and/or portion of the power of the input signal 2110 that is applied by the power divider to the first radiating element 2106 and the second radiating element 2108. The control signal 2105 may provide an indication of a value of the first portion of the power 2012 and/or the second portion of the power 2014 of the input signal 2110 that is applied by the power divider to the first radiating element 2106 and the second radiating element 2108.

Figure 22:
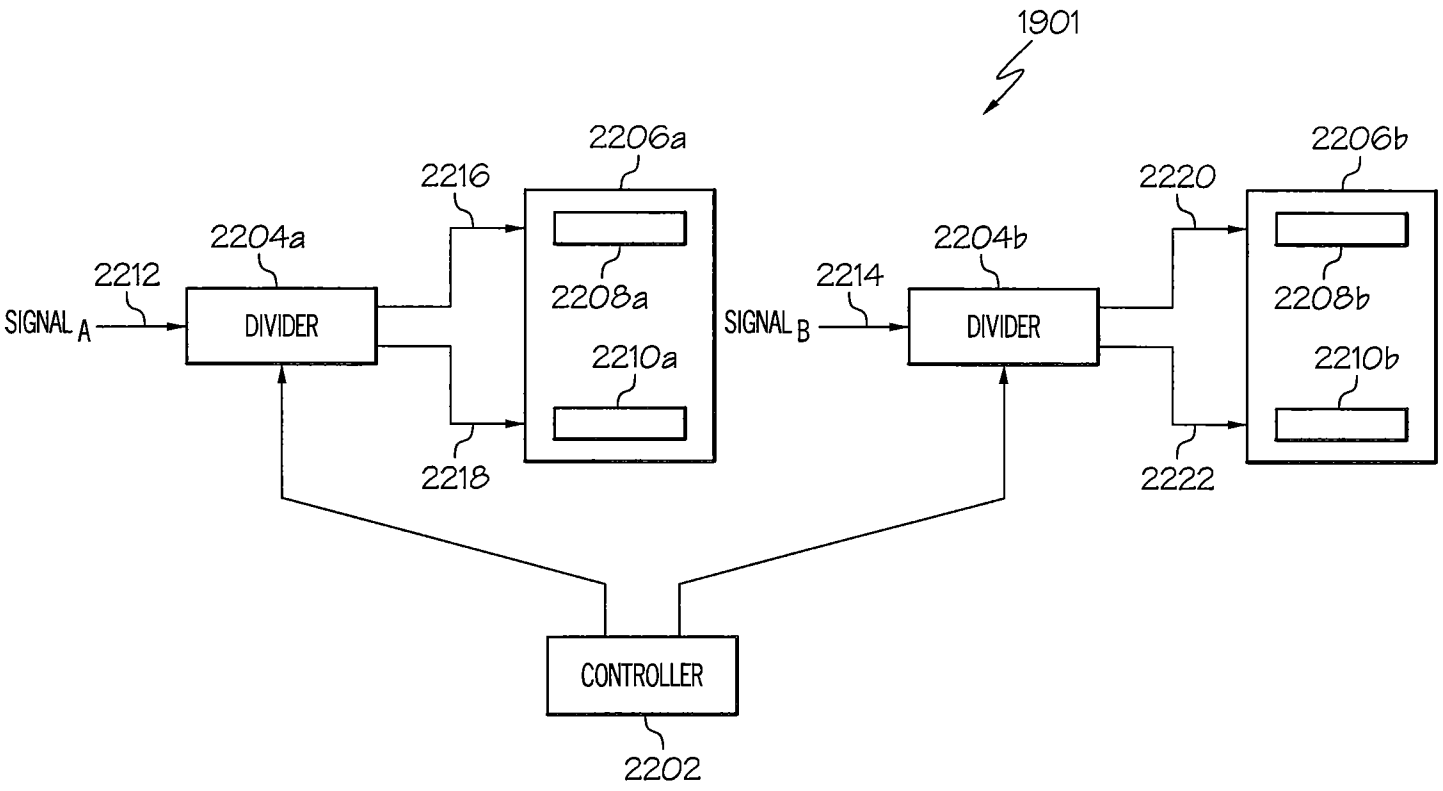
FIG. 22 illustrates a plurality of dual radiating element antennas according to FIG. 19 and power dividers for MIMO systems, according to various embodiments of the present inventive concepts.

Referring now to FIG. 22, a plurality of dual radiating element antennas 2206*a*, 2206*b* and power dividers 2204*a*, 2204*b* for Multiple Input and Multiple Output (MIMO) systems are illustrated. For the MIMO system, signal$_A$ 2212 may be associated with dual radiating element antenna 2206*a* and signal$_B$ 2214 may be associated with dual radiating element antenna 2206*b*. Signal$_A$ 2212 and signal$_B$ 2214 may be subjected to different phases and/or channel characteristics. Signal$_A$ 2212 is input into power divider 2204*a* and may be different from input signal$_B$, which is input into power divider 2204*b*. Power divider 2204*a* may divide the power of the signal$_A$ 2212 and apply signal$_A$ 2212 at a first portion of the signal power 2216 to the first radiating element 2208*a* and apply signal$_A$ 2212 at a second portion of the signal power 2218 to the second radiating element 2210*a*. Similarly, power divider 2204*b* may divide the power of the signal$_B$ 2214 and apply signal$_B$ 2214 at a first portion of the signal power 2220 to the first radiating element 2208*b* and apply signal$_B$ 2214 at a second portion of the signal power 2222 to the second radiating element 2210*b*.

Figure 23:
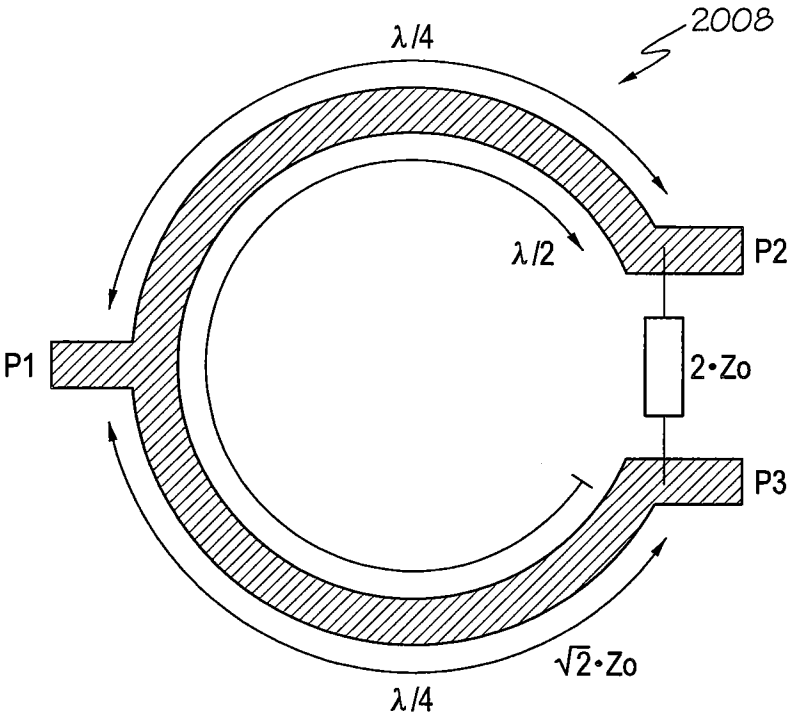
FIG. 23 illustrates a power divider, according to various embodiments of the present inventive concepts.

Referring now to FIG. 23, an embodiment of a power divider 2008 of FIG. 20 is illustrated in detail. The power divider 2008 may be coupled to an input signal P1 and may provide outputs P2 and P3. In some embodiments, the power divider 2008 may be the shape of concentric rings with a length of $\lambda/4$ on a top half of the outer ring between the input P1 and output P2 and a length of $\lambda/4$ on a bottom half of the outer ring between the input P1 and output P3. In some embodiments, the inner ring may be a length of $\lambda/2$. An impedance matching element $2 \cdot Z_0$ may be coupled to P2 and/or P3 near the inner ring. In some embodiments, the outer ring may have an impedance characteristic $\text{sqrt}(2)*Z_0$.

Figure 24A:
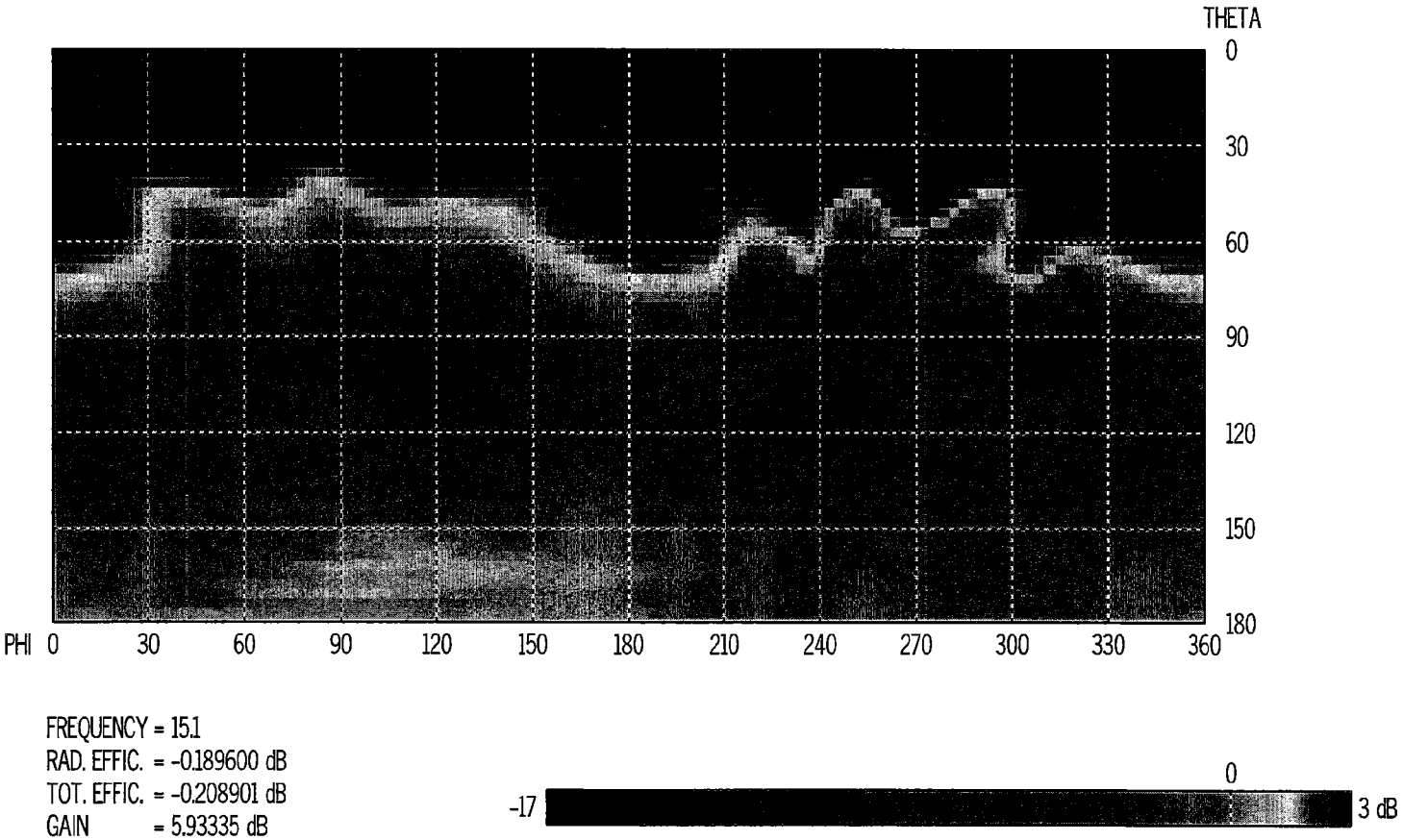
FIGS. 24A-24C illustrate the absolute far field gain at different points along the power divider of FIG. 23, according to various embodiments of the present inventive concepts.
Figure 24B:
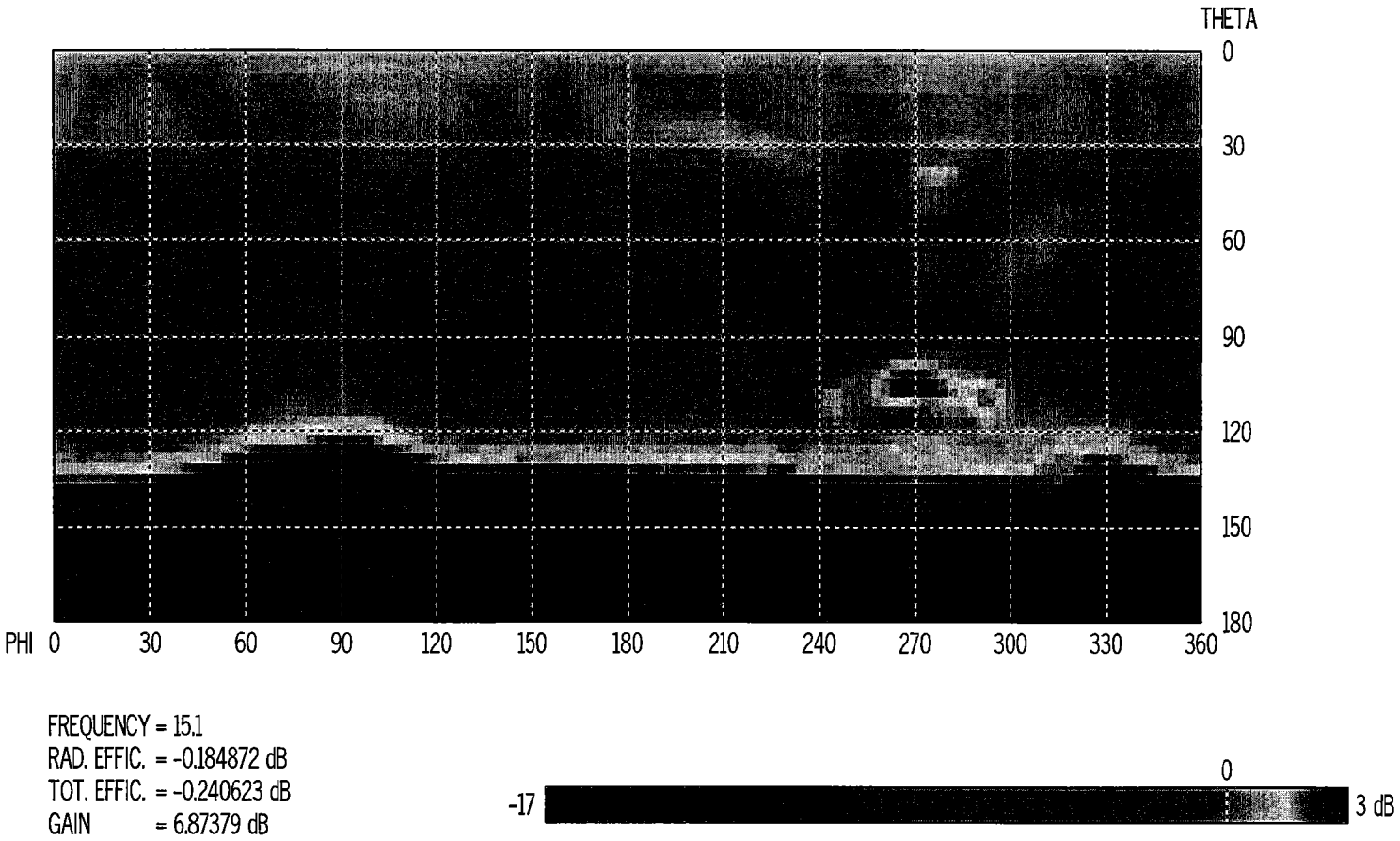
Figure 24C:
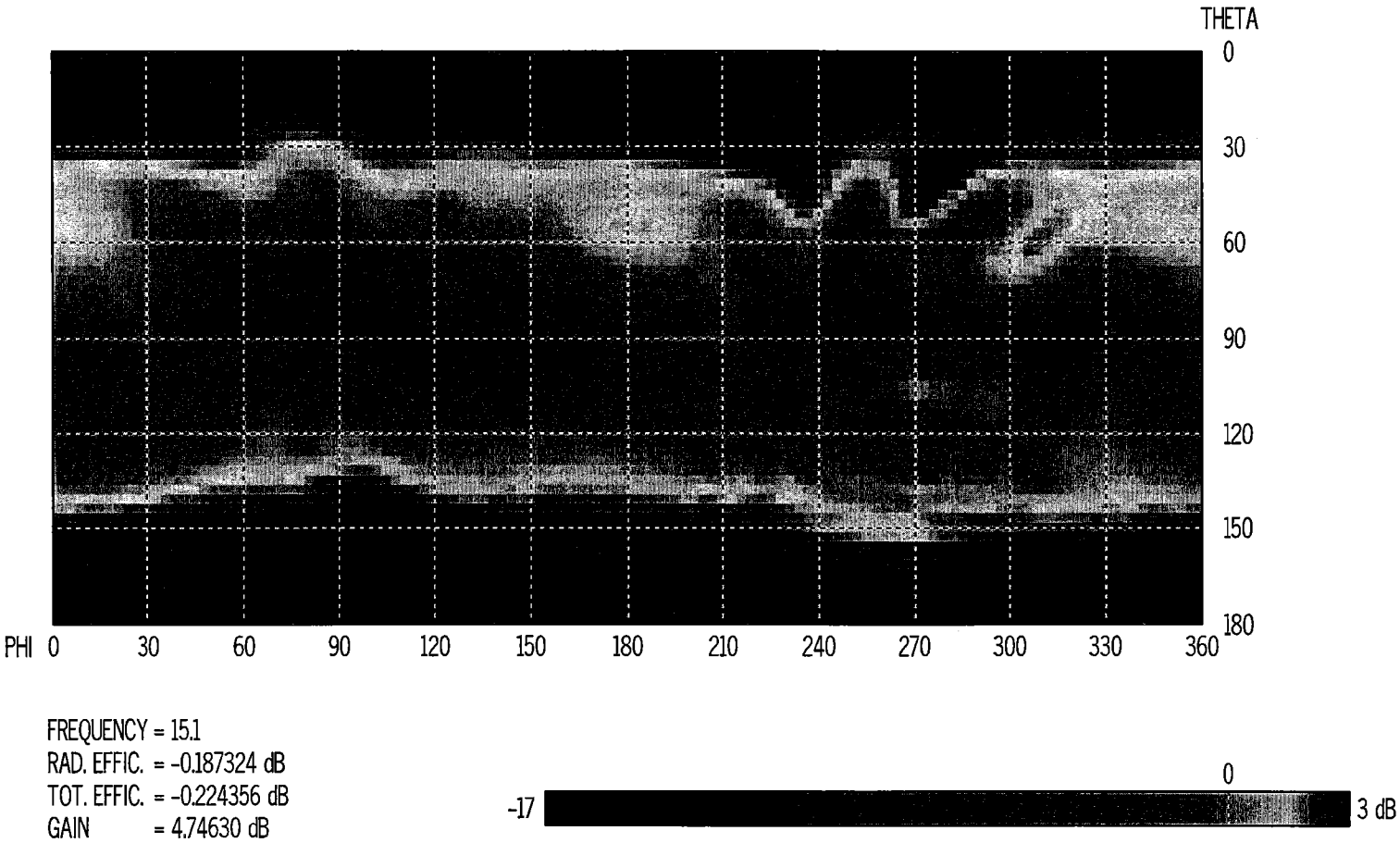

FIGS. 24A-24C illustrate the absolute far field gain at different points along the power divider of FIG. 23. Referring now to FIG. 24A, the absolute far field gain at 15.1 GHz excitation at a first radiating element of a dual radiating element antenna, of a signal at output P2 of the power divider 2008 of FIG. 23 is illustrated. Referring now to FIG. 24B, the absolute far field gain at 15.1 GHz excitation at a second radiating element of a dual radiating element antenna, of a signal at the output P3 of the power divider 2008 of FIG. 23 is illustrated. Referring now to FIG. 24C, the overall absolute far field gain at 15.1 GHz excitation of a dual radiating element antenna is illustrated.

Figure 25:
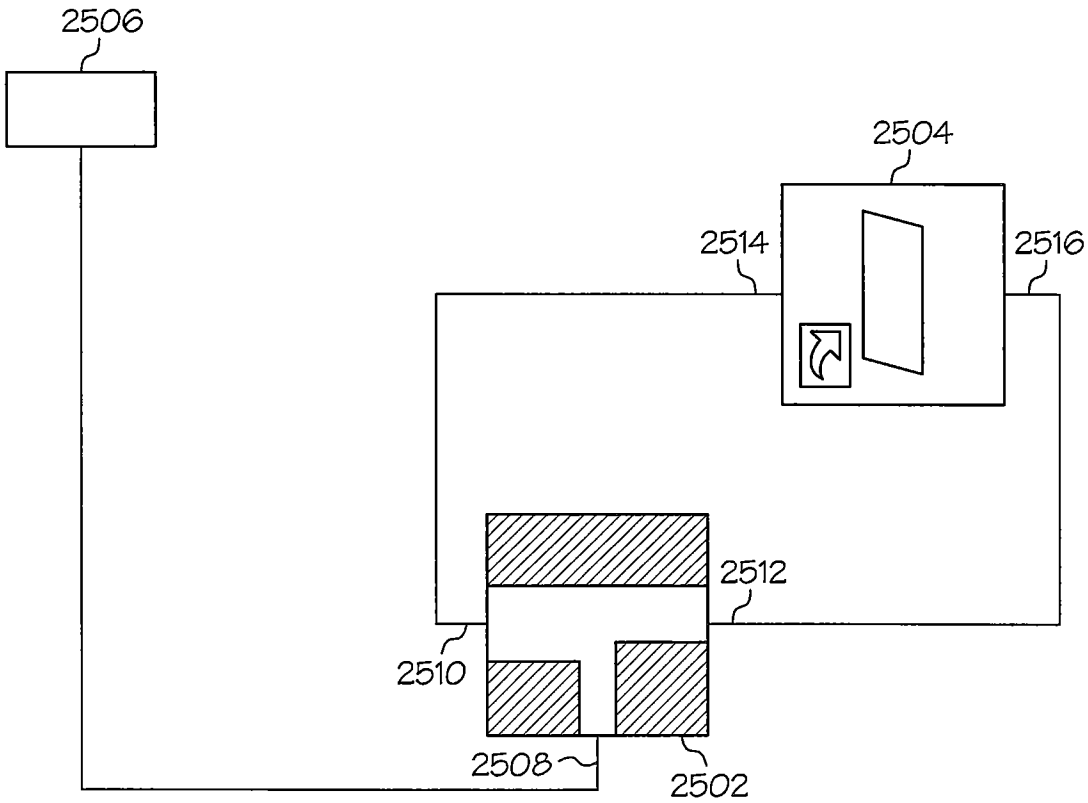
FIG. 25 illustrates a switch for selecting different feeding schemes, according to various embodiments of the present inventive concepts.

Referring now to FIG. 25, a switch 2502 for selecting different feeding schemes is illustrated. In some embodiments, different antenna feeding schemes may be used based on the channel situation. In other words, a feeding scheme may be selected to tune the antenna pattern in response to the channel conditions. Tuning the antenna pattern may include selecting one or more dual radiating element antennas for excitation by the input signals and/or selecting one or more first and/or second radiating elements for excitation by the input signals. In some embodiments, the switch 2502 may be integrated as part of the power divider of FIGS. 20 to 22. In some embodiments, the switch 2502 may be part of the controller 2104 of FIG. 21 and/or controller 2202 of FIG. 22. A control signal 2506 from the controller of 2104 of FIG. 21 and/or from controller 2202 of FIG. 22 may control operation of switch 2502. The switch 2502 may be configured to select output 2510 and/or 2512 to controller the antenna feeding scheme of the wireless electronic device 2504. For example, selecting one or more dual radiating element antennas for excitation by the input signals may be controlled by input 2514 to the wireless electronic device 2504. Selecting one or more first and/or second radiating elements for excitation by the input signals may be controlled by input 2516 to the wireless electronic device 2504.

Figure 26A:
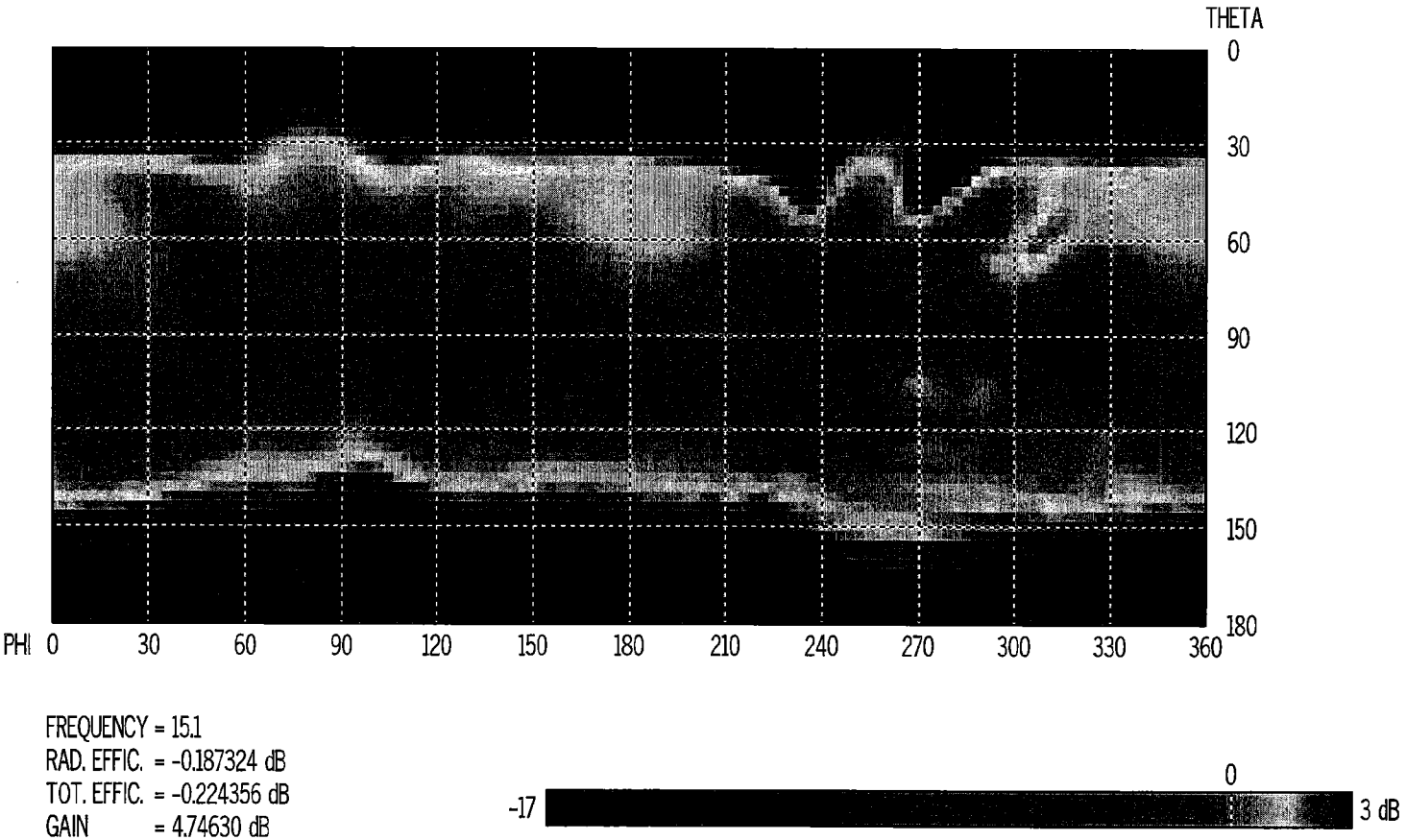
FIGS. 26A-26C illustrate the absolute far field gain for different feeding schemes using the switch of FIG. 25, according to various embodiments of the present inventive concepts.
Figure 26B:
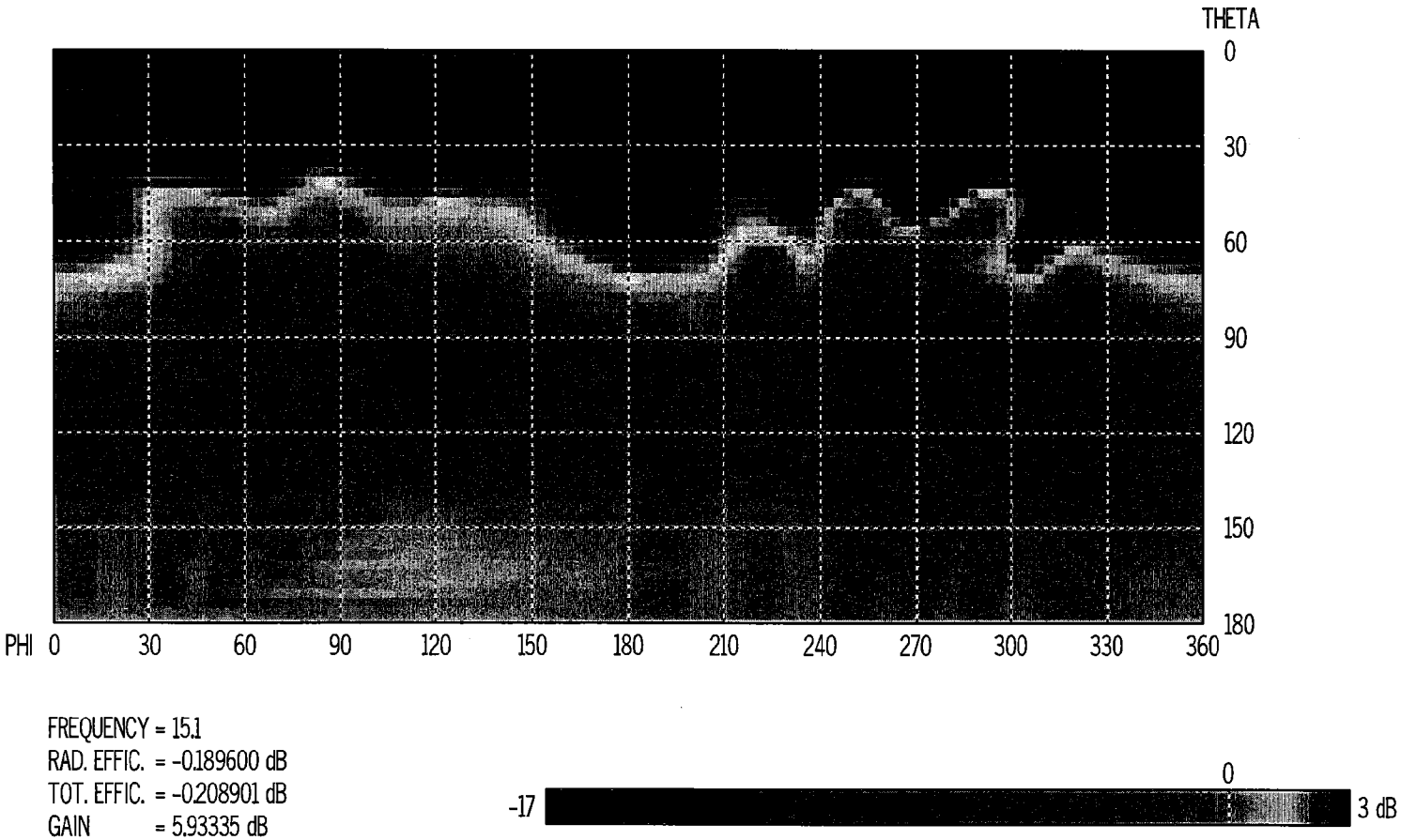
Figure 26C:
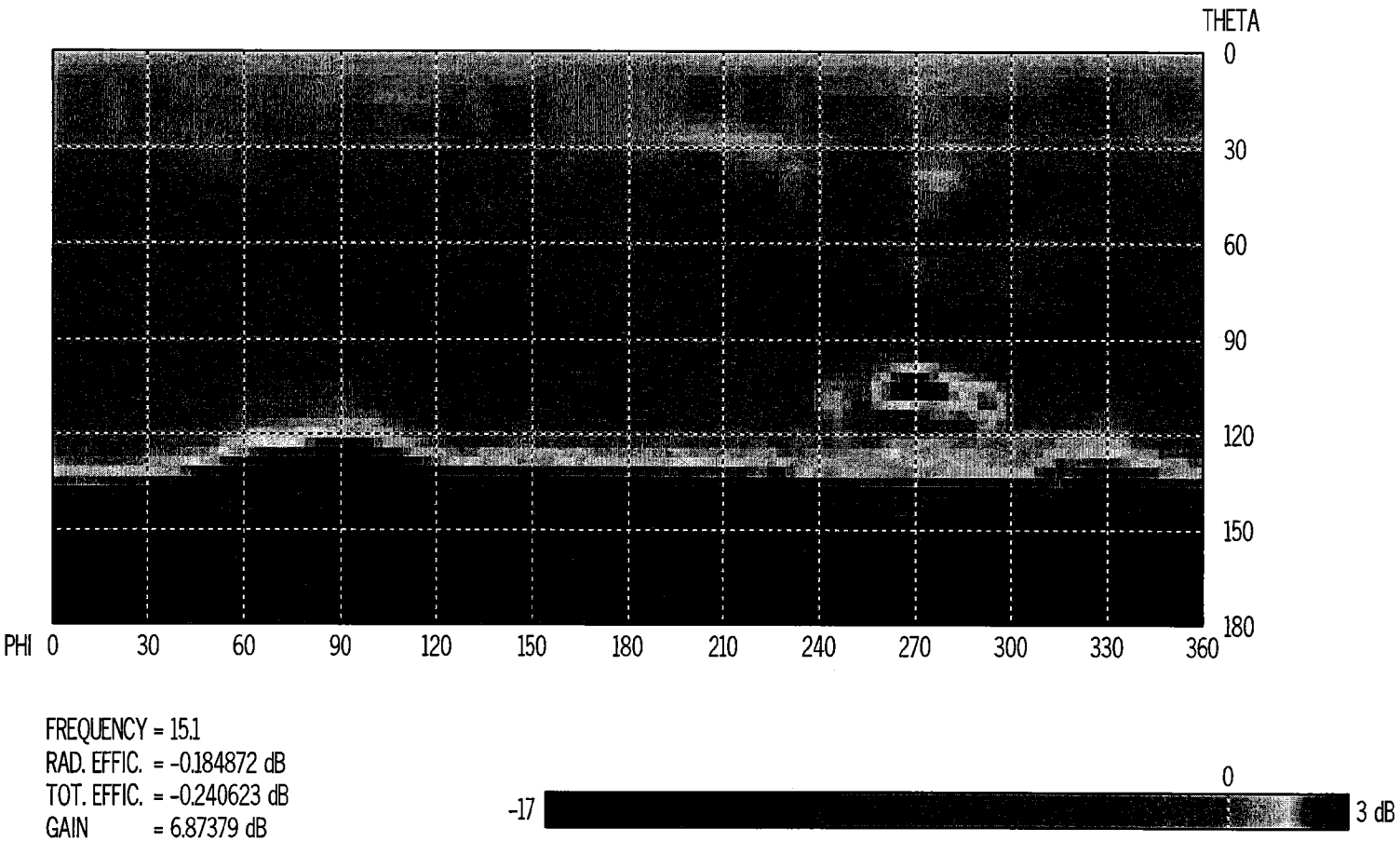

FIGS. 26A-26B illustrate the absolute far field gain for different feeding schemes using the switch of FIG. 25. In some embodiments, switch 2502 of FIG. 25 may be configured as a default feeding scheme to feed all elements in an array of dual radiating element antennas. Referring to FIG. 26A, the absolute far field gain is illustrated for a default feeding scheme which includes exciting first and second radiating elements of one or more dual radiating element antennas. In some embodiments, the switch 2502 of FIG. 25 of may be configured to selectively feed the first radiating element of one or more dual radiating element antennas. Referring to FIG. 26B, the absolute far field gain is illustrated for the case of selectively feeding the first radiating element of one or more dual radiating element antennas. In some embodiments, the switch 2502 of FIG. 25 may be configured to selectively feed the second radiating element of one or more dual radiating element antennas. Referring to FIG. 26C, the absolute far field gain is illustrated for the case of selectively feeding the second radiating element of one or more dual radiating element antennas.

Figure 27:
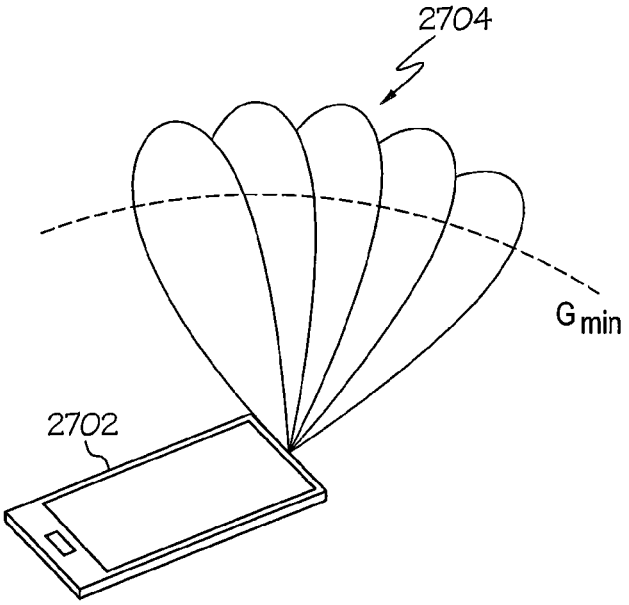
FIG. 27 illustrates antenna coverage provided by a dual radiating element antenna array of FIGS. 19 to 22, according to various embodiments of the present inventive concepts.

FIG. 27 illustrates antenna coverage provided by a dual radiating element antenna array of FIG. 19. A wireless electronic device 2702, such as a mobile phone, may include a dual radiating element antenna array. Use of an array of dual radiating element antennas may increase the overall antenna gain when compared to a single dual radiating element antenna. In some embodiments, the high gain may translate into a relatively narrow beam width of the antenna coverage area 2704, reducing overall coverage around the mobile device. A beam steering function may achieved by use of a phased array of dual radiating element antennas, as will be illustrated in FIGS. 28 to 31B. A phased array may maintain a good signal link when incoming signals arrive from different angles.

Figure 28:
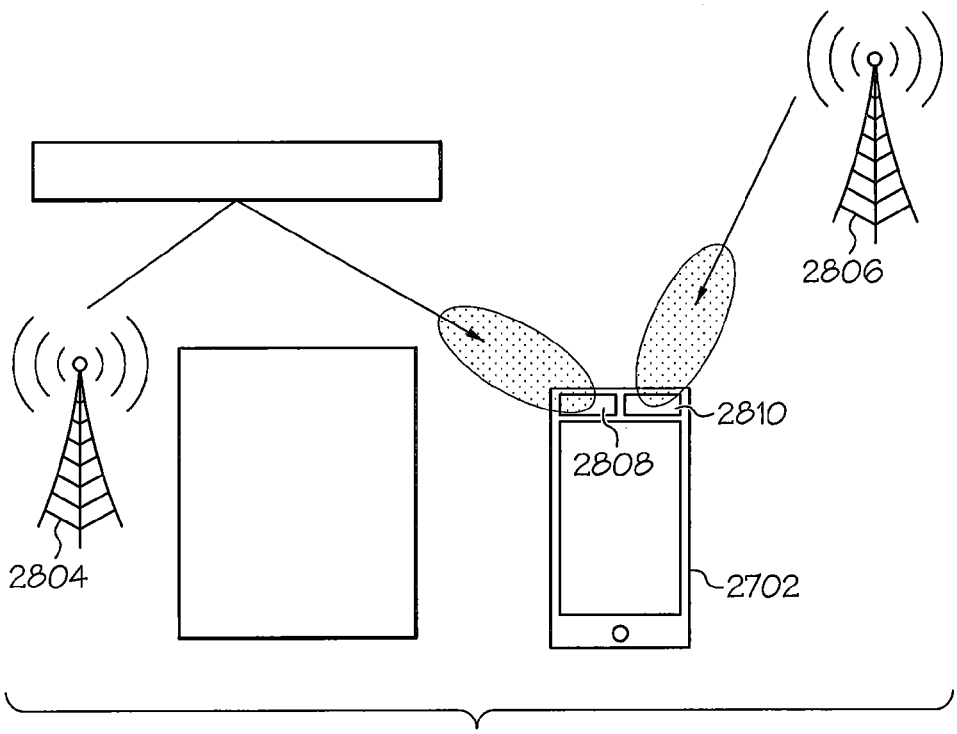
FIG. 28 illustrates signals received by dual radiating element antenna with subarrays, according to various embodiments of the present inventive concepts.

FIG. 28 illustrates signals received by dual radiating element antenna with subarrays 2808 and 2810 in a wireless electronic device 2702. Referring to FIG. 28, antenna subarrays 2808 and 2810 may be tuned to different channel characteristics from different base stations 2804 and 2806. For example, antenna subarray 2808 may be tuned to signals received from base station 2804 whereas antenna subarray 2810 may be tuned to signals received from base station 2806. Similarly, antenna subarrays 2808 and 2810 may be tuned for transmission to base stations 2804 and 2806, respectively. Tuning of antenna subarrays 2808 and 2810 may include controlling power to the first and/or second radiating elements and/or selecting one or more dual radiating element antennas in the respective antenna subarray. Base stations 2804 and/or 2806 may include various types of base stations such as macro-cell base stations, microcell base stations, pico-cell base stations, and/or femto-cell base stations.

Figure 29A:
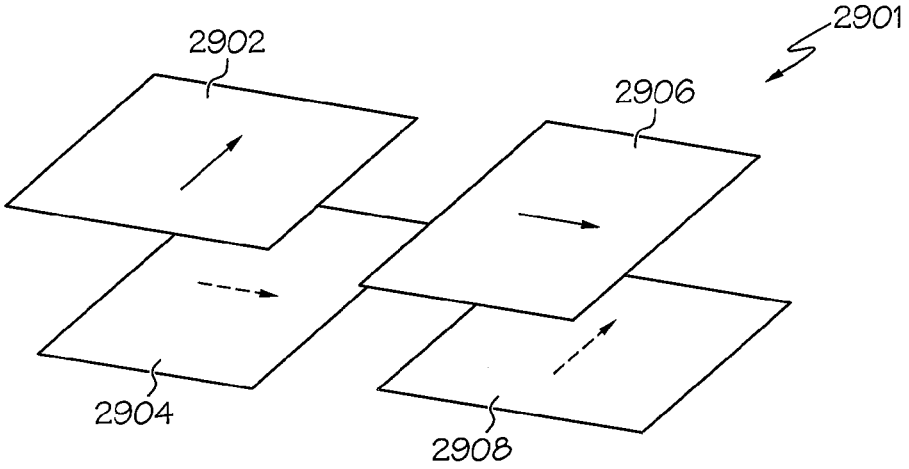
FIG. 29A illustrates a dual patch MIMO antenna array of FIG. 22, according to various embodiments of the present inventive concepts.

FIG. 29A illustrates a dual patch MIMO antenna array 2901. The dual patch MIMO antenna array 2901 may include a first dual patch MIMO antenna including a first patch 2902 and a second patch 2904. The dual patch MIMO antenna array 2901 may include a second dual patch MIMO antenna including a first patch 2906 and a second patch 2908. In some embodiments, the first patches 2902 and 2906 may correspond to a front face of the wireless electronic device 1901 of FIG. 19, such as a mobile phone. The signal applied to the first patch 2902 may be orthogonal to the signal applied to the second patch 2904. Similarly, the signal applied to the first patch 2906 may be orthogonal to the signal applied to the second patch 2908. Moreover, in some embodiments, the signal applied to the first patch 2902 of a first dual patch MIMO antenna may be orthogonal to a signal applied to an adjacent first patch 2906 of a second dual patch MIMO antenna and/or the signal applied to the second patch 2904 of a second dual patch MIMO antenna may be orthogonal to a signal applied to an adjacent second patch 2908 of a second dual patch MIMO antenna.

Figure 29B:
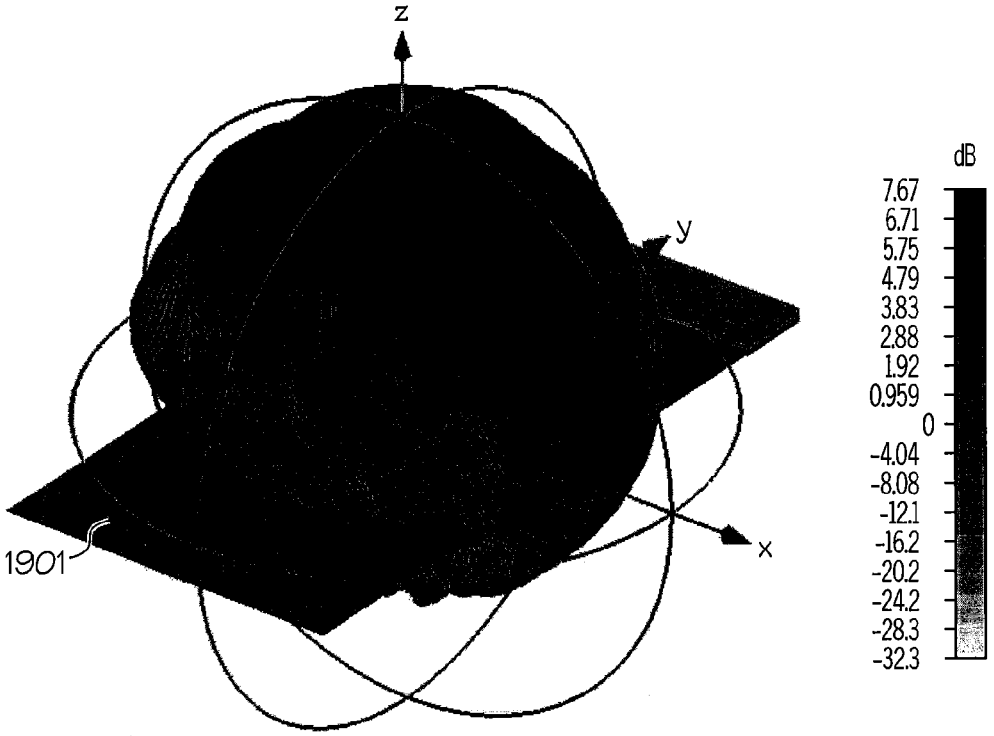
FIGS. 29B to 29E illustrate the radiation pattern around the wireless electronic device, including a dual patch MIMO antenna array of FIG. 29A, according to various embodiments of the present inventive concepts.
Figure 29C:
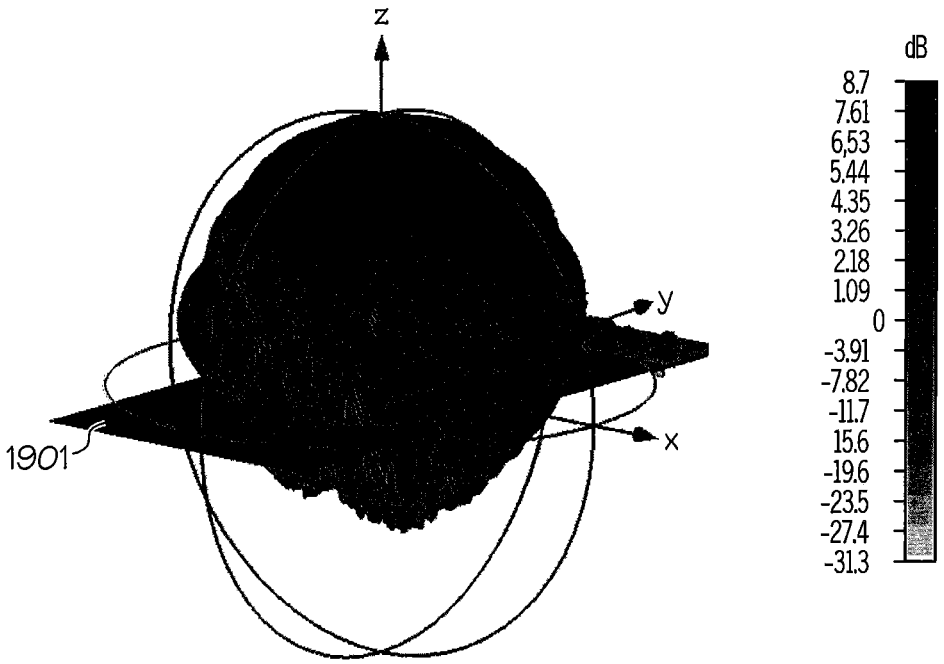
Figure 29D:
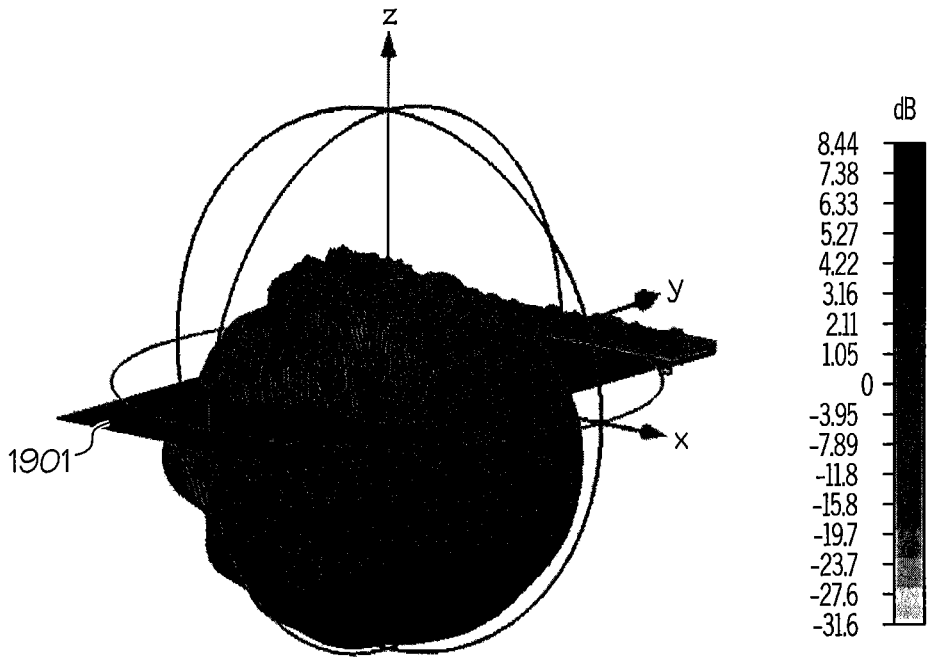
Figure 29E:
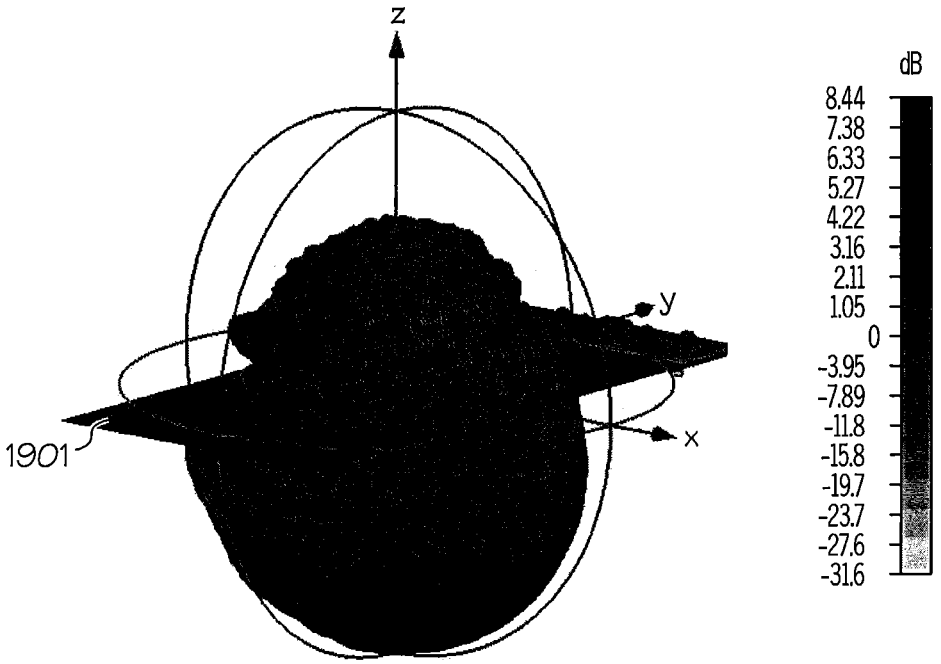

FIGS. 29B to 29E illustrate radiation patterns attributed to various elements of the wireless electronic device 1901, including the dual patch MIMO antenna array of FIG. 29A. Referring now to FIG. 29B, the radiation pattern attributed to the second patch 2908 of FIG. 29A is illustrated. The radiation pattern is directed towards the back face of the wireless electronic device 1901. Referring now to FIG. 29C, the radiation pattern attributed to the first patch 2902 of FIG. 29A is illustrated. The radiation pattern is directed towards the front face of the wireless electronic device 1901. The black arrow of FIG. 29C illustrates the polarization of the signals at the first patch 2902. Referring now to FIG. 29D, the radiation pattern attributed to the first patch 2906 of FIG. 29A is illustrated. The radiation pattern is directed towards the front face of the wireless electronic device 1901. The black arrow of FIG. 29D illustrates the polarization of the signals at the first patch 2906. Referring now to FIG. 29E, the radiation pattern attributed to the second patch 2904 of FIG. 29A is illustrated. The radiation pattern is directed towards the back face of the wireless electronic device 1901. The black arrow of FIG. 29E illustrates the polarization of the signals at the second patch 2904.

Figure 30A:
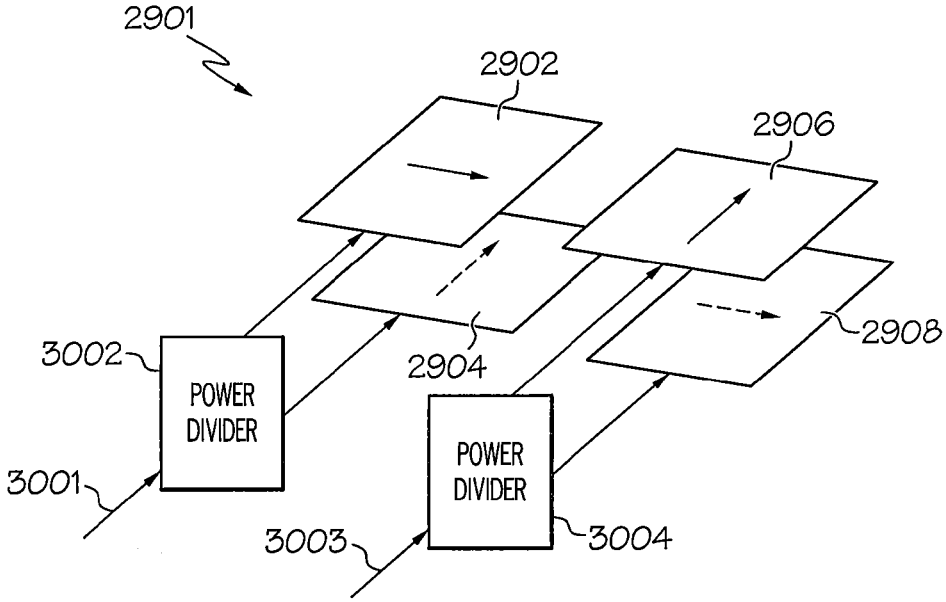
FIG. 30A illustrates a dual patch MIMO antenna array including power dividers, according to various embodiments of the present inventive concepts.

FIG. 30A illustrates a dual patch MIMO antenna array 2901 including power dividers associated with respective dual patch antennas. The dual patch MIMO antenna array 2901 may include a first dual patch MIMO antenna including a first patch 2902 and a second patch 2904. The dual patch MIMO antenna array 2901 may include a second dual patch MIMO antenna including a first patch 2906 and a second patch 2908. In some embodiments, the signal applied to the first patch 2902 may be orthogonal to the signal applied to the second patch 2904. Similarly, the signal applied to the first patch 2906 may be orthogonal to the signal applied to the second patch 2908. Moreover, in some embodiments, the signal applied to the first patch 2902 of a first dual patch MIMO antenna may be orthogonal to a signal applied to an adjacent first patch 2906 of a second dual patch MIMO antenna. A power divider 3002 may be associated with the first dual patch MIMO antenna and may be configured to divide a power of a signal 3001 into a first portion of the power and a second portion of the power. The power divider 3002 may apply the signal 3001 at the first portion of the power to the respective first patch 2902 and to apply the signal at the second portion of the power to the respective second patch 2904. A power divider 3004 may be associated with the second dual patch MIMO antenna and may be configured to divide a power of a signal 3003 into a first portion of the power and a second portion of the power. The power divider 3004 may apply the signal 3003 at the first portion of the power to the respective first patch 2906 and to apply the signal at the second portion of the power to the respective second patch 2908.

Figure 30B:
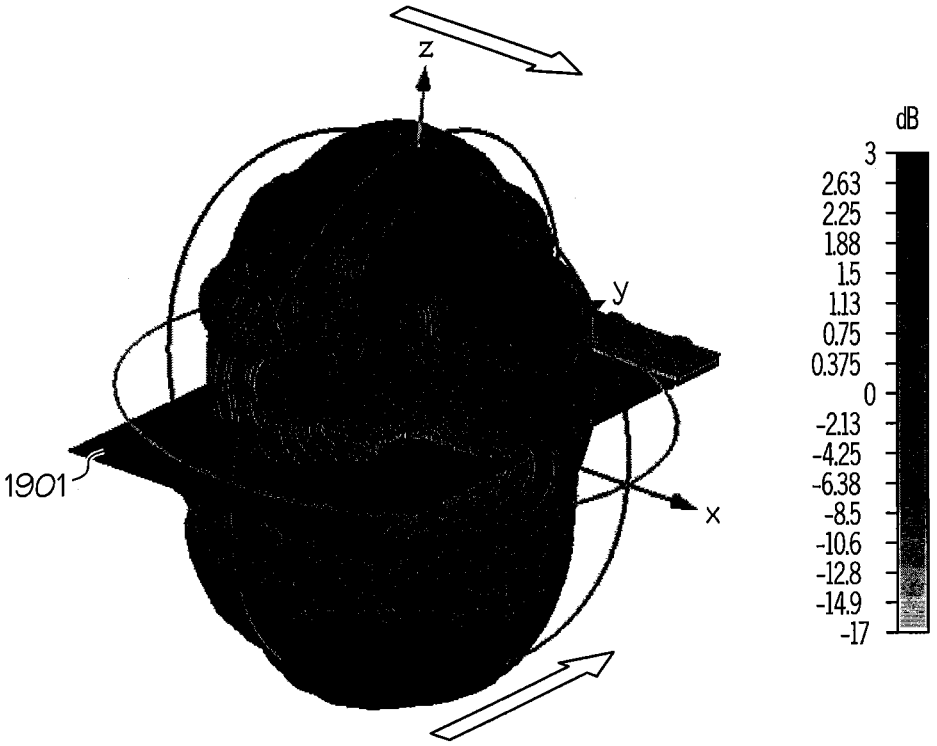
FIGS. 30B and 30C illustrate the radiation pattern around the wireless electronic device including a dual patch MIMO antenna array including the power divider of FIG. 30A, according to various embodiments of the present inventive concepts.
Figure 30C:
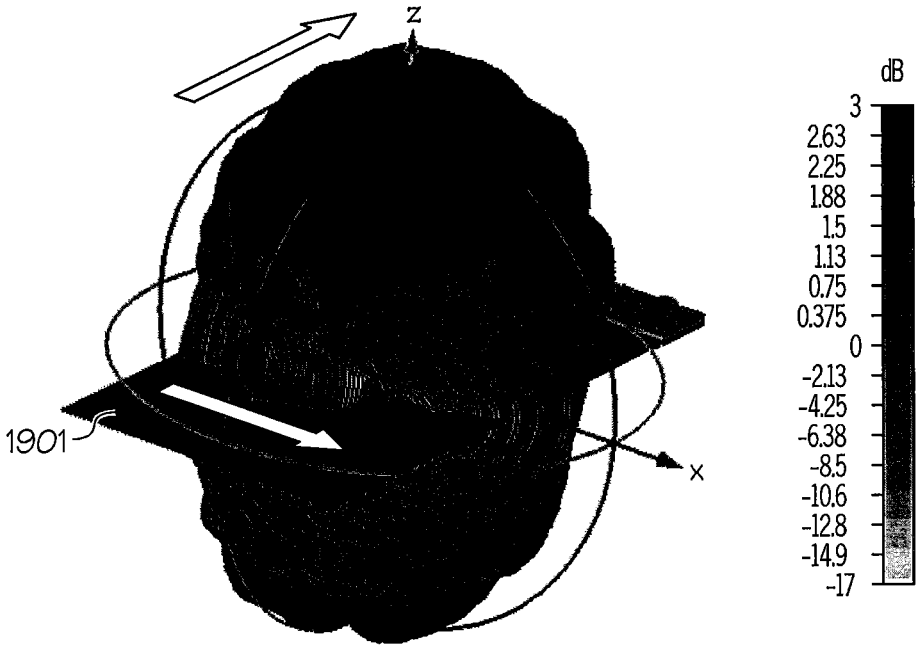

FIGS. 30B and 30C illustrate the radiation pattern around the wireless electronic device 1901, including a dual patch MIMO antenna array 2901 and power dividers 3002 and 3004 of FIG. 30A. Referring now to FIG. 30B, the radiation pattern associated with a first dual patch antenna including the first patch 2902 and second patch 2904 is illustrated. The radiation pattern spans both the front face and back face of the wireless electronic device 1902 since the power divider 3002 apply the signal 3001 at the first portion of the power to the first patch 2902 and/or applies the signal 3001 at the second portion of the power to the second patch 2904. The black arrows illustrate the polarization of the signals at the first patch 2902 and the second patch 2904. Referring now to FIG. 30C, the radiation pattern associated with a second dual patch antenna including the first patch 2906 and second patch 2908 is illustrated. The radiation pattern spans both the front face and back face of the wireless electronic device 1902 since the power divider 3004 apply the signal 3003 at the first portion of the power to the first patch 2906 and/or applies the signal 3003 at the second portion of the power to the second patch 2908. The black arrows illustrate the polarization of the signals at the first patch 2906 and the second patch 2908.

Figure 31A:
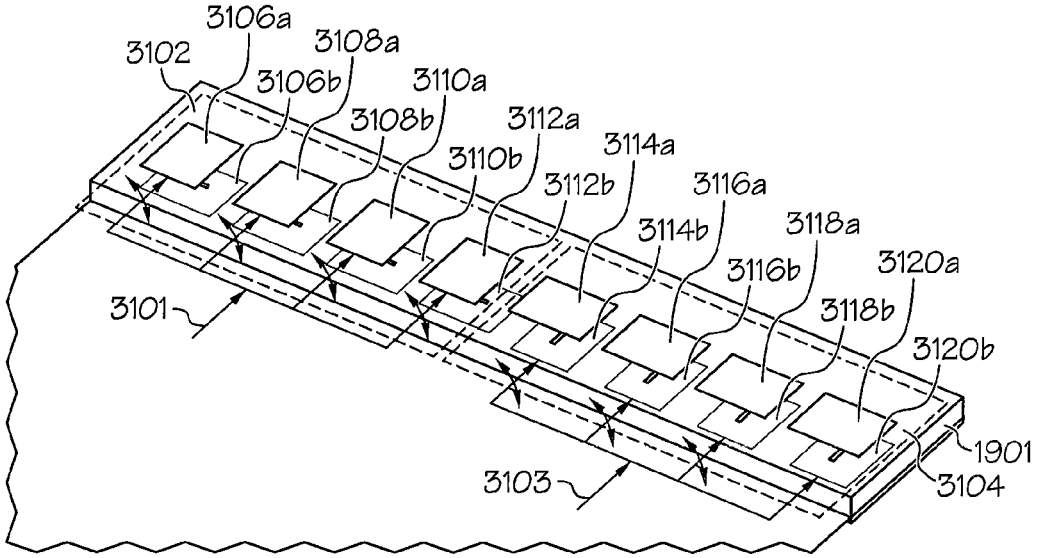
FIGS. 31A and 31B illustrate a dual patch MIMO antenna subarrays, according to various embodiments of the present inventive concepts.
Figure 31B:
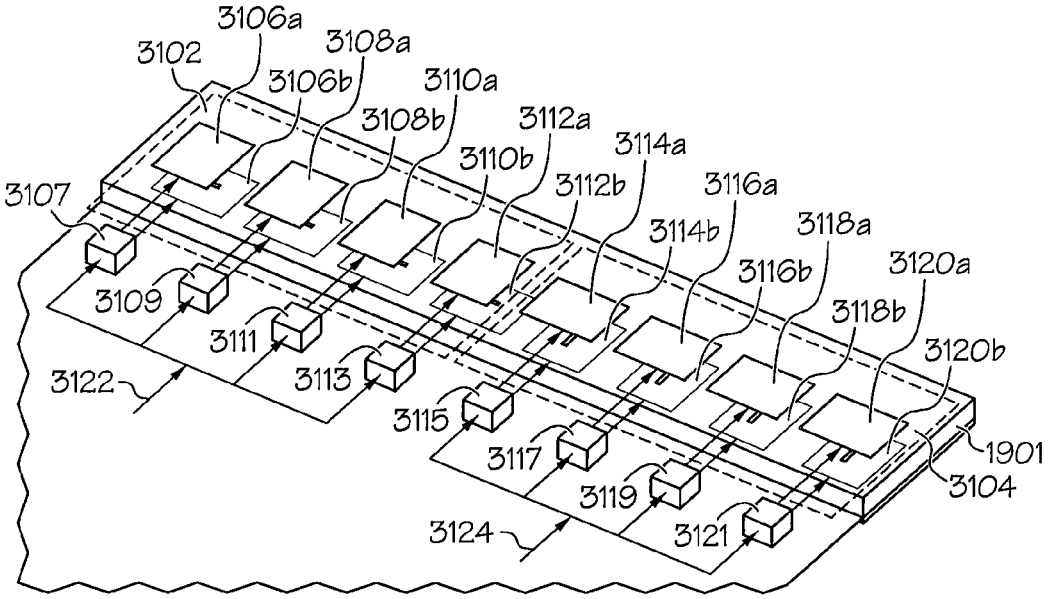

FIGS. 31A and 31B illustrate dual patch MIMO antenna subarrays 3102 and 3104 on a wireless electronic device 1901. Referring now to FIG. 31A, dual patch MIMO antenna subarrays for diversity combining applications are illustrated. A signal 3101 may be input into the first subarray 3102. The signal 3101 may be applied to one or more of the dual patch antennas in the first subarray 3102. In some embodiments, the signal 3101 may be applied to a first patch 3106*a* and/or a second patch 3106*b* of a first dual patch antenna, a first patch 3108*a* and/or a second patch 3108*b* of a second dual patch antenna, a first patch 3110*a* and/or a second patch 3110*b* of a third dual patch antenna, and/or a first patch 3112*a* and/or a second patch 3112*b* of a fourth dual patch antenna of the first subarray 3102. Likewise, a signal 3103 may be applied to one or more of the dual patch antennas in the second subarray 3104. In some embodiments, the signal 3103 may be applied to a first patch 3114*a* and/or a second patch 3114*b* of a first dual patch antenna, a first patch 3116*a* and/or a second patch 3116*b* of a second dual patch antenna, a first patch 3118*a* and/or a second patch 3118*b* of a third dual patch antenna, and/or a first patch 3120*a* and/or a second patch 3120*b* of a fourth dual patch antenna of the second subarray 3104.

Referring now to FIG. 31B, dual patch MIMO antenna subarrays 3102 and 3104 for diversity combining applications including power dividers are illustrated. The two subarrays 3102 and 3104 may be controlled separately based on signal characteristics, reducing power consumption and/or increasing coverage efficiently. For example, signal 3122 may be applied to subarray 3102 and/or signal 3124 may be applied to subarray 3104. Subarray 3102 and 3104 may correspond to subarrays 2808 and 2810 of FIG. 28 and may receive signals from different base stations and/or on channels with different propagation characteristics.

Still referring to FIG. 31B, in some embodiments, a signal 3122 may be applied to power dividers 3107, 3109, 3111, and/or 3113 of subarray 1302. Power divider 3107 may divide the power of the signal 3122 and apply the signal at the first portion of the power to the first patch 3106*a* and/or apply the signal at the second portion of the power to the second patch 3106*b*. Power divider 3109 may divide the power of the signal 3122 and apply the signal at the first portion of the power to the first patch 3108*a* and/or apply the signal at the second portion of the power to the second patch 3108*b*. Power divider 3111 may divide the power of the signal 3122 and apply the signal at the first portion of the power to the first patch 3110*a* and/or apply the signal at the second portion of the power to the second patch 3110*b*. Power divider 3113 may divide the power of the signal 3122 and apply the signal at the first portion of the power to the first patch 3112*a* and/or apply the signal at the second portion of the power to the second patch 3112*b*.

Still referring to FIG. 31B, in some embodiments, a signal 3124 may be applied to power dividers 3115, 3117, 3119, and/or 3121 of subarray 1304. Power divider 3115 may divide the power of the signal 3124 and apply the signal at the first portion of the power to the first patch 3114*a* and/or apply the signal at the second portion of the power to the second patch 3114*b*. Power divider 3117 may divide the power of the signal 3124 and apply the signal at the first portion of the power to the first patch 3116*a* and/or apply the signal at the second portion of the power to the second patch 3116*b*. Power divider 3119 may divide the power of the signal 3124 and apply the signal at the first portion of the power to the first patch 3118*a* and/or apply the signal at the second portion of the power to the second patch 3118*b*. Power divider 3121 may divide the power of the signal 3124 and apply the signal at the first portion of the power to the first patch 3120*a* and/or apply the signal at the second portion of the power to the second patch 3120*b*.

Figure 32:
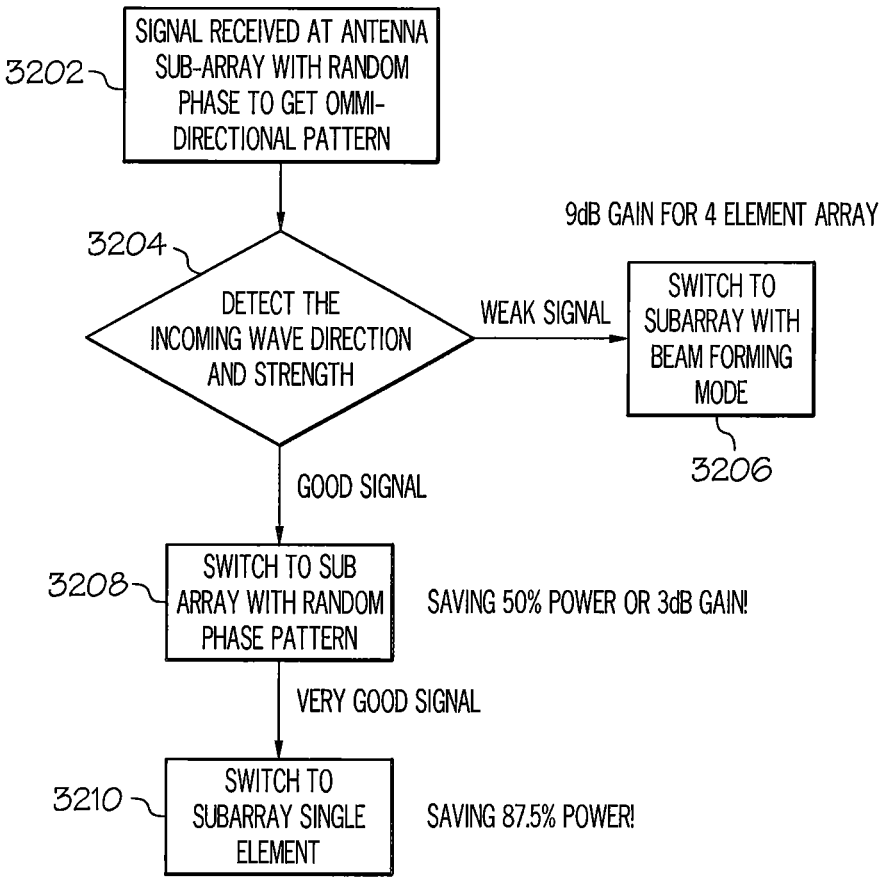
FIG. 32 illustrates operations that may be performed by a controller for the dual patch MIMO antenna subarrays of FIGS. 20-22, 31A and/or 31B, according to various embodiments of the present inventive concepts.

FIG. 32 illustrates operations that may be performed by a controller for the dual patch MIMO antenna subarrays of FIGS. 20-22, 31A and/or 31B. Referring to block 3202, a subarray of a dual patch MIMO antenna may transmit and/or receive a signal with an omni-directional pattern and/or a random phase. At block 3204, the wave direction and/or signal strength of an received signal may be detected. The received signal may be evaluated to determine the quality of the signal strength. The quality of the signal may be determined in relative terms such as "weak signal", "good signal" and/or "very good signal". In some embodiments the quality of the signal may be based on thresholds for the signal strength. Thresholds may be fixed and/or vary over time and may be absolute thresholds or a percentage of a given quality. If the received signal is determined to be a "weak signal", at block 3206, the dual patch MIMO antenna may use beam forming mode, thus utilizing one or more subarrays and first and/or second radiating elements. In some embodiments, this beam forming mode may provide 9 dB of gain for a four antenna array, compared to a conventional antenna. If the received signal is determined to be a "good signal", at block 3208, the dual patch MIMO antenna may use a single subarray with a random phase pattern. In some embodiments, use of a single subarray may provide a 3 dB gain and/or 50% savings in power, when compared to a conventional antenna. If the received signal is determined to be a "very good signal", at block 3210, the dual patch MIMO antenna may use a single subarray with a single radiating element. In some embodiments, use of a single subarray with a single radiating element may provide a power savings of 87.5%, compared to a conventional antenna.

Figure 33:
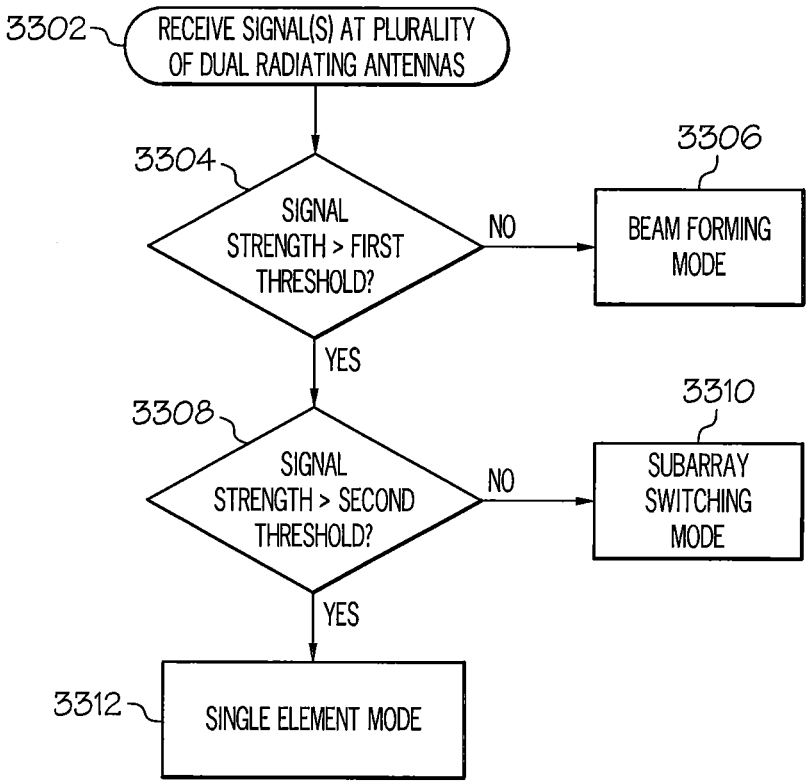
FIG. 33 illustrates a flowchart for determining modes of operating any of the antennas of FIGS. 19-22, 29A, 30A, 31A, and/or 31B, according to various embodiments of the present inventive concepts.

FIG. 33 illustrates a flowchart for determining modes of operating any of the antennas of FIGS. 19-22, 29A, 30A, 31A, and/or 31B, according to various embodiments of the present inventive concepts. Referring now to FIG. 33, one or more signals may be received at a plurality of dual radiating antennas, at block 3302. At block 3304, the signal strength of the received signals may be compared to a first threshold. If the signal strength is not greater than the first threshold, beam forming mode may be used by the antennas at block 3306. Specifically, beam forming mode may configure each of the power dividers of FIGS. 19-22, 29A, 30A and/or 31B for the first subarray to provide the signal at a first portion of the power of the signal that is greater than zero, and configure each of the power dividers of the second subarray to provide the signal at a second portion of the power of the signal that is greater than zero.

Still referring to FIG. 33, at block 3304, if the signal strength is greater than the first threshold, the signal strength may be evaluated with respect to a second threshold at block 3308. If the signal strength is not greater than the second threshold, subarray switching mode may be used by the antennas at block 3310. Subarray switching mode may include use of one subarray of the plurality of dual radiating antennas and/or may include using the first radiating elements or the second radiating elements of the subarray of dual radiating antennas. Specifically, the power dividers of FIGS. 19-22, 29A, 30A and/or 31B for the first subarray may be each configured to provide all of the power of the signal to the first radiating element and the power dividers of the second subarray may be each configured to provide all of the power of the signal to the second radiating element, or the power dividers of the first subarray may be each configured to provide all of the power of the signal to the second radiating element and/or the power dividers of the second subarray may be each configured to provide all of the power of the signal to the first radiating element.

Still referring to FIG. 33, at block 3308, if the signal strength is greater than the second threshold, single element mode may be used by the antennas at block 3312. Single element mode may include using a first or second radiating element of one dual radiating antenna. More specifically, in single element mode, a selected one of the power dividers of the first subarray or the power dividers of the second subarray may be configured to provide all of the power of the signal to a respective first radiating element and zero power to a respective second radiating element of a respective dual radiating antenna or may be configured to provide all of the power of the signal to a respective second radiating element and zero power to a respective first radiating element of a respective dual radiating antenna. In single element mode, the remaining ones of the power dividers of the first subarray and the power dividers of the second subarray, exclusive of the selected one, may be configured to provide zero power to respective first radiating elements and respective second radiating elements of respective dual radiating antennas.

Figure 34:
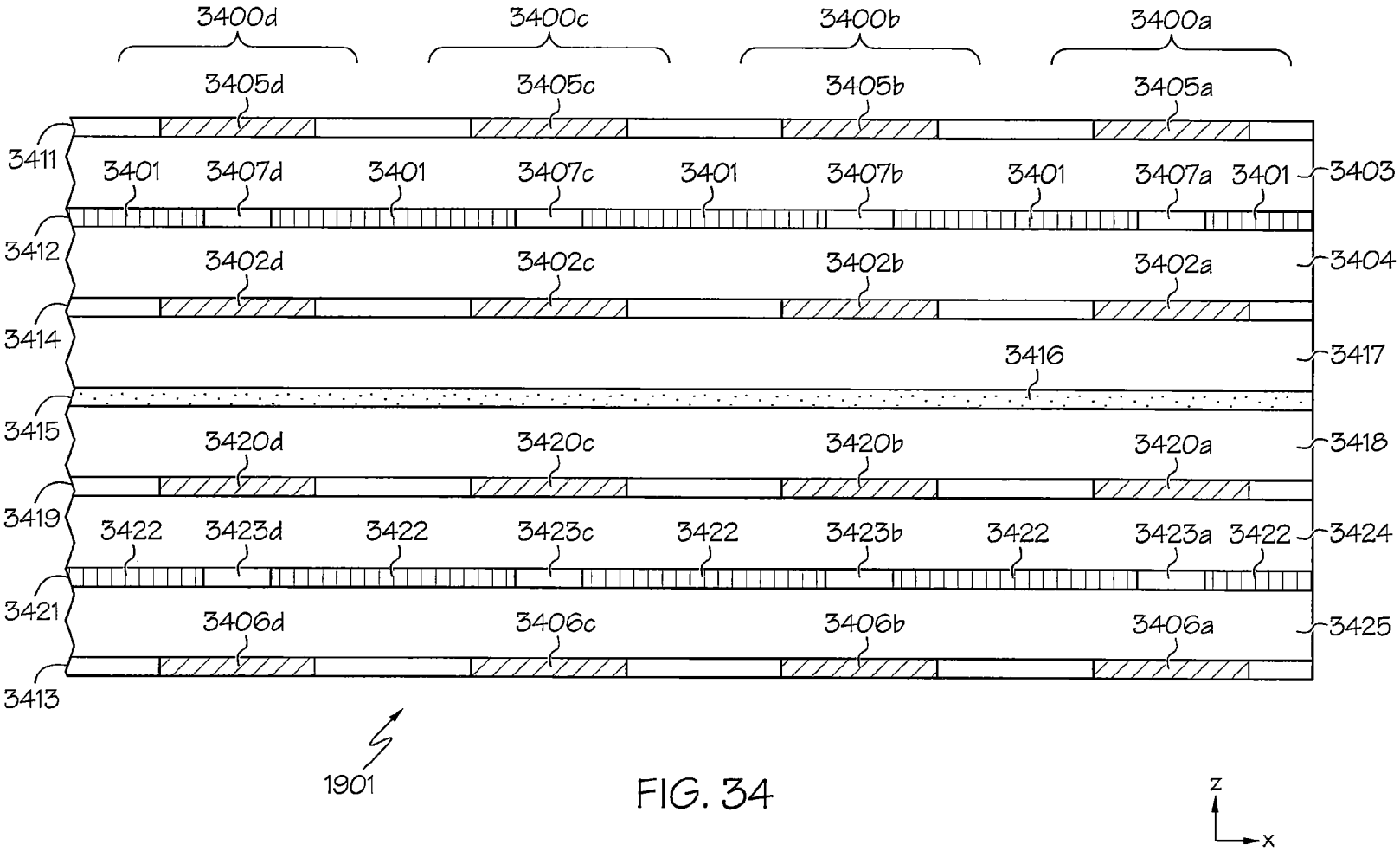
FIG. 34 illustrates a dual patch antenna array of any of FIGS. 19-22, 29A, 30A, 31A, and/or 31B, according to various embodiments of the present inventive concepts.

FIG. 34 illustrates a dual patch antenna array of any of FIGS. 19-22, 29A, 30A, 31A, and/or 31B. Referring now to FIG. 34, four dual radiating antennas 3400*a*, 3400*b*, 3400*c*, and 3400*d*, configured in a dual patch antenna array in a wireless electronic device 1901 of any of FIGS. 19-22, 29A, 30A, 31A, and/or 31B are illustrated. Dual radiating antenna 3400*a* will now be described in detail. Dual radiating antennas 3400*b*, 3400*c*, and 3400*d* are similar in structure to 3400*a* and will not be described in detail in the interest of brevity.

The first dual patch antenna 3400*a* may include a first conductive layer 3412 and a second conductive layer 3414. The first and second conductive layers (3412, 3414) may be arranged in a face-to-face relationship. The first and second conductive layers (3412, 3414) may be separated from one another by a first dielectric layer 3404. A first patch element 3405*a* may be in a fourth conductive layer 3411. The first conductive layer 3412 and the fourth conductive layer 3411 may be arranged in a face-to-face relationship separated by a second dielectric layer 3403. A second patch element 3406*a* may be in a fifth conductive layer 3413. A stripline 3402*a* may be in the second conductive layer 3412 of the first dual patch antenna 3400*a*. A ground plane 3401 may be in the second conductive layer 3412. The ground plane may include an opening or first slot 3407*a*. The width of the slot 3407*a* may be $W_{ap}$. The width of the slot 3407*a* may control impedance matching of the dual patch antenna 3400*a* to the wireless electronic device 1901. In some embodiments, the slot 3407*a* may overlap with the first patch element 3405*a* and/or the second patch element 3406*a*. In some embodiments, the slot 3407*a* may overlap with the stripline 3402*a*. In some embodiments, the slot 3407*a* may laterally overlap with the first patch element 3405*a* and/or the second patch element 3406*a*. In some embodiments, the slot 3407*a* may laterally overlap with the stripline 3402*a*. A signal may be received and/or transmitted through the stripline 3402*a*, causing the first dual patch antenna 3400*a* to resonate. In some embodiments, the second patch element 3406*a* may have a different corresponding stripline 3420*a* in a third conductive layer 3419. In some embodiments, the second patch element 3406*a* may have a different ground plane 3422 in a sixth conductive layer 3421. The ground plane 3422 may include a second slot 3423*a* in the sixth conductive layer 3421. In some embodiments, the sixth conductive layer 3421 may be separated from the third conductive layer 3419 by a fourth dielectric layer 3424. The sixth conductive layer 3421 may be separated from the fifth conductive layer 3413 by a sixth dielectric layer 3425. The two striplines 3402*a*, 3420*a* may each correspond to a different patch element 3405*a*, 3406*a*, respectively and thus may be used by the power divider 2008 of FIG. 20 to separately provide signals to the first patch element 3405*a* and/or the second patch element 3406*a*.

Still referring to FIG. 34, a power divider may be associated with the first dual patch antenna 3400*a*. The power divider is not illustrated in FIG. 34 for simplicity. The power divider may be internal or external to the first dual patch antenna 3400*a* but is electrically connected and/or coupled to the first stripline 3402*a* and/or the second stripline 3420*a*. The power divider may be configured to control a power of the signal that is applied to the first patch element 3405*a* and/or the second patch element 3406*a*. The first patch element 3405*a* and/or the second patch element 3406*a* may be configured such that a first polarization of the signal at the first patch element 3405*a* is orthogonal to a second polarization of the signal at the second patch element 3406*a*.

Still referring to FIG. 34, the first dual patch antenna 3400*a* may be included in a Printed Circuit Board (PCB). In some embodiments, the first dual patch antenna 3400*a* may include a PCB ground plane 3416 in a seventh conductive layer 3415. The seventh conductive layer 3415 may be separated from the second conductive layer 3414 by a third dielectric layer 3417. The seventh conductive layer 3415 may be separated from the third conductive layer 3419 by a fifth dielectric layer 3418.

The above discussed antenna structures for millimeter band radio frequency communication with dual radiating element antenna arrays may improve antenna performance by producing high gain signals that cover the three-dimensional space around a mobile device with uniform radiation patterns. In some embodiments, further performance improvements may be obtained by adding a plurality of power dividers to control various elements in the array of dual radiating element antennas based on signal conditions.

The terminology used herein is for the purpose of describing particular embodiments only and is not intended to be limiting of the embodiments. As used herein, the singular forms "a," "an," and "the" are intended to include the plural forms as well, unless the context clearly indicates otherwise. It will be further understood that the terms "comprises,"

"comprising," "includes," "including,", "having," and/or variants thereof, when used herein, specify the presence of stated features, steps, operations, elements, and/or components, but do not preclude the presence or addition of one or more other features, steps, operations, elements, components, and/or groups thereof.

It will be understood that when an element is referred to as being "coupled," "connected," or "responsive" to another element, it can be directly coupled, connected, or responsive to the other element, or intervening elements may also be present. In contrast, when an element is referred to as being "directly coupled," "directly connected," or "directly responsive" to another element, there are no intervening elements present. As used herein, the term "and/or" includes any and all combinations of one or more of the associated listed items.

Spatially relative terms, such as "above," "below," "upper," "lower," "top," "bottom," and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" other elements or features would then be oriented "above" the other elements or features. Thus, the term "below" can encompass both an orientation of above and below. The device may be otherwise oriented (rotated 90 degrees or at other orientations) and the spatially relative descriptors used herein interpreted accordingly. Well-known functions or constructions may not be described in detail for brevity and/or clarity.

It will be understood that, although the terms "first," "second," etc. may be used herein to describe various elements, these elements should not be limited by these terms. These terms are only used to distinguish one element from another. Thus, a first element could be termed a second element without departing from the teachings of the present embodiments.

Unless otherwise defined, all terms (including technical and scientific terms) used herein have the same meaning as commonly understood by one of ordinary skill in the art to which these embodiments belong. It will be further understood that terms, such as those defined in commonly-used dictionaries, should be interpreted as having a meaning that is consistent with their meaning in the context of the relevant art and will not be interpreted in an idealized or overly-formal sense unless expressly so defined herein.

Many different embodiments have been disclosed herein, in connection with the above description and the drawings. It will be understood that it would be unduly repetitious and obfuscating to literally describe and illustrate every combination and subcombination of these embodiments. Accordingly, the present specification, including the drawings, shall be construed to constitute a complete written description of all combinations and subcombinations of the embodiments described herein, and of the manner and process of making and using them, and shall support claims to any such combination or subcombination.

In the drawings and specification, there have been disclosed various embodiments and, although specific terms are employed, they are used in a generic and descriptive sense only and not for purposes of limitation.

What is claimed is:

1. A wireless electronic device, comprising:

a plurality of dual radiating antennas, wherein each of the dual radiating antennas comprises a first radiating element and a second radiating element; and a plurality of power dividers, a respective one of which is configured to divide a power of a signal into a first portion of the power and a second portion of the power, and to apply the signal at the first portion of the power to a respective first radiating element of a respective one of the plurality of dual radiating antennas and to apply the signal at the second portion of the power to a respective second radiating element of the respective one of the plurality of dual radiating antennas, wherein the wireless electronic device is configured to resonate at a resonant frequency corresponding to a respective first radiating element and/or a respective second radiating element of at least one of the plurality of dual radiating antennas when excited by the signal transmitted by at least one of the plurality of dual radiating antennas.

2. The wireless electronic device of claim 1, wherein a respective one of the plurality of dual radiating antennas is configured such that a first polarization of the signal at the first portion of the power applied to the first radiating element is orthogonal to a second polarization of the signal at the second portion of the power applied to the second radiating element.

3. The wireless electronic device of claim 1, wherein a third polarization of a respective first radiating element of a first one of the plurality of dual radiating antennas is orthogonal to a fourth polarization of a respective first radiating element of a second one of the plurality of dual radiating antennas that is adjacent the first one of the plurality of dual radiating antennas, and wherein a fifth polarization of a respective second radiating element of the first one of the plurality of dual radiating antennas is orthogonal to a sixth polarization of a respective second radiating element of the second one of the plurality of dual radiating antennas that is adjacent the first one of the plurality of dual radiating antennas.

4. The wireless electronic device of claim 3, wherein the third polarization is orthogonal to the fifth polarization, and wherein the fourth polarization is orthogonal to the sixth polarization.

5. The wireless electronic device of claim 1, wherein the wireless electronic device further comprises:

a first subarray comprising a first plurality of the dual radiating antennas and a first plurality of power dividers, a respective one of which is configured to divide the power of the signal and apply the signal to a respective one of the first plurality of the dual radiating antennas, and a second subarray comprising a second plurality, exclusive of the first plurality, of the dual radiating antennas and a second plurality of power dividers, a respective one of which is configured to divide the power of the signal and apply the signal to a respective one of the second plurality of the dual radiating antennas.

6. The wireless electronic device of claim 5, wherein the first subarray and/or the second subarray are configured to transmit multiple-input and multiple-output (MIMO) communication and/or diversity communication.

7. The wireless electronic device of claim 5, wherein the plurality of dual radiating antennas are further configured such that a seventh polarization of signals at each of the first radiating elements of the first plurality of the dual radiating antennas of the first subarray is orthogonal to an eighth polarization of signals at each of the first radiating elements of the second plurality of the dual radiating antennas of the second subarray, and wherein the plurality of dual radiating antennas are further configured such that a ninth polarization of signals at each of the second radiating elements of the first plurality of the dual radiating antennas of the first subarray is orthogonal to a ninth polarization of signals at each of the second radiating elements of the second plurality of the dual radiating antennas of the second subarray.

8. The wireless electronic device of claim 7, wherein the first plurality of power dividers of the first subarray are each configured to provide the signal at the first portion of the power of the signal that is greater than zero, and wherein the second plurality of power dividers of the second subarray are each configured to provide the signal at the second portion of the power of the signal that is greater than zero.

9. The wireless electronic device of claim 8, wherein the first plurality of power dividers of the first subarray are each configured to provide the signal at the first portion of the power of the signal that is greater than zero, and the second plurality of power dividers of the second subarray are each configured to provide the signal at the second portion of the power of the signal that is greater than zero, in response to a signal strength of the signal being less than a first threshold.

10. The wireless electronic device of claim 7, wherein the first plurality of power dividers of the first subarray are each configured to provide all of the power of the signal to the first radiating element and the second plurality of power dividers of the second subarray are each configured to provide all of the power of the signal to the second radiating element, or the first plurality of power dividers of the first subarray are each configured to provide all of the power of the signal to the second radiating element and the second plurality of power dividers of the second subarray are each configured to provide all of the power of the signal to the first radiating element.

11. The wireless electronic device of claim 10, wherein the first plurality of power dividers of the first subarray are each configured to provide all of the power of the signal to the first radiating element and the second plurality of power dividers of the second subarray are each configured to provide all of the power of the signal to the second radiating element, or the first plurality of power dividers of the first subarray are each configured to provide all of the power of the signal to the second radiating element and the second plurality of power dividers of the second subarray are each configured to provide all of the power of the signal to the first radiating element, in response to a signal strength of the signal being greater than a first threshold and less than a second threshold.

12. The wireless electronic device of claim 7, wherein a selected one of the first plurality of power dividers of the first subarray or the second plurality of power dividers of the second subarray is configured to provide all of the power of the signal to a respective first radiating element and zero power to a respective second radiating element of a respective dual radiating antenna or is configured to provide all of the power of the signal to a respective second radiating element and zero power to a respective first radiating element of a respective dual radiating antenna, and wherein remaining ones of the first plurality of power dividers of the first subarray and the second plurality of power dividers of the second subarray, exclusive of the selected one, are configured to provide zero power to respective first radiating elements and respective second radiating elements of respective dual radiating antennas.

13. The wireless electronic device of claim 12, wherein the selected one of the first plurality of power dividers of the first subarray or the second plurality of power dividers of the second subarray is configured to provide all of the power of the signal to the respective first radiating element and zero power to the respective second radiating element of the respective dual radiating antenna or is configured to provide all of the power of the signal to the respective second radiating element and zero power to the respective first radiating element of the respective dual radiating antenna, in response to a signal strength of the signal being greater than a second threshold.

14. The wireless electronic device of claim 1, further comprising:

a control signal that is applied to the respective one of the plurality of power dividers and that provides a first indication of a value of the first portion of the power and/or provides a second indication of a value of the second portion of the power.

15. The wireless electronic device of claim 14, further comprising:

a controller that is configured to generate the control signal.

16. The wireless electronic device of claim 1, wherein the first radiating element comprises a first dielectric block, and wherein the second radiating element comprises a second dielectric block.

17. The wireless electronic device of claim 1, wherein the first radiating element comprises a first patch element, and wherein the second radiating element comprises a second patch element.

18. The wireless electronic device of claim 1, further comprising:

a plurality of first striplines and a plurality of second striplines, wherein a respective one of the plurality of the first striplines and a respective one of the plurality of the second striplines are electrically coupled to a respective one of the plurality of power dividers, and wherein the respective one of the plurality of the first striplines is configured to apply a first signal to the first radiating element of the respective one of the plurality of dual radiating antennas, and wherein the respective one of the plurality of the second striplines configured to apply a second signal to the second radiating element of the respective one of the plurality of dual radiating antennas;

a first conductive layer comprising a plurality of first slots;

a second conductive layer comprising the plurality of first striplines, wherein a respective one of the plurality of first slots partially overlaps a respective one of the plurality of first striplines;

a third conductive layer comprising the plurality of second striplines; and a fourth conductive layer comprising a plurality of second slots, wherein a respective one of the plurality of second slots partially overlaps a respective one of the plurality of second striplines, wherein the first, second, third, and fourth conductive layers are arranged in a face-to-face relationship, separated from one another by first, second, and third dielectric layers, respectively.

19. A wireless electronic device, comprising:

first, second, third, and fourth conductive layers arranged in a face-to-face relationship, separated from one another by first, second, and third dielectric layers, respectively;

a plurality of first radiating elements; and a plurality of second radiating elements, wherein the first conductive layer comprises a plurality of first slots, wherein the second conductive layer comprises a plurality of first striplines, wherein the third conductive layer comprises a plurality of second striplines, wherein the fourth conductive layer comprises a plurality of second slots, wherein respective ones of the plurality of second radiating elements at least partially overlap respective ones of the plurality of first radiating elements, wherein a respective one of the plurality of first radiating elements at least partially overlaps a respective one of the plurality of the first slots, wherein a respective one of the plurality of second radiating elements at least partially overlaps a respective one of the plurality of the second slots, and wherein the wireless electronic device is configured to resonate at a resonant frequency corresponding to at least one of the plurality of the first radiating elements and/or at least one of the plurality of second radiating elements when excited by a signal transmitted and/or received though the first stripline and/or second stripline.

20. The wireless electronic device of claim 19, wherein a first one of the plurality of the first radiating elements and a respective first one of the plurality of the second radiating elements are configured such that a first polarization of the signal at the first one of the plurality of the first radiating elements is orthogonal to a second polarization of the signal at the respective first one of the plurality of the second radiating elements.

21. The wireless electronic device of claim 20, wherein a second one of the plurality of the first radiating elements and a respective second one of the plurality of the second radiating elements are configured such that a third polarization of the signal at the second one of the plurality of the first radiating elements is orthogonal to a fourth polarization of the signal at the respective second one of the plurality of the second radiating elements, wherein the first one of the plurality of the first radiating elements and the respective second one of the plurality of the first radiating elements are adjacent to one another, wherein the first one of the plurality of the second radiating elements and the respective second one of the plurality of the second radiating elements are adjacent to one another, and wherein the third polarization is orthogonal to the first polarization.

22. The wireless electronic device of claim 19, further comprising:

a plurality of power dividers, wherein a respective one of the plurality of the power dividers is electrically coupled to a respective one of the plurality of the first striplines and a respective one of the plurality of the second striplines, wherein a respective one of the plurality of the first striplines is configured to receive the signal at the first portion of a power of the signal from a respective one of the power dividers, and where a respective one of the plurality of the second striplines is configured to receive the signal at a second portion of the power of the signal from the respective one of the power dividers.

23. The wireless electronic device of claim 19, further comprising:

a fifth conductive layer comprising the plurality of first radiating elements; and a sixth conductive layer comprising the plurality of second radiating elements, wherein the plurality of first radiating elements comprises a plurality of first patch elements, and wherein the plurality of second radiating elements comprises a plurality of second patch elements.

24. The wireless electronic device of claim 22, further comprising:

a controller that is configured to generate a control signal that is applied to the respective one of the plurality of the power dividers and that provides an indication of a value of the first portion of the power and/or a second portion of the power.

25. The wireless electronic device of claim 19, further comprising:

wherein the plurality of first radiating elements comprise a plurality of first dielectric blocks on the first conductive layer, wherein a respective one of the plurality of the first dielectric blocks at least partially overlaps a respective one of the plurality of first slots, wherein the plurality of second radiating elements comprises a plurality of second dielectric blocks on the fourth conductive layer, and wherein a respective one of the plurality of the second dielectric blocks at least partially overlaps a respective one of the plurality of second slots.

* * * * *